US008007976B2

(12) United States Patent
Sugiura et al.

(10) Patent No.: US 8,007,976 B2
(45) Date of Patent: Aug. 30, 2011

(54) ELECTROSTATIC IMAGE DEVELOPING TONER, TONER KIT AND IMAGE FORMING APPARATUS

(75) Inventors: Hideki Sugiura, Fuji (JP); Hiroyuki Fushimi, Numazu (JP); Osamu Uchinokura, Mishima (JP); Takahiro Honda, Fujinomiya (JP); Masami Tomita, Numazu (JP); Hyo Shu, Mishima (JP); Ken Umehara, Chiba (JP)

(73) Assignee: Ricoh Company. Ltd., Tokyo (JP)

( * ) Notice: Subject to any disclaimer, the term of this patent is extended or adjusted under 35 U.S.C. 154(b) by 329 days.

(21) Appl. No.: 12/091,301

(22) PCT Filed: Nov. 1, 2006

(86) PCT No.: PCT/JP2006/321912

§ 371 (c)(1),
(2), (4) Date: Apr. 24, 2008

(87) PCT Pub. No.: WO2007/052725

PCT Pub. Date: May 10, 2007

(65) Prior Publication Data

US 2009/0123186 A1 May 14, 2009

(30) Foreign Application Priority Data

Nov. 2, 2005 (JP) ..... 2005-319577
Nov. 9, 2005 (JP) ..... 2005-324898

(51) Int. Cl.
*G03G 15/04* (2006.01)

(52) U.S. Cl. ..... 430/109.2; 430/109.4; 430/110.1; 430/110.4; 430/107.1; 430/108.1

(58) Field of Classification Search ..... 430/109.2, 430/109.4, 110.1, 110.4, 107.1, 108.1
See application file for complete search history.

(56) References Cited

U.S. PATENT DOCUMENTS

2002/0058193 A1 * 5/2002 Tosaka et al. ..... 430/108.23

(Continued)

FOREIGN PATENT DOCUMENTS

EP 1 329 774 A2 7/2003

(Continued)

OTHER PUBLICATIONS

Supplementary European Search Report issued Nov. 29, 2010 in EP 06 82 2832.

(Continued)

*Primary Examiner* — Hoa V Le

(74) *Attorney, Agent, or Firm* — Oblon, Spivak, McClelland, Maier & Neustadt, L.L.P.

(57) ABSTRACT

A toner is provided that comprises a colorant and a binder resin, wherein the binder resin comprises a polyester resin that is prepared by a polycondensation reaction in the presence of at least a titanium-containing catalyst expressed by General Formula (II) or (II), the toner has a volume average particle diameter of 2.0 μm to 10.0 μm and a ratio Dv/Dn within a range of 1.00 to 1.40, in which Dv represents a volume average particle diameter and Dn represents a number average particle diameter, Ti(—X)m(—OH)n General Formula (I)

O=Ti(—X)p(—OR)q General Formula (II)

in General Formulas (I) and (II), X represents a residue of a mono-alkanolamine of 2 to 12 carbon atoms or a polyalkanolamine from which a hydrogen atom of one hydroxyl group is removed; other hydroxyl group(s) and still other hydroxyl group(s), within the polyalkanolamine molecule that has a directly bonding Ti atom, may polycondense to form a ring structure; other hydroxyl group(s) and still other hydroxyl group(s) may polycondense intermolecularly to form a repeating structure; and the polymerization degree is 2 to 5 in a case of forming the repeating structure; R represents one of a hydrogen atom and alkyl groups of 1 to 8 carbon atoms that may have 1 to 3 ether bonds; "m" is an integer of 1 to 4; "n" is an integer of 0 to 3; the sum of "m" and "n" is 4; "p" is an integer of 1 or 2; "q" is an integer of 0 or 1; the sum of "p" and "q" is 2; and in a case that "m" and "p" is 2 or more, the respective Xs may be identical or different each other.

22 Claims, 13 Drawing Sheets

U.S. PATENT DOCUMENTS

| | | | | |
|---|---|---|---|---|
| 2003/0207186 | A1 | 11/2003 | Itakura et al. | |
| 2005/0042534 | A1 | 2/2005 | Tanaka et al. | |
| 2006/0014094 | A1* | 1/2006 | Yuasa et al. | 430/108.2 |
| 2006/0167214 | A1 | 7/2006 | Terauchi et al. | |
| 2007/0065746 | A1* | 3/2007 | Kawase et al. | 430/110.3 |
| 2009/0220881 | A1* | 9/2009 | Takase | 430/109.2 |
| 2009/0305157 | A1 | 12/2009 | Koike et al. | |
| 2009/0305158 | A1 | 12/2009 | Ono et al. | |

FOREIGN PATENT DOCUMENTS

| | | | |
|---|---|---|---|
| EP | 1 329 774 | A3 | 7/2003 |
| EP | 1 887 430 | A1 | 2/2008 |
| EP | 1 887 432 | A1 | 2/2008 |
| JP | 62 178278 | | 8/1987 |
| JP | 63 88564 | | 4/1988 |
| JP | 63 184762 | | 7/1988 |
| JP | 3 56974 | | 3/1991 |
| JP | 4 313760 | | 11/1992 |
| JP | 6 230609 | | 8/1994 |
| JP | 7 62766 | | 7/1995 |
| JP | 8 30017 | | 2/1996 |
| JP | 9 171271 | | 6/1997 |
| JP | 9 211896 | | 8/1997 |
| JP | 11 218965 | | 8/1999 |
| JP | 2003 215847 | | 7/2003 |
| JP | 2004 77664 | | 3/2004 |
| JP | 2005 181839 | | 7/2005 |
| JP | 2005 258102 | | 9/2005 |
| JP | 2006 243715 | | 9/2006 |
| KR | 10-2005-0006232 | | 1/2005 |
| KR | 10-2005-0051543 | | 6/2005 |
| WO | WO 2004/055600 | A1 | 7/2004 |

OTHER PUBLICATIONS

U.S. Appl. No. 12/203,278, filed Sep. 3, 2008, Yamada, et al.

* cited by examiner

ELECTROSTATIC IMAGE DEVELOPING TONER, TONER KIT AND IMAGE FORMING APPARATUS

TECHNICAL FIELD

The present invention relates to electrostatic image developing toners, containing a polyester resin as a binder resin, that are utilized as dry toners to develop electrostatic images or magnetic latent images in electrophotographic, electrostatic recording or electrostatic printing processes; and also toner kits and image forming apparatuses.

BACKGROUND ART

Polyester resins have been used as binders in the art in order to improve low temperature toner fixability (Patent Literatures 1 and 2). In order to improve the low temperature toner fixability still further, the molecular mass and/or the glass transition temperature Tg should be lowered with respect to the resins, however, which typically leading to poor blocking resistance of toners under high temperature and high humidity conditions. Such resins are also problematic as to reduce charging capacity of developers since the toners adhere firmly to carriers, developing sleeves, etc. Moreover, the reduction of charging capacity tends to be pronounced with time in particular under high temperature and high humidity conditions or low temperature and low humidity conditions with large image areas. As such, toners and/or image forming apparatuses have been demanded that can output stably high quality images under a wide variety of operating conditions meanwhile being substantially non-problematic under usual operating conditions.

A binder containing a charge controller or a charge control agent is proposed in order to improve charging ability or charge stability and to prevent background smear (Patent Literature 3). However, the charge controller typically exhibits a low temperature fixability inferior to that of polyester resins, thus is likely to deteriorate the low temperature fixability of polyester resins. It is therefore necessary for the toner to improve the low temperature fixability still more that the charge controller should disperse uniformly into the toner and represent a sufficient charging property in less amount.

Developers are typically used in electrophotographic, electrostatic recording or electrostatic printing processes in a way that a developer firstly attaches to a photoconductor on which an electrostatic image is formed in a developing step, then the developer is transferred from the photoconductor to a recording medium such as paper in a transfer step and fixed on the recording medium in a transfer step. The developers for developing electrostatic images on the surfaces with latent images are usually two-component developers containing a carrier and a toner or one-component developers containing a magnetic or non-magnetic toner and no carrier. In the processes as regards the two-component developers, the toner particles tend to attach the carrier surface to degrade the developer, and one-sided consumption of toners decreases the toner concentration in the developers, which requires to maintain a certain ratio between toner and carrier by means of large-size developing devices. On the other hand, the apparatuses or devices have been downsized by virtue of advanced function of developing rollers as regards the one-component developers.

In recent years, automation and coloring have been popularized still further in offices, such that various graphs by means of personal computers, images taken with digital cameras, or pictorial drafts read by scanners are printed and copied on a number of papers for personal presentation, for example. Images to be output by printers typically contain a complicated configuration including solid images, line images and halftone images even in one draft, thus are demanded in various manners along with high reliability.

Conventional electrophotographic processes on the basis of one-component developers are classified into magnetic one-component developing processes by use of magnetic toners and non-magnetic one-component developing processes by use of non-magnetic toners. In the magnetic one-component developing processes, which have been recently in practical use for numerous small-size printers etc., a magnetic toner that contains a magnetic material such as magnetites is supported by a developer bearing member with a magnetic field-generating unit therein, and the toner is thin-layered by means of a layer thickness-control member and developed subsequently. However, most of the magnetic materials are of colored or black, which affording a deficiency that the coloring is difficult.

On the other hand, in the non-magnetic one-component developing processes, a toner supply roller etc. is urged to contact with a developer bearing member thereby to supply a toner on the developer bearing member that electrostatically supports the toner, which is then thin-layered by means of a layer thickness-control member and developed, by virtue of the non-magnetic property of toners. The processes may advantageously be compliant to colorizing due to the absence of color magnetic materials, and the apparatuses may be small-sized still more and of low cost due to the absence of magnets in developer bearing members, thus have been recently in practical use for small-size full-color printers etc.

The two-component developing systems may maintain stably the charging ability and the transportability even under prolonged usage and be easily compliant with high-speed developing devices, since a carrier is employed as a means for charging and transporting, the toner and the carrier is sufficiently stirred inside a developing unit and then transported to a developer bearing member before the developing.

In contrast, there remain currently many problems to be solved in the one-component developing processes. That is, problems in charging or transporting tend to occur under prolonged usage or high speed in the one-component developing processes due to the absence of the charging and transporting means such as carriers. Specifically, when the toner is transported on the developer bearing member followed by thin-layering the toner by means of the layer thickness-control member before the developing in the one-component developing processes, toners of low or inverse charging tend to generate in a rate more than that of the two-component developing processes since the contacting or the frictional charging period is significantly shorter between the toner and the developer bearing member, the layer thickness-control member or the frictional electrification.

In non-magnetic one-component developing processes, toners or developers are transported typically by at least one toner transporting member and electrostatic latent images on the latent image are developed by use of the transported toner. In the processes, the layer thickness of the toner should be as thin as possible on the surface of the toner transporting member. This is applicable to two-component developers with carriers having a very small diameter. When one-component developers and toners with a high electric resistance are employed together with, the layer thickness of the toner should also be as thin as possible in particular, since the toners are to be charged by developing units. In cases where the toner layer is thick, the toner layer is likely to be charged at only around its surface and far from uniformly charging over the entire toner layer. Therefore, toners are required to exhibit a rapid charging velocity and an appropriate charging amount.

As such, charge control agents and additives are conventionally added to toners in order to stabilize the charging ability. The charge control agent controls and maintains the frictional charge amount of toners. The charge control agents of negative electricity are exemplified by mono azo dyes; metal salts of salicylic acid, naphthoic acid and dicarboxylic acids; metal complex salts of dicarboxylic acids; diazo compounds; and boron complex compounds. The charge control agents of positive electricity are exemplified by quaternary ammonium salts, imidazole compounds, nigrosines and azine dyes.

However, some of these charge control agents are of chromatic color and inadequate for color toners. In addition, some of these charge control agents have a poor compatibility with binder resins and those on toner surface, which mostly contributing to the charging, tend to separate from the surface and fluctuate the charging ability of toners, or may disadvantageously smear developing sleeves or cause filming on photoconductors.

Therefore, there conventionally arises a troublesome phenomenon that initial appropriate images degrade gradually to cause background smear or unclearness. In cases of continuous color copy along with supplying toners in particular, long term usage cannot be achieved since the charge amount of toners decreases and the initial tone of images significantly alters, such that no more than several thousand sheets of copy bring about premature exchange of process cartridges of an imaging unit, which leading to a large environmental load and bothersome processing of users. Moreover, heavy metals in almost all process cartridges are causing a social safety issue in recent years.

In order to solve the problems described above, resin charge-control agents are proposed that improve the compatibility with binder resins, clarity of fixed toner images and environmental safety. The resin charge-control agents may afford stable charging ability/clarity due to appropriate compatibility with binder resins. However, the charge control agents are inferior in the charge amount/charging rate compared to toners containing mono azo dyes, metal salts or metal complex salts of salicylic acid, naphthoic acid or dicarboxylic acids. When the added amount of the resin charge-control agent increases, the charging ability may be improved but the toner fixability such as low temperature fixability or offset resistance is likely to degrade. Moreover, these compounds tend to exhibit excessively large environmental stability or moisture resistance with respect to their charge amount, which possibly resulting in background smear or fog (Patent Literatures 4 to 7).

As such, copolymers are proposed that are proposed from monomers having an organic acid salt such as a sulfonic acid salt group and aromatic monomers having an electron attracting group. However, these copolymers represent an insufficient dispersion into the binder resins, and the effects on suppressing the fluctuation of toner charge amount or preventing the filming on developing sleeves or photoconductors are insufficient as regarding a prolonged period, although the charge amounts are sufficient by virtue of the moisture absorbability and tackiness derived possibly from monomers containing the organic acid salt such as the sulfonic acid salt group (Patent Literatures 8 to 11).

In addition, such copolymers are proposed, formed of monomers containing an organic acid salt like a sulfonic acid salt group, aromatic monomers containing an electron-attracting group, and styrene or polyester monomers, in order to enhance the compatibility with binder resins such as styrene resins and polyester resins, however, providing insufficient effects on maintaining the charge amount or preventing the filming on developing sleeves or photoconductors. In particular, the charge control agents are typically unsatisfactory in combination with polyester or polyol resins as used for a color toner binder resin that are usually desirable in terms of coloring property and intensity.

There have been such a technical trend that the apparatuses are small-sized, high-speed, and cost-lowered along with the printer market expanding; and currently, the apparatuses are demanded for higher reliability and longer life, toners are required to maintain their properties for a long period; however, the resin charge-control agents are less likely to maintain their charge control effect thus to blur or foul the developing sleeves or layer thickness-control members such as blades and rollers, consequently decreasing charging ability of toners and causing filming on photoconductors.

The small-sized, high-speed apparatuses necessarily lead to developing processes with lower amounts of developers and shorter periods, which requiring developers having an excellent initial charging property. A variety of developing systems have been proposed for both of one-component developers and two-component developers; non-magnetic one-component development is desirable for printers by virtue of small-sizing or weight-saving ability and absence of carriers. In the developing systems, the toner amount on developing rollers is adjusted by way of forcibly frictioning and attaching toners on developing rollers or by means of blades since such properties are poor as toner-supplying ability onto the developing rollers and toner-sustaining ability on the developing rollers. As a result, there arise such problems as filming tendency of toners onto the developing rollers, shorter lifetime of the developing rollers and unstable charge amount of toners, and these problems possibly disturb adequate development. Accordingly, color toners for the non-magnetic one-component development are often unsatisfactory in thermal resistance of toner binder resins in addition to usually necessary properties for conventional color toners, thus are likely to cause toner filming on the developing rollers.

Furthermore, Patent Literatures 1 to 4 describes Examples that show poor charge amount and charging velocity. When the added amount of resin charge-control agents for the countermeasure is increased, the charging ability may be improved but the toner fixability such as low temperature fixability or offset resistance is likely to be deteriorated. Moreover, these compounds tend to exhibit excessively large environmental stability or moisture resistance in their charge amount, which possibly resulting in background smear or fog.

Furthermore, the proposals in Patent Literatures 8 to 11 may assure a sufficient charge amount due to moisture absorbability or adhesive property, however, there remain such problems as insufficient dispersion into toner binders, unsatisfactory suppression of charge fluctuation and insufficient effect on preventing filming onto sleeves and photoconductors.

In forming images by electrophotographic processes, a latent image is electrostatically formed on an image bearing member of photoconductive materials etc., then charged toner particles are attached to the electrostatic latent image to form a visible image, followed by transferring the toner image onto a recording medium like papers and fixing thereof to produce an output image. In recent years, electrophotographic copiers and printers are changing rapidly from monochrome to full-color systems, and the full-color market has been expanding.

In forming color images by full-color electrophotographic processes, typically, color toners of three elementary colors of yellow, magenta and cyan or four colors adding black thereto are duplicated to reproduce every color. In order to produce clear full-color images with excellent color reproducibility, therefore, the surface of fixed toner images should be somewhat smoothed to decrease optical diffraction, and it is also important that pigments are uniformly dispersed into toners and the dispersed pigments maintain the finely dispersed condition without re-coagulating.

In order to reproduce the color of human skin in particular, it is required that the color is expressed by a subtractive mixing process through overlapping a yellow toner and a magenta toner, thus an optimum combination from yellow pigments, magenta pigments and resins for dispersion matrix has been investigated as a subject matter.

Patent Literature 12, for example, discloses a magenta toner for developing electrostatic images, in which the toner is prepared by way of dissolving a toner composition, containing a polyester resin modified to form a urea bond, into an organic solvent to form a solution, which then undergoes a polyaddition reaction, then the dispersion liquid is removed for the solvent and rinsed, and the toner contains at least a colorant of a specific compound.

In addition, Patent Literature 13 discloses a magenta toner for electrophotography containing at least a binder resin and a colorant, in which the toner contains a naphthol pigment having a certain structure as the colorant, and the tone has a shape factor SF1 of 110 to 140 and a volume average particle diameter of 2 to 9 μm.

However, these proposals may be far from recovering by themselves the poor color reproducibility due to pigment re-agglomeration in toners, and thus the color reproducibility of images is currently far from accurate reproduction as for human shin color in particular.

Patent Literature 1: Japanese Patent Application Laid-Open (JP-A) No. 62-178278

Patent Literature 2: JP-A No. 4-313760

Patent Literature 3: JP-A No. 7-062766

Patent Literature 4: JP-A No. 63-88564

Patent Literature 5: JP-A No. 63-184762

Patent Literature 6: JP-A No. 03-56974

Patent Literature 7: JP-A No. 06-230609

Patent Literature 8: JP-A No. 08-30017

Patent Literature 9: JP-A No. 09-171271

Patent Literature 10: JP-A No. 9-211896

Patent Literature 11: JP-A No. 11-218965

Patent Literature 12: JP-A No. 2004-77664

Patent Literature 13: JP-A No. 2003-215847

DISCLOSURE OF INVENTION

It is an object of the present invention to provide an electrostatic image developing toner that is excellent in blocking resistance as well as low temperature fixability under high temperature and high humidity conditions, free from background smear, and far from lowering charging ability of developers due to firm deposition of toner ingredients onto carriers or developing sleeves with time even under high temperature and high humidity conditions or low temperature and low humidity conditions and also under outputting with large image areas, thus outputting stably high quality images.

It is another object of the present invention to provide an electrostatic image developing dry-toner that can control and maintain stably the frictional charge amount of the toner, keep stably the frictional charging ability, be excellent in transportability, developing ability, transferring ability and storage stability, and be free from abnormal images caused by deposition onto photoconductors.

It is another object of the present invention to provide a one-component and a two-component developer each utilizing the electrostatic image developing toner and an image forming apparatus utilizing at least one of the developers.

It is another object of the present invention to provide a toner kit for developing latent electrostatic images, which is free from re-agglomeration of pigments once-dispersed into resins and the related inferior color reproducibility, thus can appropriately represent a color reproducibility of yellow and magenta, and also red in a subtractive mixing process.

The present inventors have been investigated vigorously to solve the problems described above and have found that the problems may be solved by a toner binder of a polycondensation polyester resin produced under a specific catalyst and a toner having a particle diameter and a particle diameter distribution each controlled in a certain range, or by use of a specific charge control agent.

The present invention has been made based on the findings described above; the problems described above can be solved by the invention as follows:

<1> A toner, comprising a colorant and a binder resin, wherein the binder resin comprises a polyester resin that is prepared by a polycondensation reaction in the presence of at least a titanium-containing catalyst expressed by General Formula (I) or (II), the toner has a volume average particle diameter of 2.0 μm to 10.0 μm and a ratio Dv/Dn of 1.00 to 1.40, in which Dv represents a volume average particle diameter and Dn represents a number average particle diameter,

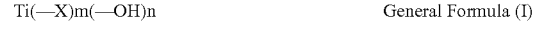

Ti(—X)m(—OH)n General Formula (I)

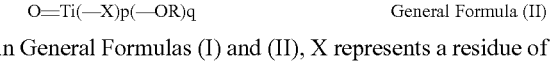

O═Ti(—X)p(—OR)q General Formula (II)

in General Formulas (I) and (II), X represents a residue of a mono-alkanolamine of 2 to 12 carbon atoms or a polyalkanolamine from which a hydrogen atom of one hydroxyl group is removed; other hydroxyl group(s) and still other hydroxyl group(s), within the polyalkanolamine molecule that has a directly bonding Ti atom, may polycondense to form a ring structure; other hydroxyl group(s) and still other hydroxyl group(s) may polycondense intermolecularly to form a repeating structure; and the polymerization degree is 2 to 5 in a case of forming the repeating structure;

R represents one of a hydrogen atom and alkyl groups of 1 to 8 carbon atoms that may have 1 to 3 ether bonds; "m" is an integer of 1 to 4; "n" is an integer of 0 to 3; the sum of "m" and "n" is 4; "p" is an integer of 1 or 2; "q" is an integer of 0 or 1; the sum of "p" and "q" is 2; and in a case that "m" and "p" is 2 or more, the respective Xs may be identical or different each other.

<2> The toner according to <1>, wherein the polyester resin comprises at least a species of polyester resin that is prepared by a polycondensation reaction in the presence of a titanium-containing catalyst expressed by General Formula (I) or (II), and X in General Formulas (I) and (II) represents a residue of a dialkanolamine or a trialkanolamine from which a hydrogen atom of one hydroxyl group is removed.

<3> The toner according to <1> or <2>, wherein the polyester resin comprises at least a species of polyester resin that is prepared by a polycondensation reaction in the presence of a titanium-containing catalyst expressed by General Formula (I) or (II), in which "m" or "p" is 2 or more, and all of Xs are an identical group.

<4> The toner according to any one of <1> to <3>, wherein the polyester resin comprises at least a species of polyepoxide-modified resin.

<5> The toner according to any one of <1> to <4>, wherein the polyester resin comprises substantially no THF insoluble matter, the content of the ingredients having a molecular mass of 500 or less is no more than 4% by mass in the molecular mass distribution based on gel permeation chromatography, and a main peak exists within a range of 3000 to 9000 in the molecular mass distribution.

<6> The toner according to any one of <1> to <5>, wherein the binder resin represents an endothermic peak within a range of 60° C. to 70° C. under the measurement using a differential scanning calorimeter (DSC).

<7> The toner according to any one of <1> to <6>, wherein the binder resin has a ratio Mw/Mn of 2 to 10, in which Mw represents a mass average molecular mass and Mn represents a number average molecular mass.

<8> The toner according to any one of <1> to <7>, wherein the binder resin has an acid value of 10 mgKOH/g or less.

<9> The toner according to any one of <1> to <8>, wherein the binder resin represents a temperature within a range of 95° C. to 120° C. at which the apparent viscosity comes to $10^3$ Pa·s measured by a flow tester.

<10> A toner kit, comprising the toner according to any one of <1> to <9>, wherein the toner kit comprises a yellow toner, a magenta toner and a cyan toner, the magenta toner comprises an organic pigment expressed by the following Structural Formula (1), and the yellow toner comprises an organic pigment having two units per molecule each expressed by Structural Skeleton (A) and no halogen atom;

Structural Formula (1)

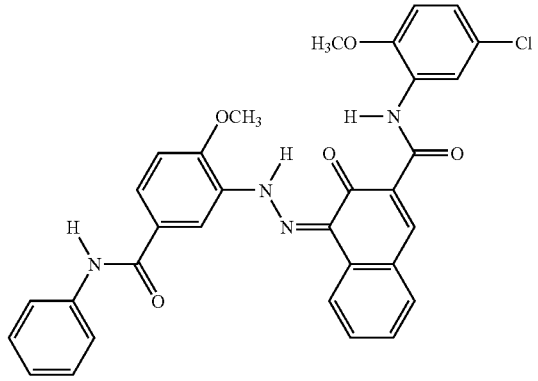

Structural Skeleton (A)

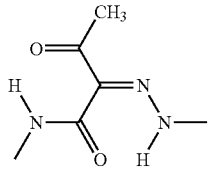

in the Structural Formula (1) and Structural Skeleton (A), ═C═N—NH— may be ═CH—N═N—.

<11> The toner kit according to <10>, wherein the organic pigment, having two units per molecule each expressed by Structural Skeleton (A) and no halogen atom, is an organic pigment expressed by Structural Formula (2) or (3).

Structural Formula (2)

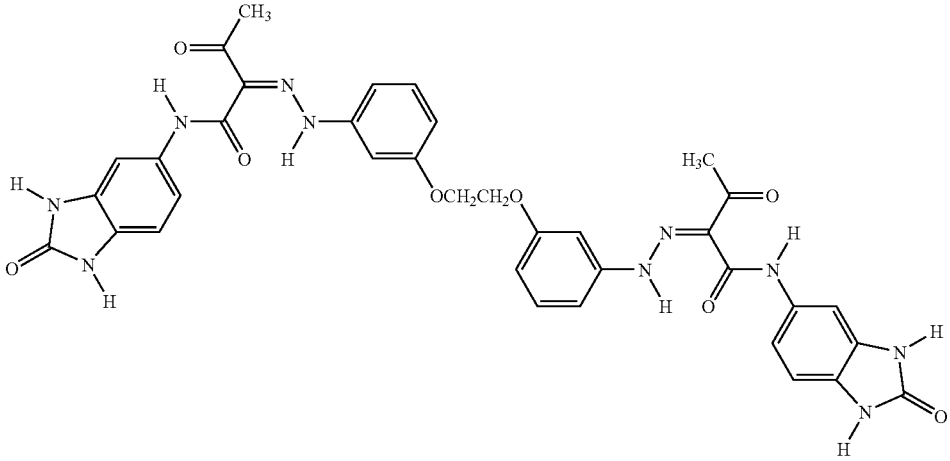

-continued

Structural Formula (3)

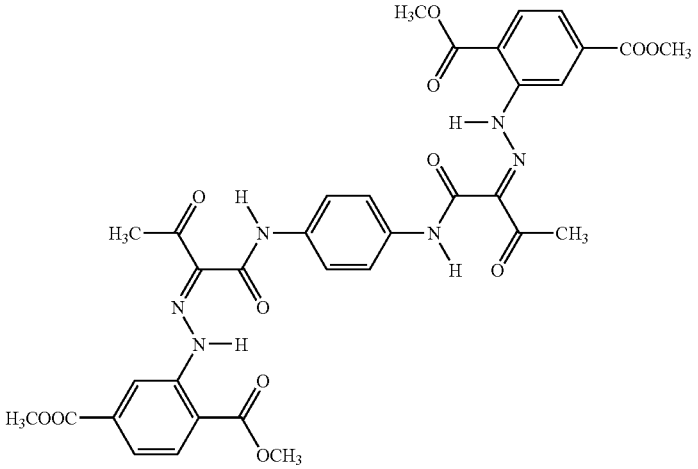

<12> An image forming apparatus, comprising:

a latent electrostatic image bearing member, a latent electrostatic image forming unit configured to form a latent electrostatic image on the latent electrostatic image bearing member, at least three developing units configured to develop a visible image using the toner kit according to <10> or <11>, a transfer unit configured to transfer the visible image onto a recording medium, and a fixing unit configured to fix the transferred image on the recording medium.

BEST MODE FOR CARRYING OUT THE INVENTION

Toner

Figure 1:
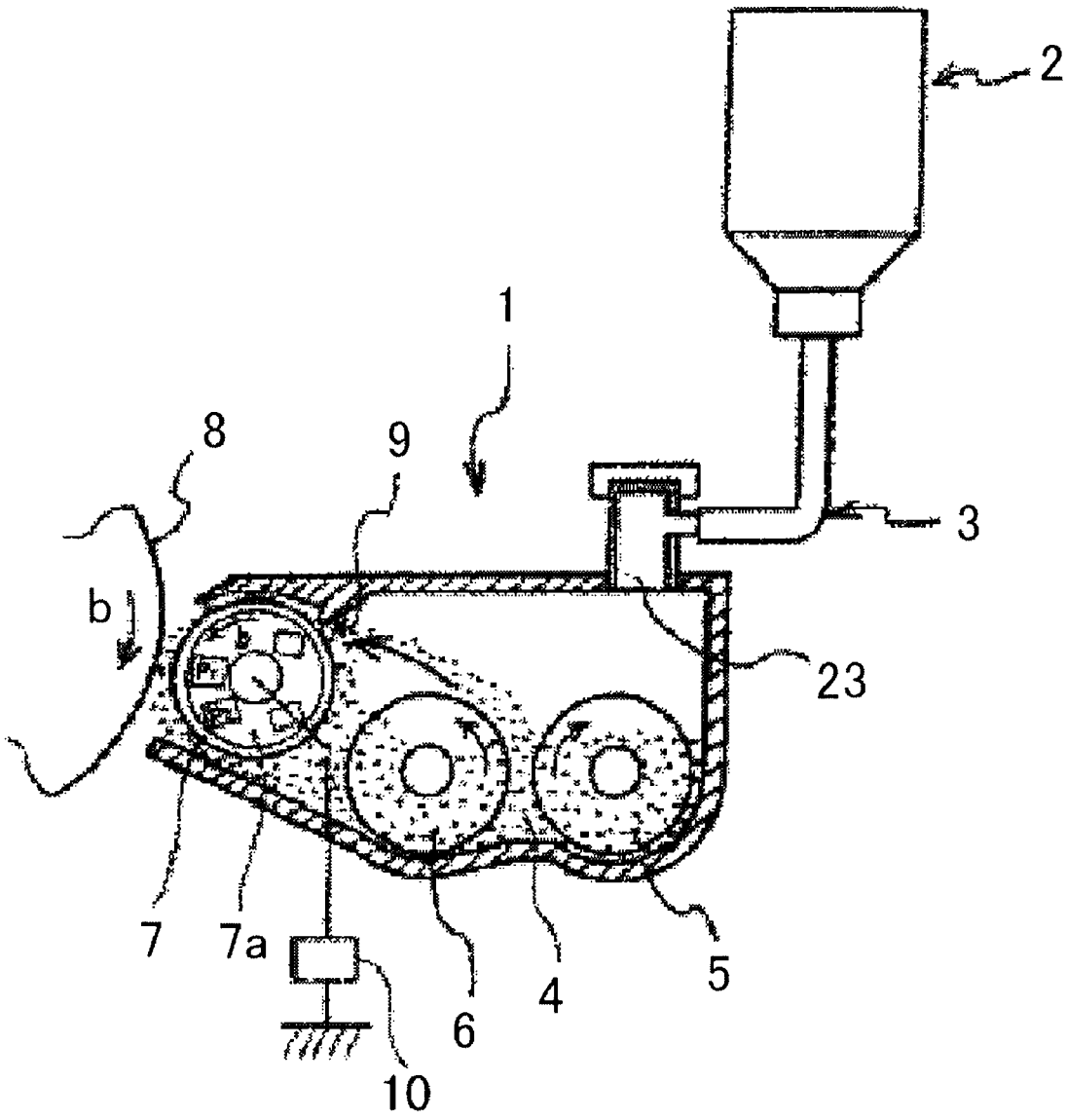
FIG. 1 is a schematic constitutional view of a developing device of an inventive image forming apparatus.
Figure 2A:
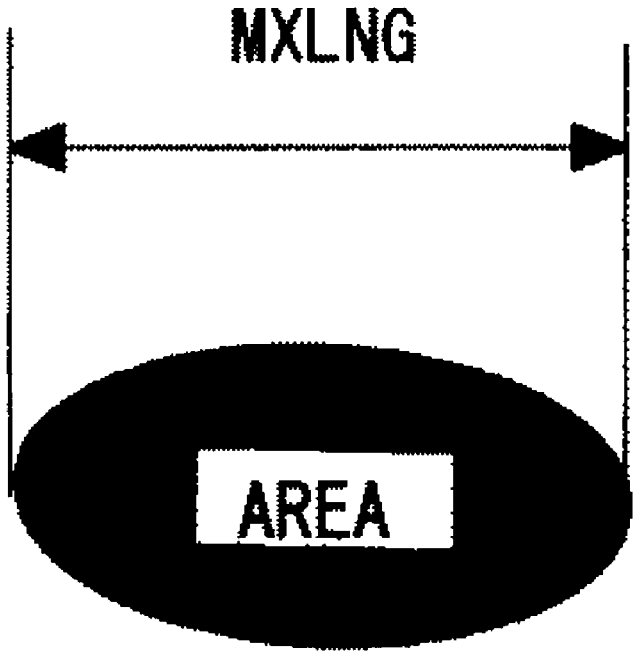
FIG. 2A is a schematic view of toner shape to explain the shape factor SF-1.
Figure 2B:
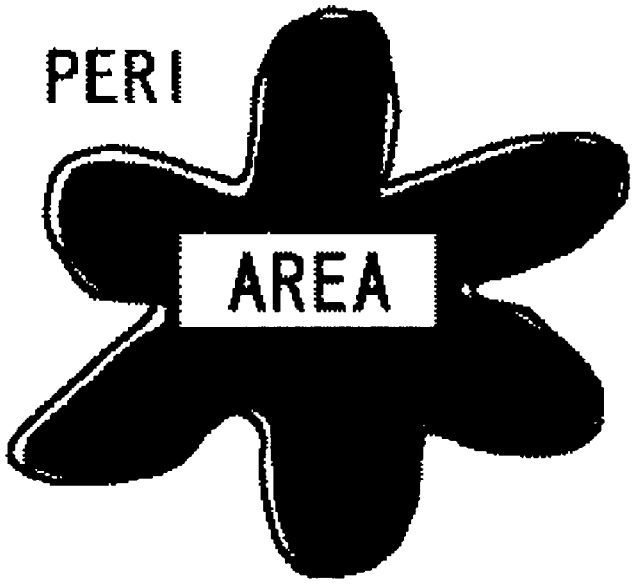
FIG. 2B is a schematic view of toner shape to explain the shape factor SF-2.

The toner according to the present invention comprises a colorant and a binder resin, and also optional other ingredients.

The binder resin contains at least a polyester resin that is prepared by a polycondensation reaction in the presence of at least a titanium-containing catalyst expressed by General Formula (I) or (II).

The titanium-containing catalyst is a compound expressed by General Formula (I) or (II) and may be two or more compounds thereof;

$$Ti(—X)m(—OH)n \qquad \text{General Formula (I)}$$

$$O{=}Ti(—X)p(—OR)q \qquad \text{General Formula (II)}$$

in General Formulas (I) and (II), X represents a residue of a mono-alkanolamine of 2 to 12 carbon atoms or a polyalkanolamine thereof from which a hydrogen atom of one hydroxyl group is removed; other hydroxyl group(s) and still other hydroxyl group(s), within the polyalkanolamine that directly bonds to a Ti atom, may polycondense to form a ring structure; other hydroxyl group(s) and still other hydroxyl group(s) may polycondense intermolecularly to form a repeating structure. In cases of repeating structures, the polymerization degree is 2 to 5;

R represents one of a hydrogen atom and alkyl groups of 1 to 8 carbon atoms that may have 1 to 3 ether bonds;

"m" is an integer of 1 to 4; "n" is an integer of 0 to 3; the sum of "m" and "n" is 4; "p" is an integer of 1 or 2; "q" is an integer of 0 or 1; the sum of "p" and "q" is 2; in case that "m" and/or "p" is 2 or more, the respective Xs may be identical or different each other.

In General Formulas (I) and (II) above, X represents a residue of a mono-alkanolamine of 2 to 12 carbon atoms or a polyalkanolamine thereof from which a hydrogen atom of one hydroxyl group is removed; the number of nitrogen atoms, i.e. the total number of primary, secondary and tertiary amines, is preferably 1 or 2, more preferably 1.

The monoalkanolamine may be properly selected depending on the application; examples thereof include ethanolamine and propanolamine. The polyalkanolamine may be properly selected depending on the application; examples thereof include dialkanolamines such as diethanolamine, N-methyldiethanolamine and N-butyldiethanolamine; trialkanolamines such as triethanolamine and tripropanolamine; and tetraalkanolamines such as N,N,N',N'-tetrahydroxyethylethylenediamine.

In cases of polyalkanolamines, there exists at least one hydroxyl group in addition to the hydroxyl group for the residue to form Ti—O—C bond with a Ti atom; the hydroxyl group(s) and other hydroxyl group(s), within the polyalkanolamine that directly bonds to a Ti atom, may polycondense to form a ring structure; or the hydroxyl group(s) and other hydroxyl group(s) may polycondensate intermolecularly to form a repeating structure. In cases of repeating structures, the polymerization degree is 2 to 5. In cases where the polymerization degree is above 5, the catalytic activity tends to be lower, which may increase the amount of oligomers and deteriorate blocking resistance of toners.

X may be a residue of dialkanolamines in particular diethanolamine or a residue of trialkanolamines in particular triethanolamine, particularly preferable is the residue of triethanolamine.

R represents one of a hydrogen atom (H) and alkyl groups of 1 to 8 carbon atoms that may have 1 to 3 ether bonds. Examples of the alkyl groups of 1 to 8 carbon atoms include methyl group, ethyl group, n-propyl group, isopropyl group, n-butyl group, n-hexyl group, n-octyl group, beta-methoxyethyl group and beta-ethoxyethyl group. Among these, R is preferably hydrogen atom or alkyl groups of 1 to 4 carbon atoms having no ether bond, more preferably, hydrogen atom, ethyl group or isopropyl group.

In General Formula (I) above, "m" is an integer of 1 to 4, preferably 1 to 3; "n" is an integer of 0 to 3, preferably 1 to 3; the sum of "m" and "n" is 4. In General Formula (II) above, "p" is an integer of 1 or 2; "q" is an integer of 0 or 1; the sum of "p" and "q" is 2. Xs may be identical or different each other in case that "m" and/or "p" is 2 or more.

Examples of the titanium-containing catalyst expressed by General Formula (I) include titanium dihydroxybis(triethanol aminate), titanium trihydroxytriethanol aminate, titanium dihydroxybis(diethanol aminate), titanium dihydroxybis (monoethanol aminate), titanium dihydroxybis(monopropanol aminate), titanium dihydroxybis(N-methyldiethanol aminate), titanium dihydroxybis(N-buthyldiethanol aminate), tetrahydroxy titanium, and reaction products of these compounds with N,N,N',N'-tetrahydroxy ethylethylenediamine or intermolecular polycondensation products of these compounds.

Examples of the titanium-containing catalyst expressed by General Formula (II) include titanylbis(triethanol aminate), titanylbis(diethanol aminate), titanylbis(monoethanol aminate), titanylhydroxyethanol aminate, titanylhydroxytriethanol aminate, titanylethoxytriethanol aminate, titanylisopropoxytriethanol aminate, and intramolecular or intermolecular polycondensation products of these compounds.

Among these, preferable are titanium dihydroxybis(triethanol aminate), titanium dihydroxybis(diethanol aminate), titanylbis(triethanol aminate), polycondensation products thereof, and combinations of these compounds; particularly preferable is titanium dihydroxybis(triethanol aminate).

These titanium-containing catalysts may be readily synthesized by reaction of commercially available titanium dialkoxybisalcohol aminates (by DuPont Co.) at 70° C. to 90° C. in the presence of water.

The amount of the titanium-containing catalyst is preferably 0.0001 to 0.8% by mass based on the resulting polycondensation product in view of polymerization activity, more preferably 0.0002 to 0.6% by mass, still more preferably 0.0015 to 0.55% by mass.

The titanium-containing catalyst may be combined with other esterification catalysts in an appropriate non-harmful range. Examples of the other esterification catalysts include tin-containing catalysts such as dibutyltin oxide; antimony trioxide; titanium-containing catalysts other than the titanium-containing catalysts such as titanium alkoxides, potassium titanyl oxalate and titanium terephthalate; zirconium-containing catalysts; germanium-containing catalysts; alkaline (earth) metal catalysts such as carboxylates of alkaline metals and alkaline earth metals, lithium acetate, sodium acetate, potassium acetate, sodium benzoate and potassium benzoate; and zinc acetate. The amount of the other catalysts is preferably 0 to 0.6% by mass based on the resulting polymer. The amount of no more than 0.6% by mass may lead to less coloring of the polyester resin thus is desirable for color toners. The content of the titanium-containing catalyst in the entire catalyst is preferably 50 to 100% by mass.

Binder Resin

The polycondensed polyester resin of the binder resin may be polycondensate of polyester resins (AX) between polyols and polycarboxylic acids or modified polyester resins (AY) by reaction of AX and polyepoxides (c). These AX and AY may be used alone or combinations of two or more.

The polyol may be diols (g) or trivalent or more polyols (h). The polycarboxylic acid may be dicarboxylic acids (i) or trivalent or more polycarboxylic acids (j). These may be combinations of two or more.

The polyester resin (AX) or (AY) may be those shown below, and these may be used in combination.

(AX1): linear polyester resins prepared from (g) and (i);

(AX2): nonlinear polyester resins prepared from (g) and (i) along with (h) and/or (j);

(AY1): modified polyester resins by reaction of (AX2) with (c).

The diol (g) is preferably those having a hydroxyl value of 180 to 1900 mgKOH/g. Specific examples are alkylene glycols of 2 to 36 carbon atoms such as ethylene glycol, 1,2-propylene glycol, 1,3-propylene glycol, 1,4-butylene glycol and 1,6-hexanediol; alkyleneether glycols of 4 to 36 carbon atoms such as diethylene glycol, triethylene glycol, dipropylene glycol, polyethylene glycol, polypropylene glycol and polybutylene glycol; cycloaliphatic diols of 6 to 36 carbon atoms such as 1,4-cyclohexane dimethanol and hydrogenated bisphenol A; adducts of cycloaliphatic diols described above with alkylene oxides of 2 to 4 carbon atoms such as ethylene oxide (EO), propylene oxide (PO) and butylene oxide (BO) (added mole number: 1 to 30); adducts of bisphenols such as bisphenol A, F and S with alkylene oxides of 2 to 4 carbon atoms such as EO, PO and BO (added mole number: 2 to 30).

Among these, preferable are alkylene glycols of 2 to 12 carbon atoms, adducts of bisphenols with alkylene oxides, or combinations thereof, particularly preferable are adducts of bisphenols with alkylene oxides, alkylene glycols of 2 to 4 carbon atoms, or combinations of two or more thereof. The hydroxyl value may be measured in accordance JIS K 0070, for example.

The trivalent or more polyols (h), i.e. 3 to 8 valence or more, are preferably those having a hydroxyl value of 150 to 1900 mgKOH/g. Specific examples are aliphatic polyvalent alcohols of 3 to 36 carbon atoms and 3 to 8 or more valences such as alkane polyols and intra- or inter-molecular dehydration products like glycerin, triethylolethane, trimethylolpropane, pentaerythritol, sorbitol, sorbitan, polyglycerin and dipentaerythritol; saccharide and derivatives thereof like simple sugar and methyl glucoside; adducts of aliphatic polyvalent alcohols with alkylene oxides of 2 to 4 carbon atoms such as EO, PO and BO (added mole number: 1 to 30); adducts of trisphenols such as trisphenol PA with alkylene oxides of 2 to 4 carbon atoms such as EO, PO and BO (added mole number: 2 to 30); and adducts of novolac resins such as phenol novolacs and cresol novolacs having an average polymerization degree of 3 to 60 with alkylene oxides of 2 to 4 carbon atoms such as EO, PO and BO (added mole number: 2 to 30).

Among these, preferable are aliphatic polyvalent alcohols of 3 to 8 or more valences and adducts of novolac resins with alkylene oxides (added mole number: 2 to 30), particularly preferable are adducts of novolac resins with alkylene oxides.

Preferably, the dicarboxylic acid (i) has an acid value of 180 to 1250 mgKOH/g; specific examples thereof include alkane dicarboxylic acids of 4 to 36 carbon atoms such as succinic acid, adipic acid and sebacic acid; alkenyl succinic acids such as dodecenylsuccinic acid; cycloaliphatic dicarboxylic acids of 4 to 36 carbon atoms such as dimer acids like linoleic acid dimer; alkene dicarboxylic acids of 4 to 36 carbon atoms such as maleic acid, fumaric acid, citraconic acid and mesaconic acid; and aromatic dicarboxylic acids of 8 to 36 carbon atoms such as phthalic acid, isophthalic acid, terephthalic acid and naphthalenedicarboxylic acid. Among these, particularly preferable are alkene dicarboxylic acids of 4 to 20 carbon atoms and aromatic dicarboxylic acids of 8 to 20 carbon atoms. The compounds (i) may be acid anhydrides or esters of lower alkyls of 1 to 4 carbon atoms, derived from those described above, such as methyl esters ethyl esters and isopropyl esters.

The trivalent or more polycarboxylic (j) (i.e. 3 to 6 valences or more) is preferably those having an acid value of 150 to 1250 mgKOH/g; specific examples thereof include aromatic polycarboxylic acids of 9 to 20 carbon atoms such as trimellitic acid and pyromellitic acid; and vinyl polymers of unsaturated carboxylic acids having a number average molecular mass of 450 to 10000 by gel permeation chromatography (GPC) such as styrene/maleic acid copolymers, styrene/acrylic acid copolymers, alpha-olefin/maleic acid copolymers and styrene/fumaric acid copolymers. Among these, preferable are aromatic polycarboxylic acids of 9 to 20 carbon atoms, in particular trimellitic acid and pyromellitic acid. The trivalent or more polycarboxylic (j) may be acid anhydrides or esters of lower alkyls of 1 to 4 carbon atoms, derived from those described above, such as methyl esters, ethyl esters and isopropyl esters.

The compounds (g), (h), (i) or (j) may be respectively copolymerized with aliphatic or aromatic hydroxycarboxylic acids (k) of 4 to 20 carbon atoms or lactones (l) of 6 to 12 carbon atoms.

The hydroxycarboxylic acid (k) is exemplified by hydroxystearic acid and aliphatic acids of hydrogenated castor oil; the lactone (l) is exemplified by caprolactone.

Examples of the polyepoxide (c) include polyglycidyl ethers such as ethylene glycol diglycidyl ether, tetramethylene glycol diglycidyl ether, bisphenol A diglycidyl ether, bisphenol F diglycidyl ether, glycerin tridiglycidyl ether, pentaerythritol tetraglycidyl ether and glycidyl-etherified phenol novolac (average polymerization degree: 3 to 60); and diene oxides such as pentadiene oxide and hexadiene oxide. Among these, preferable are polyglycidyl ethers, in particular ethylene glycol diglycidyl ether and bisphenol A diglycidyl ether.

The number of epoxy groups is preferably 2 to 8 per molecule of the polyepoxide (c), more preferably 2 to 6, and still more preferably 2 to 4. The epoxy equivalent of the polyepoxide (c) is preferably 50 to 500; more preferably, the lower limit is 70, still more preferably 80; more preferably, the upper limit is 300, still more preferably 200. The number of epoxy groups and the epoxy equivalent within the ranges may provide appropriate developing ability as well as fixing ability; more preferably, the number of epoxy groups and the epoxy equivalent are within the preferable ranges at the same time.

The reactant ratio of the polyol and the polycarboxylic acid is preferably 2/1 to 1/2 in terms of the equivalent ratio [OH]/[COOH], more preferably 1.5/1 to 1/1.3, still more preferably 1.3/1 to 1/1.2. It is preferred that the specific compounds of the polyol and the polycarboxylic acid are selected such that the glass transition temperature Tg of the resulting polyester toner binder is 40° C. to 90° C. considering the molecular mass.

The binder resin is typically required for different properties between full-color and monochromic applications, which also leading to different designs for the polyester resins. That is, full color images are required for high gloss, which requesting a low-viscosity binder resin, and monochromic images are demanded for hot offset resistance instead of the gloss, which requesting a high-modulus binder resin.

The (AX1), (AX2) and (AY1) described above and also combinations thereof are preferable in order to form high gloss images suited for full-color copiers etc. From the viewpoint that the polyester resin is preferably of lower viscosity, the content of (h) and (j) is 0 to 20% by mole based on the total of (g) to (j) by mole number, more preferably 0 to 15% by mole, still more preferably 0 to 10% by mole.

The (AX2) and (AY1) described above and also combinations thereof are preferable in order to form images with hot offset resistance suited for monochromic copiers etc. From the viewpoint that the polyester resin is preferably of high modulus, the polyester resin is preferably prepared by both of (h) and (j) in particular. The content of (h) and (j) is preferably 0.1 to 40% by mole based on the total of (g) to (j) by mole number, more preferably 0.5 to 25% by mole, still more preferably 1 to 20% by mole.

In cases of polyester resins for full-color, the temperature at which the complex viscosity coefficient $\eta^*$being 100 Pa·s (TE) is preferably 90° C. to 170° C., more preferably 100° C. to 165° C., still more preferably 105° C. to 150° C. The TE of no higher than 170° C. may bring about sufficient gloss, and the TE of no lower than 90° C. may lead to appropriate storage stability at high temperatures.

The temperature TE can be determined by way of measuring the complex viscosity coefficient $\eta^*$ while changing the resin temperature using a commercially available measurement device for dynamic viscoelasticity after melting-kneading a resin block at 130° C., 70 rpm for 30 minutes using a laboblast mill.

The insoluble matter into tetrahydrofuran (THF) of polyester resins for full-color is no more than 10% by mass in view of glossiness, more preferably no more than 5% by mass.

The insoluble matter or soluble matter into THF can be measured by the following processes.

A sample 0.5 g is precisely weighed into a 200 mL Meyer flask with a stopper, to which 50 mL of THF is added and the mixture is stirred under reflux for 3 hours, then the insoluble matter is filtered off using a glass filter. The content of the THF insoluble matter is calculated from the mass ratio of the sample and the matter filtered-dried at 80° C. for 3 hours. The molecular mass described later is determined by use of the filtrate as the THF soluble matter.

In cases of polyester resins for monochrome, the temperature at which the storage modulus G' being 6000 Pa (TG) is preferably 130° C. to 230° C., more preferably 140° C. to 230° C., still more preferably 150° C. to 230° C.

The temperature TG can be determined by way of measuring the storage modulus while changing the resin temperature using a commercially available measurement device for dynamic viscoelasticity after melting-kneading a resin block at 130° C., 70 rpm for 30 minutes using a laboblast mill.

In cases of polyester resins for monochrome, the temperature at which the complex viscosity coefficient $\eta^*$ being 1000 (TE) is preferably 80° C. to 140° C. in view of low temperature fixability and high temperature storage stability, more preferably 90° C. to 135° C., still more preferably 105° C. to 130° C.

The polyester resin for monochrome preferably contains 2 to 70% by mass of the THF insoluble matter, more preferably 5 to 60% by mass, still more preferably 10 to 50% by mass. The THF insoluble matter of no less than 2% by mass may lead to appropriate hot offset resistance, and no higher than 70% by mass thereof may lead to favorable low temperature fixability.

The peak top molecular mass Mp of the polyester resin is preferably 1000 to 30000 for monochrome as well as full-color, more preferably 1500 to 25000, still more preferably 1800 to 20000. The peak top molecular mass Mp of no less than 1000 may lead to appropriate high temperature storage stability and proper powder flowability, and no higher than 30000 thereof may enhance milling ability of toners and thus bring about proper productivity.

It is also preferred in the inventive toner containing a toner binder resin of polyester resins that the content of ingredients having a molecular mass of no more than 1500 is 1.8% by mass or less, more preferably 1.3% by mass or less, and still more preferably 1.1% by mass or less. The content of ingredients, having a molecular mass of no more than 1500, of 1.8% by mass or less may lead to more proper storage stability.

The peak top molecular mass Mp, the number average molecular mass, and the content of ingredients having a molecular mass of no more than 1500 may be measured for THF soluble matter of polyester resins or toners using GPC under the following conditions.

Apparatus: HCL-8120, by Tosoh Co.
Column: TSK gel GMHXL (two),
TSKgel Multipore HXL-M (one)
Measuring temperature: 40° C.
Sample solution: 0.25% solution in THF
Injecting solution amount: 100 μl
Detecting device: refractive index
Standard: polystyrene The molecular mass, which corresponding to the highest peak on the resulting chromatogram, is referred to as "peak top molecular mass" (Mp). The ratio of peak area, corresponding to matters less than the molecular mass of 1500, may represent the ratio existing as low molecular mass matters.

The acid value of the polyester resin is preferably 0.1 to 60 mgKOH/g for monochrome as well as full-color, more preferably 0.2 to 50 mgKOH/g, still more preferably 0.5 to 40 mgKOH/g. The acid value of 0.1 to 60 mgKOH/g may bring about appropriate charging ability.

The hydroxyl value of the polyester resin is preferably 1 to 70 mgKOH/g for monochrome as well as full-color, more preferably 3 to 60 mgKOH/g, still more preferably 5 to 55 mgKOH/g. The hydroxyl value of 1 to 70 mgKOH/g may bring about appropriate environmental stability.

The glass transition temperature of the polyester resin is preferably 40° C. to 90° C. for monochrome as well as full-color, more preferably 50° C. to 80° C., still more preferably 55° C. to 75° C. The glass transition temperature Tg of 40° C. to 90° C. may favorably bring about high temperature storage stability and low temperature fixing ability.

The glass transition temperature Tg of the polyester resin may be measured in accordance with DSC method defined in ASTM D 3418-82 using DSC20 SCC/580 by Seiko Instruments Inc., for example.

The polyester resin for the binder resin may be produced by a process similar as conventional processes for producing polyesters; under such conditions as in inert gas atmosphere like nitrogen gas in the presence of titanium-containing catalysts at reaction temperature of preferably 150° C. to 280° C., more preferably 160° C. to 250° C., still more preferably 170° C. to 240° C., for example. The reaction period is preferably 30 minutes or longer, more preferably 2 to 40 hours from the view point of assuring the polycondensation reaction. The atmosphere may be effectively reduced to 1 to 50 mmHg, for example, in order raise the reaction velocity at the end stage of the reaction.

The process for producing the linear polyester resin (AX1) is exemplified by heating a diol (g) and a dicarboxylic acid (i) to 180° C. to 260° C. to undergo dehydration and condensation under normal or reduced pressure in the presence of a titanium-containing catalyst of 0.0001 to 0.8% by mass based on the mass of the resulting polymer and other optional catalysts thereby to prepare (AX1).

The process for producing the nonlinear polyester resin (AX2) is exemplified by heating a diol (g), a dicarboxylic acid (i) and a trivalent or more polyol (h) to 180° C. to 260° C. to undergo dehydration and condensation under normal or reduced pressure in the presence of a titanium-containing catalyst (a) of 0.0001 to 0.8% by mass based on the mass of the resulting polymer and other optional catalysts thereby to prepare (AX2). The (j) may be reacted with the (g), (i) and (h) at the same time.

The process for producing the modified polyester resin (AY1) is exemplified by adding a polyepoxide (c) to the polyester resin (AX2) and allowing a molecule-extending reaction of the polyester at 180° C. to 260° C. thereby to prepare the (AY1).

The acid value of (AX2) to react with (c) is preferably 1 to 60 mgKOH/g, more preferably 5 to 50 mgKOH/g. The acid value of no less than 1 mgKOH/g may eliminate the possibility of (c) not to react and thus to degrade the resin properties, and the acid value of no more than 60 mgKOH/g may bring about proper thermal stability of the resin.

The amount of (c) to prepare (AX1) is preferably 0.01 to 10% by mass based on (AX2), more preferably 0.05 to 5% by mass in view of low temperature fixability and hot offset resistance.

The polycondensation polyester resin is preferable in the present invention for the binder resin of full-color toners in view of coloring properties and image intensity. Color images typically result in thicker toner layers due to multiple overlapping of toner layers, which leading to cracks or defects on images due to insufficient strength and/or diminishing appropriate gloss. As such, the polyester resin is employed for maintaining appropriate gloss and excellent strength.

It is preferred for the polyester resin in the binder resin in particular that there exists substantially no THF-insoluble matter, the content of the ingredients having a molecular mass of 500 is no more than 4% by mass in the molecular mass distribution of gel permeation chromatography, and one peak exists within a molecular-mass range of 3000 to 9000. The THF insoluble matter tends to decrease the glossiness and transparency, thus high quality images are difficult in OHP sheets. It is preferable for the inventive toner to prevent filmings on blades or sleeves such that the content of the ingredients having a molecular mass of 500 is no more than 4% by mass in the molecular mass distribution of the binder resin, and the ratio of mass average molecular mass (Mw) to number average molecular mass (Mn) is $2 \leqq Mw/Mn \leqq 10$. The content of more than 4% by mass of the ingredients having a molecular mass of 500 tends to bring about smearing the blades or sleeves under prolonged usage and to induce filming.

The molecular mass of the binder resin in the inventive toner may be measured based on gel permeation chromatography by way of conditioning a column within a heat chamber at 40° C., flowing THF into the column at 1 mL/min at the temperature as the solvent, and injecting a THF sample solution, prepared from a toner at a sample concentration of 0.05 to 0.6% by mass, in an amount of 200 μL. The THF insoluble matter in the THF sample solution is removed by a 0.45 μm filter for liquid chromatography before injection thereof.

The molecular mass distribution of samples is calculated from a relation between logarithmic values of a calibration curve formed from a number of monodispersion polystyrene standards and a counted number. The polystyrene standards for the calibration curve are those having a molecular mass of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, $4.48\times10^6$ by Pressure Chemical Co. or Tosoh Co., or the like, preferably at least about 10 polystyrene standards are utilized. The detector is a refractive index (RI) detector. The existence of THF insoluble matters in the binder resin may be judged at preparing the THF sample solution for measuring the molecular mass distribution. That is, it is judged that substantially no THF insoluble matters exist as long as the filter being not clogged when a filter unit of 0.45 μm is attached to a syringe and a liquid is extruded from the syringe.

It is preferred in the present invention that the binder resin represents an endothermic peak at 60° C. to 70° C. under the measurement using a differential scanning calorimeter (DSC). The endothermic peak of below 60° C. may affect the toner storage ability and cause problems such as toner solidification within cartridges or hoppers. On the other hand, the endothermic peak of below 60° C. may affect the toner productivity and cause problems such as low feeding ability at milling processes. The endothermic peak in the differential scanning calorimeter may be read as a main maximum peak in the endothermic curve using, for example, Rigaku THRMOFLEX TG8110 (by Rigaku Co.) under a temperature-rising rate of 10° C./min.

It is preferable as described above that the ratio of mass average molecular mass (Mw) to number average molecular mass (Mn) is $2 \leqq Mw/Mn \leqq 10$ in the polyester resin. The ratio Mw/Mn of above 10 may bring about images with less gloss of the fixed toner and far from high quality images. On the other hand, ratio Mw/Mn of below 2 may bring about low productivity in milling processes of toner production and smearing of blades or sleeves under prolonged usage, and thus inducing the filming.

It is preferred in the polyester resin that the acid value is no more than 10 mgKOH/g when a resin charge-control agent described later is employed. It is known that the charging ability and the acid value represent a proportional relation in the polyester resin, and that the higher acid value leads to larger negative-charging ability of the resin and also affects the environmental properties at charging. That is, when the acid value is higher, the charge amount is larger under low temperature and low humidity conditions, and the charge amount is lower under high temperature and high humidity conditions. The change of the charge amount due to the environmental conditions may enlarge the changes of background smear, image concentration and color reproducibility, thus making difficult to maintain high quality images. In general, the acid value of above 20 mgKOH/g may possibly increase the charge amount and deteriorate the environmental fluctuation.

When the polyester resin is employed in the inventive toner, the resistance of the toner particles may be controlled by the resin charge-control agent, hydrophobic silica, hydrophobic titanium oxide etc. Therefore, the charge control effect of the resin charge-control agent, hydrophobic silica, or hydrophobic titanium oxide may be disturbed when the acid value of the polyester resin is above 10 mgKOH/g. The acid value of the polyester resin employed in the present invention is preferably no more than 10 mgKOH/g, more preferably no more than 5 mgKOH/g.

It is preferred that the polyester resin represents a temperature within 95° C. to 120° C. at which the apparent viscosity comes to $10^3$ Pa·s measured by a flow tester. When the temperature is below 95° C., the hot offset tends to occur at fixing processes, and the temperature of above 120° C. may result in insufficient gloss. The temperature, at which the apparent viscosity comes to $10^3$ Pa·s, may be measured using a flow tester CFT-500 (by Shimadzu Co.) under conditions of load 10 kg/cm$^2$, orifice size 1 mm by length 1 mm, and temperature-rising rate 5° C./min, and reading the temperature corresponding to the apparent viscosity of $10^3$ Pa·s.

Resin Charge-Control Agent

When a monomer containing a sulfonic acid salt group is added as a monomer of the resin charge-control agent, the resin charge-control agent may improve the negative-charging effect. On the other hand, the environmental stability or temperature/humidity stability of the toner tends to degrade due to the moisture-absorbing property, thus it is popular in the art that an aromatic monomer with an electron-attracting group is utilized for a copolymer. However, when the toner is used for a long term over several ten thousands of sheets, smears or photoconductor filmings appear on the developing sleeves or layer thickness-control members such as blades and rollers, the charge stability of toners or high quality images cannot be maintained sufficiently, and the productivity decreases, even though several thousands of sheets cause substantially no problem.

In order to address these deficiencies, the inventive toner employs a copolymer that is formed from (1) a monomer containing a sulfonic acid salt group, (2) an aromatic monomer containing an electron attracting group, and (3) a monomer of a (meth)acrylic acid ester, or a copolymer formed from (1) to (3) and also (4) an aromatic vinyl monomer, as the resin charge-control agent, for the purpose of a binder resin for full-color toner in addition to polyester resins that are favorable in terms of coloring properties and image intensity, thereby, an electrostatic image developing toner is provided that may exhibit excellent charging stability and environmental stability, that are far from smearing the developing sleeves or layer thickness-control members such as blades and rollers, that may appropriately form thin films, that may free from photoconductor filmings, and that may maintain high image quality and high productivity.

The resin charge control agent is defined in terms of molecular mass distribution as for the content of molecular mass of no more than $1\times10^3$. The ingredients having a molecular mass of no more than $1\times10^3$ are lower molecular mass compounds, copolymers, ionomers, residual monomers etc.; these ingredients possibly inhibit to generate charging and fluctuate the charging under the influence of temperatures and humidities. These ingredients also affect its safety such as skin stimulation and fish poison. The ingredients having a molecular mass of no more than $1\times10^3$ in a content of 10% by mass or more may make the charging property unstable under the significant influence of temperatures and humidities.

These inventive effects are estimated due to the following reasons: the combination of the monomer containing a sulfonic acid salt group and the aromatic monomer containing an electron attracting group may enhance the negative-charge effect. The monomer of a (meth)acrylic acid ester and also the aromatic vinyl monomer may still enhance the environmental charge stability and increase the resin hardness, which leading to desirable milling property and effectively preventing the photoconductor filmings without smearing the developing sleeves or layer thickness-control members such as blades and rollers.

In addition, the low molecular mass ingredients as well as the combination of monomers in the resin charge control agent may bring about an electrostatic image developing toner having an adequate dispersing ability and a sharp distribution of charge amount desirable for long term charge stability and high image quality, in the combination with a polyester resin that is favorable in terms of coloring properties and image intensity as a binder resin for full-color toners.

The monomer containing a sulfonic acid salt group in the resin charge-control agent is exemplified by aliphatic monomers containing a sulfonic acid salt group and aromatic monomers containing a sulfonic acid salt group. Examples of the aliphatic monomers containing a sulfonic acid salt group include alkaline metal salts, alkaline earth metal salts, amine salts, and quaternary ammonium salts of vinylsulfonic acids, allylvinylsulfonic acids, 2-acrylamide-2-methylpropanesulfonic acid, methacryloyloxyethylsulfonic acid, or perfluorooctanesulfonic acid. Examples of the aromatic monomers containing a sulfonic acid salt group include alkaline metal salts, alkaline earth metal salts, amine salts, and quaternary ammonium salts of styrenesulfonic acid, sulfophenyl acrylamide, or sulfophenyl itaconic imide. The metal salts of heavy metals like nickel, copper, zinc, mercury and chromium are undesirable in terms of safety.

Examples of the aromatic monomers containing an electron attracting group in the resin charge control agent include substituted styrenes such as chlorostyrene, dichlorostyrene, bromostyrene, fluorostyrene, nitrostyrene and cyanstyrene; substituted phenyl(meth)acrylates such as chlorophenyl (meth)acrylate, bromophenyl(meth)acrylate, nitrophenyl (meth)acrylate and chlorophenyloxyethyl(meth)acrylate; substituted phenyl(meth)acrylamides such as chlorophenyl (meth)acrylamide, bromophenyl(meth)acrylamide and nitrophenyl(meth)acrylamide; substituted phenylmaleimides such as chlorophenylmaleimide, dichlorophenylmaleimide, nitrophenylmaleimide and nitrochlorophenylmaleimide; substituted phenylitaconimides such as chlorophenylitaconimide, dichlorophenylitaconimide, nitrophenylitaconimide and nitrochlorophenylitaconimide; and substituted phenylvinyl ethers such as chlorophenylvinyl ether and nitrophenylvinyl ether. Among these, phenylmaleimide and phenylitaconimide substituted by a chloride or nitro group are particularly preferable in view of charging ability and filming resistance.

Examples of the (meth)acrylic acid ester monomer in the resin charge control agent include methyl(meth)acrylate, ethyl(meth)acrylate, propyl(meth)acrylate, n-butyl(meth)acrylate, isobutyl(meth)acrylate, stearyl(meth)acrylate, dodecyl (meth)acrylate and 2-ethylhexyl(meth)acrylate.

Examples of the aromatic vinyl monomer in the resin charge-control agent include styrene, vinyltoluene, and alpha-methylstyrene.

It is preferred in the resin charge-control agent that the amount of the monomer containing a sulfonic acid salt group is 1 to 30% by mass based on the entire mass of the resin charge-control agent, more preferably 2 to 20% by mass. In cases where the amount of the monomer containing a sulfonic acid salt group is less than 1% by mass, the initial charging property and/or the saturated charge amount is insufficient, possibly influencing images. In cases where the amount is above 30% by mass, the environmental stability degrades at the charging step, the charge amount is lower at high temperature and high humidity conditions, the charge amount is higher at low temperature and low humidity conditions, thus the charge stability of toners or high quality images cannot be maintained sufficiently. Moreover, smears or photoconductor filmings tend to appear on the developing sleeves or layer thickness-control members such as blades and rollers, and the productivity in kneading-milling steps of toner production tends to decrease.

The amount of the aromatic monomer containing an electron attracting group is preferably 1 to 80% by mass based on the entire mass of the resin charge control agent, more preferably 20 to 70% by mass. When the amount of the aromatic monomer containing an electron attracting group is less than 1% by mass, the charge amount is insufficient, and background smear or toner scattering is likely to occur; and when the amount is above 80% by mass, the monomer exhibits poor dispersibility into toners to widen the charging distribution of toners, which leading to background smear, toner scattering and insufficient high quality images.

The amount of the acrylic ester monomer and/or methacrylic ester monomer is preferably 10 to 80% by mass based on the resin charge control agent, more preferably 20 to 70% by mass. When the amount of the acrylic ester monomer and/or methacrylic ester monomer is below 10% by mass, the environmental stability is insufficient in the charging step, the milling ability is insufficient at kneading-milling steps in the toner production, smears on the developing sleeves or layer thickness-control members such as blades and rollers or photoconductor filmings cannot be sufficiently prevented; when the amount is above 80% by mass, the initial charging property and/or the charge amount is insufficient, possibly influencing images.

The amount of the aromatic vinyl monomer is preferably 0 to 30% by mass based on the entire mass of the resin charge control agent, more preferably 3 to 20% by mass. When the amount of the aromatic vinyl monomer is above 30% by mass, the resin charge control agent comes to hard, which leading to a wide charging distribution, background smear, toner scattering in the processes, and also inferior toner fixability in particular poor coloring property at mixing color toners.

The aromatic monomer in the resin charge control agent may be phenylmaleimide or phenylitaconimide substituted by chloride or a nitro group as described above. The resin charge control agent may fluctuate its volume resistivity possibly due to residual matters of catalysts, polymerization inhibitors, or solvents at the monomer production processes, which sometimes adversely influences on the intended toner charging amount. Therefore, there may cause problems in initial charging ability or charging to a saturated level with respect to toners that contain a resin negative-charge control agent.

As such, it is preferred in the present invention that the volume resistivity of the resin charge control agent is 9.5 to 11.5 Log ohm·cm, more preferably 10.0 to 11.0 Log ohm·cm. In cases where the volume resistivity of the resin charge control agent is below 9.5 Log ohm·cm, toners on developing rollers may initially take an insufficient charge amount, which possibly causing background smear or toner scattering. In cases where the volume resistivity of the resin charge control agent is above 11.5 Log ohm·cm, toners on developing rollers may initially take a sufficient charge amount, however, charge up tends to appear with time, which possibly leading to non-uniform toner thin layers on developing rollers under one-component developing systems to generate color streaks or irregularities on images. In cases of two-component developing systems, the image density often decreases, and background smear or toner scattering is likely to occur.

The volume resistivity of the resin charge control agent may be measured in accordance with JIS K6911. Specifically, the resin charge control agent is size-controlled with a mesh and conditioned at 23° C. and 50% RH. The sample of 3 g is molded at pressure 500 kg/cm$^2$ using an automatic pressure molding machine to prepare a disc-like test piece of 2 mm thick by 4 cm diameter. The test piece is placed on a dielectric loss tester (TR-10C, by Ando Electric Co.) after measuring precisely the thickness with a micrometer, and the volume resistivity is measured with applying an alternative voltage of frequency 1 kHz.

It is preferred in the resin charge control agent that the temperature corresponding to the apparent viscosity of $10^4$ Pa·s by a flow tester is 85° C. to 110° C. In cases where the temperature is below 85° C., the dispersibility of the resin charge control agent is inappropriate in toners, which possibly decreasing the charge amount and also leading to inferior storage stability and agglomeration or solidification; moreover, fixation tends to occur in kneading, milling, or classifying production steps, which deteriorating the productivity. On the other hand, in cases where the temperature is above 110° C., the monomer exhibits poor dispersibility into toners to widen the charging distribution of toners, which leading to background smear or toner scattering in the systems. Moreover, toner fixability, in particular the coloring property, degrades at overlapping color toners. The temperature, at which the apparent viscosity comes to $10^4$ Pa·s, may be measured by using a flow tester CFI-500 (by Shimadzu Co.) under conditions of load 10 kg/cm$^2$, orifice of diameter 1 mm by length 1 mm and temperature-rising rate 5° C./min, and reading the temperature corresponding to the apparent viscosity of $10^4$ Pa·s.

The mass average molecular mass of the resin charge control agent is preferably $5\times10^3$ to $1\times10^5$. In cases where the mass average molecular mass is below $5\times10^3$, the dispersibihty of the resin charge control agent is inappropriate in toners, which possibly decreasing the charge amount and also leading fixation in milling steps during production processes including kneading, milling, or classifying steps, which further deteriorating the productivity. On the other hand, in cases where the mass average molecular mass is above $1\times10^5$, the monomer exhibits poor dispersibility into toners to widen the charging distribution of toners, which leading to background smear or toner scattering in the systems, or inferior toner fixability of coloring properties.

It is also preferred in the resin charge control agent that the mass amount of ingredients having a molecular mass of no more than $1\times10^3$ is no more than 10% by mass, more preferably no more than 6% by mass. The ingredients having a molecular mass of no more than $1\times10^3$ are lower molecular mass compounds, copolymers, ionomers, residual monomers etc.; these ingredients possibly inhibit to generate charging and fluctuate the charging under the influence of temperatures and humidities; moreover, these ingredients also affect its safety such as skin stimulation and fish poison.

It is also preferred that the following relation is satisfied: $0.9<T1/T2<1.4$, in which T1 represents the temperature at which the inventive binder resin has an apparent viscosity of $10^3$ Pa·s measured by a flow tester, and T2 represents the temperature at which the resin charge control agent has an apparent viscosity of $10^4$ Pa·s measured by the flow tester.

The dispersibility of the charge control agent into the binder resin is an important factor to decide the charging ability of toners. In accordance with the present invention, a combination of a specific binder resin and a specific resin charge control agent may lead to a toner with an appropriate charging ability and an excellent initial charging property. On the other hand, it is apparent as described above that the dispersibility or compatibility between the binder resin and the resin charge control agent affects the charging ability. The present inventors have found the optimum range in terms of the apparent viscosity measured by a flow tester and the dispersibility of binder resins and resin charge control agents. In cases where T1/T2 is below 0.9, the apparent viscosities of the binder resin and the resin charge control agent are similar, which leading to a dissolved condition between the binder resin and the resin charge control agent, resulting in an insufficient saturated charge amount and inferior initial charging property. In cases where T1/T2 is above 1.4, the apparent viscosities of the binder resin and the resin charge control agent are excessively different, which leading to inferior dispersibility of the resin charge control agent, resulting in initial background smear and decrease of the charge amount with time. In addition, proper charging ability may be attained and filmings are unlikely to generate by way of defining the constitutional monomers, apparent viscosity thereof, and viscosity ratio of apparent viscosities of dispersed binder resins.

The amount of the resin charge control agent is preferably 0.1 to 20% by mass based on the toner particles, more preferably 0.5 to 10% by mass. In cases where the amount is below 0.1% by mass, the initial charging and the charge amount are insufficient, which possibly influencing images like background smear and dusts. On the other hand, in cases where the amount is above 20% by mass, the poor dispersibility widens the charging distribution, which possibly leading to background smear or toner scattering in the systems.

The additives utilized in the inventive toner are exemplified by hydrophobic-treated silica having a primary particle diameter of 0.01 to 0.03 μm and hydrophobic-treated specific titanium oxide having a primary particle diameter of 0.01 to 0.03 μm and a specific surface area of 60 to 140 m$^2$/g, in cases a resin charge control agent is utilized. When these additives are employed along with the polyester resin and the resin charge control agent, the toner may be obtained with a stable charging ability.

When the hydrophobic-treated silica having a primary particle diameter of 0.01 to 0.03 μm is attached to the surface of the base toner, the toner may take the necessary flowability and charging ability, resulting in appropriate developing ability on developing rollers and therefrom to photoconductors. The amount of the silica is preferably no less than 2.1 parts by mass based on 100 parts by mass of the base toner. Consequently, the toner may be made into uniform thin layers on developing rollers, irregularity may be significantly improved for the thin layers, and also white streaks due to toner fusion onto developer coating blades may be prevented due to stirring by developing rollers for a long period. In cases where the silica amount is less than the range, the toner flowability may be insufficient for supplying a necessary amount of toner to developing rollers, or the charge amount of the toner may be less than the necessary level. Moreover, the toner may be made into nonuniform thin layers on developing rollers, which possibly inhibiting uniform developments and images or generating white streaks due to toner fusion onto developer coating blades.

In addition, by virtue of attaching a hydrophobic-treated titanium oxide having a primary particle diameter of 0.01 to 0.03 μm and a specific surface area of 60 to 140 $m^2/g$ onto the surface of the base toner, the charging ability of the toner may be stabilized, in particular the initial charging property is improved and the charge up is prevented. The amount of the titanium oxide is preferably 0.4 to 1.0 part by mass based on 100 parts by mass of the base toner. When the amount is less than 0.4 part by mass, the development of the toner may be insufficient due to excessively high charging ability of the toner, and when the amount is above 1.0 part by mass, the toner may scatter from developing rollers or cause background smear due to excessively low charging ability of the toner.

The term "base toner" means the particles on the way of production that contain at least a binder resin, colorant, and resin charge control other than additives.

The inventive toner binder resin (A) may contain optional other resins in addition to the polycondensation polyester resins described above.

Examples of the other resins include styrene resins such as copolymers of styrene and alkyl(meth)acrylate and copolymers of styrene and diene monomers; epoxy resins such as ring-opening polymers of bisphenol A diglycidyl; and urethane resins such as polyadducts of diols and/or trivalent or more polyols and diisocyanates.

Preferably, the mass average molecular mass of the other resins is 1000 to 2,000,000. The amount of the other resins is preferably 0 to 40% by mass in the toner binder resin (A), more preferably 0 to 30% by mass, still more preferably 0 to 20% by mass.

In cases where two or more species of polyester resins are used in combination, or at least one species of polyester resin and at least one species of other resin are combined, these may be powder-mixed or melted-mixed, or may be mixed in toner production processes.

The temperature for melting and mixing is preferably 80° C. to 180° C., more preferably 100° C. to 170° C., still more preferably 120° C. to 160° C. Lower mixing temperatures below the range may result in insufficient mixing and nonuniform mixture. When two or more species of polyester resins are mixed, excessively high mixing temperatures may deteriorate resin properties necessary for toner binder because of averaging through an ester exchange reaction.

The mixing period in the melting and mixing step is preferably 10 seconds to 30 minutes, more preferably 20 seconds to 10 minutes, still more preferably 30 seconds to 5 minutes. When two or more species of polyester resins are mixed, excessively long mixing periods may deteriorate resin properties necessary for toner binder because of averaging through an ester exchange reaction.

The mixing device at the melting and mixing step may be batch mixing devices such as reaction vessels and continuous mixing devices. Continuous mixing devices are suited for uniformly mixing at an appropriate temperature for shorter periods. The continuous mixing devices are exemplified by extruders, continuous kneaders, three rollers, etc. Among these, extruders and continuous kneaders are preferable. In cases of powder mixing, conventional mixing conditions and devices are available.

As for the mixing conditions of powder mixing, the mixing temperature is preferably 0° C. to 80° C., more preferably 10° C. to 60° C.; the mixing period is preferably no shorter than 3 minutes, more preferably 5 to 60 minutes. Examples of the mixing device include Henschel mixers, Nautor mixers, banbury mixers, etc. Among these, Henschel mixers are preferable in particular.

The electrostatic image developing toner contains at least (A) a binder resin and (B) a colorant, and optionally (C) a release agent, (D) a charge control agent, and (E) a fluidizer, etc.

Colorant

The colorant may be properly selected from conventional dyes, pigments, and magnetic powders; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone, magnetite, iron black and combinations thereof.

The amount of the colorant selected from dyes or pigments is preferably 1 to 15% by mass based on the toner, more preferably 3 to 10% by mass.

The amount of the colorant selected from magnetic powders is preferably 1 to 70% by mass based on the toner, more preferably 15 to 70% by mass, still more preferably 30 to 60% by mass, particularly preferably 2 to 30% by mass.

The colorant for use in the present invention may be a master batch prepared by mixing-kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylene, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

Release Agent

A wax having a low melting point of 50° C. to 120° C. may be used for the release agent (C); the wax effectively works on between fixing rollers and toner surfaces as a release agent, which effects hot offset resistance even without coating a release agent such as lubricants onto the fixing rollers.

Examples of the wax include vegetable waxes such as carnauba wax, cotton wax, sumac wax and rice wax; animal waxes such as bees wax and lanoline; mineral waxes such as ozokerite and ceresin; and petroleum waxes such as paraffin, micro crystalline and petrolatum.

Besides these natural waxes, there are synthetic hydrocarbon waxes such as Fischer-Tropsch wax, polyethylene wax; and synthetic waxes such as of ester, ketone, and ether. Further, it is also possible to use aliphatic amides such as 12-hydroxystearic acid amide, stearic acid amide, phthalic anhydride imide and chlorinated hydrocarbons; low-molecular-weight crystalline polymers including homopolymers such as poly-n-stearyl methacrylate and poly-n-laurylmethacrylate and copolymers such as n-stearyl acrylate-ethylmethacrylate copolymer; and crystalline polymers having a long alkyl group in its side chain.

More specifically, the release agent (C) is exemplified by carnauba waxes (C1), Fischer-Tropsch waxes (C2), paraffin waxes (C3) and polyolefin waxes (C4).

Examples of (C1) include natural carnauba waxes and free aliphatic acid carnauba waxes.

Examples of (C2) include petroleum Fisher Tropsch waxes (Paraflint H1, Paraffint $H_1N_4$, and Raffint C105, by Schumann Sasol Co.), natural gas Fisher Tropsch waxes (FT100, by Shell MDS Co.), and separated ad crystallized products thereof such as MDP-7000 and MDP-7010 (by Nippon Seiro Co.).

Examples of (C3) include petroleum paraffin waxes such as paraffin wax HNP-5, HNP-9 and HNP-11 (by Nippon Seiro Co.). Examples of (C4) include polyethylene waxes such as Sunwax 171P and Sunwax LEL400P (by Sanyo Chemical Industries Ltd.) and polypropylene waxes such as Biscol 550P and Biscol 660P (by Sanyo Chemical Industries Ltd.).

Among these waxes, carnauba waxes and Fischer-Tropsch waxes are preferable, carnauba waxes and petroleum Fischer-Tropsch waxes are more preferable.

These waxes may act as a release agent and provide excellent low temperature fixability with toners.

The amount of the release agent (C) is preferably 0 to 15% by mass based on the toner, more preferably 1 to 10% by mass.

Charge Control Agent

The charge control agent (D) may be conventional ones; examples thereof include nigrosine dye, triphenylmethane dye, chrome-contained metal-complex dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, and salicylic acid derivative metallic salt. Specifically, Bontron 03 of a nigrosine dye, Bontron P-51 of a quaternary ammonium salt, Bontron S-34 of a metal containing azo dye, Bontron E-82 of an oxynaphthoic acid metal complex, Bontron E-84 of a salicylic acid metal complrex, and Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.), copper phtalocyamine, perylene, quinacridone, azo pigment, and other high-molecular weight compounds having a functional group, such as sulfonic acid group, carboxyl group, and quaternary ammonium salt. Among the charge control agents, those capable of controlling toners to a negative polarity are preferable.

The amount of the charge control agent depends on the type of binder resins, optional additives, and methods for manufacturing; preferably, the amount is 0.1 to 10 parts by mass based on 100 parts by mass of binder resin, more preferably 0.2 to 5 part by mass. When the amount is more than 10 parts by weight, toner-charge properties are excessive, which lessens the effect of the charge control agent, increases in electrostatic attraction force with developing rollers, and degrades developer fluidity and image density.

Examples of the charge control agents preferable for the present invention are the resin charge control agents described above, bis[1-(5-chloro-2-hydroxyphenylazo)-2-naphtolat]chromic (III) acid, nigrosine, perfluoroalkyltrimethylammonium iodine, polyhydroalkanoate and those expressed by General Formulas (III), (IV), and (V).

General Formula (III)

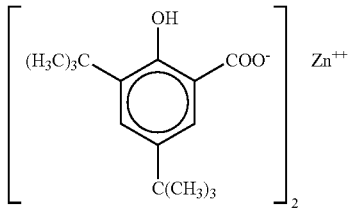

General Formula (IV)

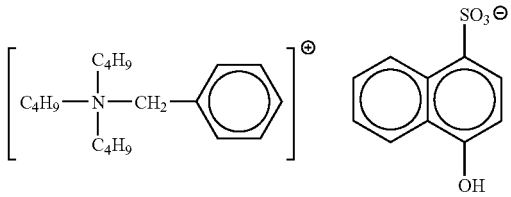

General Formula (V)

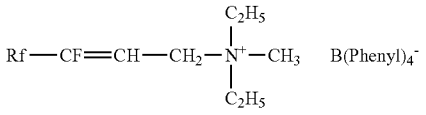

Rf = $C_8F_{11}$—$C_{11}F_{23}$

The charge control agent is preferably the copolymers containing a quaternary ammonium salt group formed from the monomer expressed by General Formula (VI) in a content of 65 to 97% by mass and the monomer expressed by General Formula (VII) in a content of 3 to 35% by mass and having a mass average molecular mass of 2000 to 10000.

General Formula (VI)

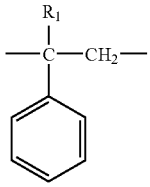

-continued

General Formula (VII)

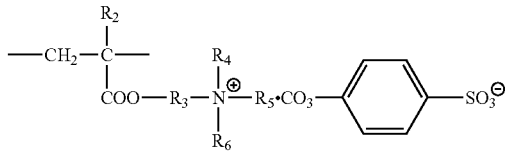

in General Formulas (VI) and (VII) described above, $R_1$ is a hydrogen atom or a methyl group, $R_2$ is a hydrogen atom or a methyl group, $R_3$ is an alkylene group, and $R_4$, $R_5$ and $R_6$ are each an alkyl group.

In addition, compounds expressed by General formula (VIII) or (IX) are also preferable as the charge control agent.

General Formula (VIII)

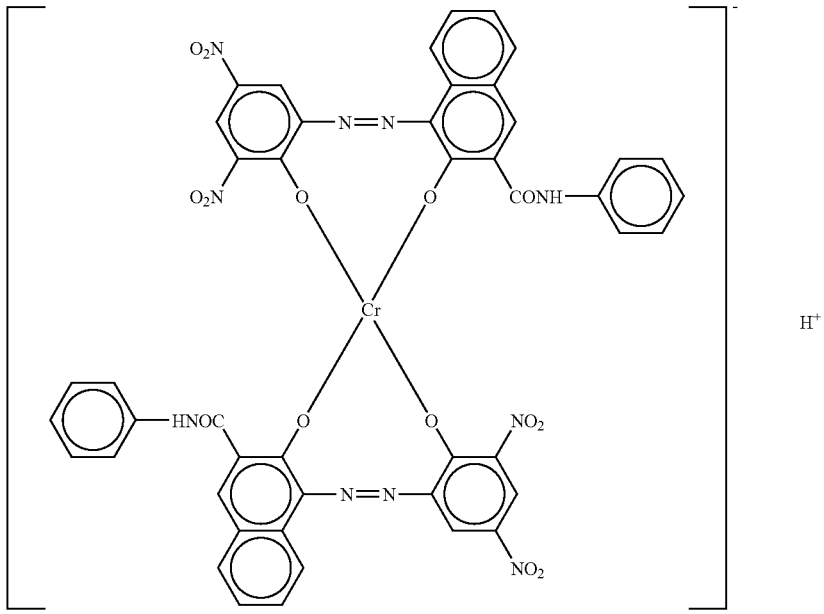

General Formula (IX)

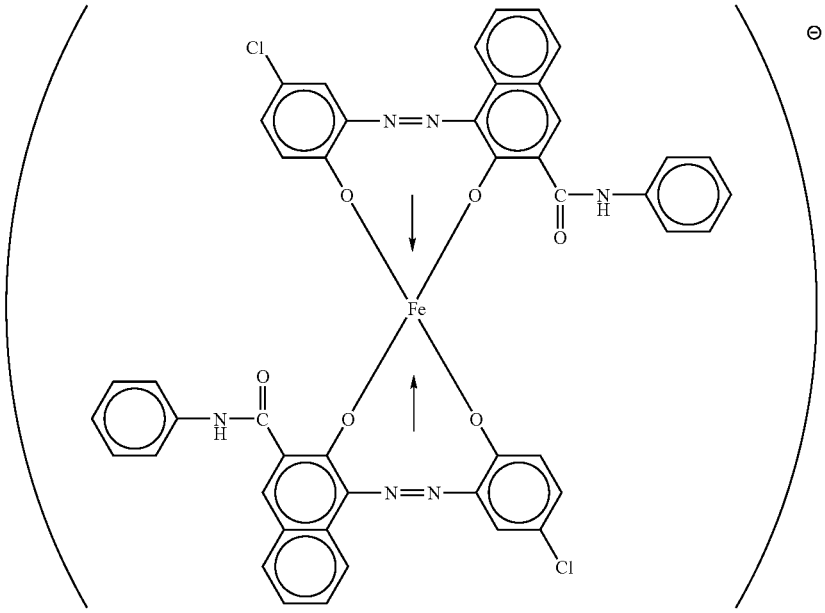

$\{a_1(NH_4^+) + b_1(Na^+) + c_1(H^+)\}$ in General Formulas (VIII) and (IX), $a_1$ is a number of 0.8 to 0.98, $b_1$ is a number of 0.01 to 0.19, $c_1$ is a number of 0.01 to 0.19, and $a_1+b_1+c_1=1$.

The amount of the charge control agent is preferably 0.01 to 20% by mass based on the toner, more preferably 0.1 to 15% by mass.

Fluidizer and Toner External Additive

Inorganic fine particulates for the inventive toner added as a fluidizer (E) of an external additive are exemplified by silica, alumina, titanium oxide, barium titanate, magnesium titanate, calcium titanate, strontium titanate, iron oxide, copper oxide, zinc oxide, tin oxide, silica sand, clay, mica, tabular spar, diatomite, chromium oxide, cerium oxide, colcothar, antimony trioxide, magnesium oxide, zirconium oxide, barium sulfate, barium carbonate, calcium carbonate, silicon carbide, silicon nitride, etc. Among these, preferable are metal oxides, metal nitrides and metal carbides, in particular those external additives having a number average particle diameter of 8 to 80 nm or 120 to 300 nm. Among the inorganic fine particles described above, preferable are silica, alumina, titanium oxide, in particular silica and titanium oxide. It is preferred for the charging ability and flowability of toners that the external additive comprises titanium oxide having a number average particle diameter of 5 to 40 nm in terms of the primary particles.

The amount of the inorganic fine particles as the external additive is preferably 0.01 to 5% by mass based on the base toner.

In order to control precisely the flowability of toners, not only control of production conditions to produce the additives but also crushing or milling and screening of the resulting products are important. It is also important how to attach the additives to toner surface and the attaching conditions.

The external additives may be used in combination with inorganic fine particles or hydrophobic-treated inorganic fine particles. Preferably, there exist two species of fine particles on the toner surface, such that one is low diameter inorganic fine particles having an average particle diameter of hydrophobic-treated primary particles of 1 to 20 nm, more preferably 6 to 15 nm (BET surface area: 100 to 400 $m^2/g$), and another is high diameter inorganic fine particles having an average particle diameter of hydrophobic-treated primary particles of 30 to 150 nm, more preferably 90 to 130 nm (BET surface area: 20 to 100 $m^2/g$). Preferably, the low diameter inorganic fine particles are of silica or titanium oxide, more preferably the both; preferably, the large diameter inorganic fine particles are of silica; preferably, the silica is of wet processes such as sol-gel processes; more preferably, medium diameter inorganic fine particles, preferably of silica, also exist on the toner surface, of which the average particle diameter being 20 to 50 nm (BET surface area: 40 to 100 $m^2/g$).

The inorganic fine particles may be selected from conventional ones including silica fine particles, hydrophobic silica; fatty acid metal salts such as zinc stearate and aluminum stearate; metal oxides such as titania, alumina, tin oxide and antimony oxide; and fluoropolymers.

Particularly preferable additive is hydrophobic-treated silica, titania, titanium oxide and alumina fine particles. Examples of the silica fine particles include HDKH2000, HDKH2000/4, HDKH2050EP, HVK21, HDKH1303 (by Hochst Co.), R972, R974, RX200, RY200, R202, R805 and R812 (by Nippon Aerosil Co.). Examples of the titania fine particles include P-25 (by Nippon Aerosil Co.), STT-30, STT-65C—S (by Titanium Industries Ltd.), TAF-140 (by Fuji Titanium Industry, Co.), MT-150W, MT-500B, MT-600B and MT-150A (by Tayca Co.). Examples of the hydrophobic-treated titanium oxide fine particles include P-805 (by Nippon Aerosil Co.), STT-30A, STT-65S-S (by Titanium Industries Ltd.), TAF-500T, TAF-1500T (by Fuji Titanium Industry, Co.), MT-100S, MT-100T (by Tayca Co.), and ITS (by Ishihara Sangyo Kaisha Ltd.)

The hydrophobic-treated oxide fine particles of silica, titania or alumina may be produced by treating the hydrophilic fine particle with silane coupling agents such as methyltriethoxysilane and octyltriethoxysilane. In addition, silicone oil-treated oxide fine particles or inorganic fine particles are available, which are treated with a silicone oil with heating as required.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oils, and alpha-methylstyrene-modified silicone oils.

The inorganic fine particles are exemplified by silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are preferable in particular. The added amount is preferably 0.1 to 5% by mass based on the toner, more preferably 0.3 to 3% by mass.

The average particle diameter of primary particles of the inorganic fine particles is preferably no larger than 100 nm, more preferably 3 to 70 nm. In cases where the diameter is less than the range, the inorganic fine particles tend to be embedded into toners to hide the effective performance; and when the diameter is larger than the range, the photoconductor surface is likely to be damaged nonuniformly.

The other external additives or fluidizers are exemplified by polymer fine particles of polystyrenes, methacrylate copolymers or acrylate copolymers produced through soap-free emulsion, suspension or dispersion polymerization; polycondensation products such as silicones, benzoguanamine and nylon; and polymer particles of thermosetting resins.

These fluidizers may be possibly surface-treated to enhance the hydrophobicity thereby to maintain the flowability and/or charging property even under high humidity conditions; examples of the treating agents are silane coupling agents, silylation agents, silane-coupling agents having alkyl fluorides, organo-titanium coupling agents, aluminum coupling agents, silicone oil, and modified silicone oil The toner may also contain a cleaning aid to assist the cleaning of developers remaining on photoconductors or primary transferred bodies; examples of the cleaning aid include fatty acid metal salts such as zinc stearate, stearic acid calcium and stearic acid; and polymer fine particles produced through soap-free-emulsion polymerization such as polymethylmethacrylate fine particles and polystyrene fine particles. Those polymer fine particles preferably have a narrower particle diameter distribution and a volume average particle diameter of 0.01 μm to 1 μm.

In addition, the toner may further contain, as the other additives, fluoropolymers, polyolefins of low molecular mass; metal oxides such as aluminum oxide, tin oxide and antimony oxide; conductivity enhancer such as carbon black and tin oxide; and surface-treated products thereof. These additives may be used alone or in combination; the amount is preferably 0.1 to 10 parts by mass based on 100 parts by mass of the toner.

The charge control agent and the release agent may be melted and kneaded with a master batch and/or binder resin or may be dissolved into an organic solvent and dispersed.

The charge control agent and the release agent may be added externally to the toner by wet processes using solvents or water and optional active agents besides dry processes using Henschel mixers or Q mixers.

In the mixing process of the external additives, a dry mixing may be carried out while dispersing and coating the external additive onto toner surface by way of stirring a mixture of a toner material and the additive using mixers. In such a process, it is important that the additive of inorganic or resin fine particles is attached uniformly and firmly onto the toner material in view of higher durability. For the purpose, such conditions are typically important, as blade shape of mixers, rotation frequency, mixing period, mixing times, external additive amount, toner material amount, surface properties of toner material like irregularity, hardness and viscoelasticity.

The wet processes may apply inorganic file particles on toners in liquid media. This process may be carried out after toner particles are produced in water and the used surfactants are washed away. Excessive surfactants are removed through solid-liquid separating processes, then the resulting cake or slurry is dispersed again into aqueous media. The inorganic fine particles are added and dispersed into the slurry; alternatively, the fine particles may be dispersed previously into the aqueous water. When a reverse-polarity surfactant is added into the aqueous media, the inorganic fine particles may attach the surface of toner particles more efficiently. In cases where the inorganic fine particles are hydrophobic-treated and hardly dispersible into aqueous media, an additional small amount of alcohols may decrease the surface tension thus make the inorganic fine particles more wettable and dispersible. The reverse-polarity surfactant is then added gradually into the aqueous media with stirring. The amount of the reverse-polarity surfactant is preferably 0.01 to 1% by mass based on the solid content of toner particles. The addition of the reverse-polarity surfactant may neutralize the charge of the inorganic fine particle dispersion in the aqueous media, which allowing the inorganic fine particles to coagulate and attach onto the toner surface. The amount of the inorganic fine particles is preferably 0.01 to 5% by mass base on the solid content of toner particles.

The inorganic fine particles, attaching to the toner surface, may be then fixed on the toner surface through heating the slurry thereby be prevented from the separation. Preferably, the heating of the slurry is carried out at higher than Tg of the resin in the toner, and/or after drying while preventing agglomeration thereof.

The inventive toner may be incorporated a metal stearate as a lubricant in order to reduce friction coefficient of photoconductor surface and to improve cleaning ability. Preferably, the metal stearate is zinc stearate.

Toner Production Process

The inventive toner for developing electrostatic images may be produced through conventional milling and polymerizing processes, specifically, air-flow milling, mechanical milling, emulsion-agglomeration, and suspension-polymerization processes; substantially any processes may derive the inventive effects.

In conventional kneading-milling processes to produce toners, the constitutional ingredients of toners are dry-mixed, and melted-kneaded, then finely milled by use of jet mills etc., followed by air-classifying, thereby toners may be produced with a volume average particle diameter of 2 to 10 μm.

The volume average particle diameter may be determined by Coulter counter (article name: Multitizer III, by Beckman Coulter, Inc.).

The processes for producing the inventive toner may be by conventional ones; specifically, the inventive toner may be produced by a process that comprises a step of mechanically mixing toner ingredients such as a binder resin, a charge control agent and colorant, a step of melting and kneading the mixture, a step of milling, and a step of classifying. The powders other than those adapted to milling or classifying steps may be recycled to the step of mechanically mixing or melting-kneading.

The powders (by-product) other than those adapted to milling or classifying steps mean fine or coarse particles that are out of desirable particle diameters after milling steps followed by a melting-kneading step or out of desirable particle diameters after the following classifying steps. The amount of the byproduct is preferably 1 to 20 parts by mass based on 100 parts by mass of the essential ingredients in the melting-kneading step.

The mixing step to mechanically mix the toner ingredients such as binder resins, colorants, resin charge control agents, and other charge control agents or the mixing step to mechanically mix the toner ingredients such as binder resins, colorants and resin charge control agents with by-products may be carried out under usual conditions using conventional mixers with rotatable blades.

After the mixing step, the mixture is put into a melting kneader to melt and knead. The melting kneader may be mono-axis or two-axis continuous kneaders or batch kneaders with roll mills; preferable examples thereof include KTK type two-axis extruder (by Kobe Steel, Ltd.), TEM type two-axis extruder (by Toshiba Machine Co.), two-axis extruder (by KCK Co.), PCM type two-axis extruder (by Ikegai Ltd.), and Co-kneader (by Buss Co.). It is important that the melting-kneading step is carried out under appropriate conditions far from cutoff of molecular chains in binder resins. Specifically, the melting-kneading temperature is adjusted referring to the softening point of the binder resin; when the temperature is excessively lower than the softening point, the cutoff will be significant, and excessively high temperature results in poor dispersion.

The kneaded product is milled after the step of melting-kneading. Preferably, the material is roughly milled then finely milled in the milling step. Preferable milling processes are exemplified by making the materials collide with a plate by means of jet air, making particles collide each other by means of jet air, or pulverizing by use of a narrow gap between mechanically rotating rotors and stators. After the milling step, the milled product is classified in an air flow by use of centrifugal force, thereby to produce a developer having a predetermined particle diameter of 5 to 20 μm, for example. In order to improve the flowability, storage stability, developing property, and transferring property of toner, inorganic fine particles such as hydrophobic silica fine particles may be further added and mixed to the resulting toner base particles. The external additives may be mixed using conventional powder mixers, preferably, the mixers are equipped with a jacket etc. to adjust the inside temperature. The load history on the additives may be changed by intermediate or gradual additions of external additives, or rotation number, rolling rate, rolling time, temperature, etc., or a high load is firstly applied and then a weak load is applied, or vice versa.

Examples of the mixing equipments include V-type mixers, rocking mixers, Loedige mixers, Nauta mixers, and Henschel mixers.

The inventive toner with the inventive toner binder resin may be employed as a two-component developer for electrostatic latent images by way of mixing with carrier particles of ferrites etc. optionally coated with magnetic powders such as of iron, nickel, ferrite and magnetite; glass beads and/or resins such as acrylic resins and silicone resins. The inventive toner may form electrostatic latent images by fractioning with charging blades or other members in place of carrier particles.

Then the latent images are fixed by conventional heat roll-fixing processes on supports such as paper and polyester films.

In recent years, the particle diameter of toners has been reduced still more to form highly precise images. One way to reduce the diameter may be on the basis of conventional mixing, melting and milling processes, however, these processes lead to considerably expensive cost from the viewpoint of energy and yield and also may be limited to reduce the diameter still further in view of a minimum limit attainable by milling processes.

For the countermeasure, toner production processes have been proposed on the basis of suspension polymerization, emulsion polymerization, dispersion polymerization processes, etc.

The toner for inventive image forming apparatuses is produced by dispersing a polyester prepolymer with a nitrogen-containing functional group, a polyester resin, a colorant, and a release agent into an organic solvent to prepare a toner material liquid, then which is subjected to crosslinking or extending reaction in an aqueous solvent. The polyester resin is an inventive polycondensation polyester resin. The constitutive materials and production process of these toners will be explained in the following.

Modified Polyester

The toner of the present invention comprises a modified polyester (i) as a binder resin. A modified polyester indicates a polyester in which a combined group other than ester bond may reside in a polyester resin, and different resin components are combined into a polyester resin through a covalent bond, ionic bond or the like. Specifically, a modified polyester is one where a functional group such as an isocyanate group or the like, which reacts with a carboxylic acid group and a hydrogen group, is introduced to a polyester end and further reacted to an active hydrogen-containing compound to modify the polyester end.

Examples of the modified polyester (i) include a urea modified polyester which is obtained by a reaction between a polyester prepolymer (A) having an isocyanate group and amines (B). Examples of the polyester prepolymer (A) having an isocyanate group include a polyester prepolymer, which is a polycondensation polyester of a polyvalent alcohol (PO) and a polyvalent carboxylic acid (PC) and having an active hydrogen group, is further reacted with a polyvalent isocyanate compound (PIC). Examples of the active hydrogen group involved into the above-noted polyester include a hydroxyl group (an alcoholic hydroxyl group and a phenolic hydroxyl group), an amino group, a carboxyl group, and a mercapto group. Among these groups, an alcoholic hydroxyl group is preferable.

The urea-modified polyester may be formed in the following manner. Examples of the polyvalent alcohol compound (PO) include divalent alcohols (DIO), and trivalent or more polyvalent alcohols (TO), and any of a divalent alcohol (DIO) alone and a mixture of a divalent alcohol (DIO) with a small amount of a polyvalent alcohol (TO) are preferable. Examples of the divalent alcohol (DIO) include alkylene glycols such as ethylene glycol, 1,2-propylene glycol, 1,3-propylene glycol, 1,4-bytandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bispheonol A, bisphenol F, and bisphenol S; alkylene oxide adducts of the above-noted alicyclic diols such as ethylene oxide, propylene oxide, and butylene oxide; and alkylene oxide adducts of the above-noted bisphenols such as ethylene oxide, propylene oxide, and butylene oxide. Among the above mentioned, an alkylene glycol having carbon number of 2 to 12 and an alkylene oxide adduct of bisphenols are preferable, and an alkylene oxide adduct of bisphenols and a combination of the adduct with an alkylene glycol having a carbon number of 2 to 12 are particularly preferable. Examples of the trivalent or more polyvalent alcohol (TO) include a polyaliphatic alcohol of trivalent to octavalent or more such as glycerine, trimethylol ethane, trimethylol propane, pentaerythritol, and sorbitol; and trivalent or more phenols such as trisphenol PA, phenol novolac, and cresol novolac; and alkylene oxide adduct of the trivalent or more polyphenols.

Examples of the polyvalent carboxylic acid (PC) include a divalent carboxylic acid (DIC) and a trivalent or more polyvalent carboxylic acid (TC), and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include alkylene dicarboxylic acids such as succinic acid, adipic acid, and sebacic acid; alkenylen dicarboxylic acids such as maleic acid and fumaric acid; aromatic dicarboxylic acids such as phthalic acid, isophthalic acid, terephthalic acid, and naphthalene dicarboxylic acid. Among these divalent carboxylic acids, an alkenylen dicarboxylic acid having a carbon number of 4 to 20 and an aromatic dicarboxylic acid having a carbon number of 8 to 20 are preferable. Examples of the trivalent or more polyvalent carboxylic acid (TC) include an aromatic polyvalent carboxylic acid having a carbon number of 9 to 20 such as trimellitic acid, and pyromellitic acid. A polyvalent carboxylic acid (PC), an acid anhydride from among the polyvalent carboxylic acids or a lower alkyl ester such as methyl ester, ethyl ester, and isopropyl ester may be reacted with a polyvalent alcohol (PO).

The ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyvalent isocyanate compound (PIC) include aliphatic polyvalent isocyanates such as tetramethylen diisocyanate, hexamethylen diisocyanate, and 2,6-diisocyanate methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as $\alpha,\alpha,\alpha',\alpha'$-tetramethyl xylylene diisocyanate; isocyanates; a compound in which the above noted polyisocyanate is blocked with a phenol derivative, an oxime, caprolactam, and the like; and a combination of two or more elements thereof.

The ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH]

is more than 5, low-temperature image fixability is often poor. When a urea modified polyester is used in the molar ratio of [NCO] is less than 1, the urea content of ester becomes lower, which making hot-offset resistance insufficient.

The component content of polyvalent isocyanate compound (PIC) of a polyester prepolymer having an isocyanate group (A) is typically 0.5 to 40% by mass, preferably 1 to 30% by mass, and more preferably 2 to 20% by mass. When less than 0.5% by mass, hot-offset resistance is insufficient and there appear a disadvantage in the compatibility between hot storage resistance and low-temperature image fixability. On the other hand, when it is more than 40 wt %, low-temperature image fixability tends to be poor.

The number of isocyanate groups contained per one molecular of polyester prepolymer having isocyanate group (A) is typically 1 or more, preferably 1.5 to 3 in average, and more preferably 1.8 to 2.5 in average. When the number of isocyanate groups is less than 1 per one molecular of polyester prepolymer, the molecular weight of the urea modified polyester becomes lower, which making hot-offset resistance poor.

Examples of amines (B) to be reacted with the polyester prepolymer (A) include a divalent amine compound (B1), a trivalent or more polyvalent amine compound (B2), an aminoalcohol (B3), an amino mercaptan (B4), an amino acid (B5), and a compound in which the amino group of B1 to B5 is blocked (B6).

Examples of the divalent amine compound (B1) include aromatic diamines such as phenylene diamine, diethyl toluene diamine, 4,4'-diamino diphenyl methane; alicyclic diamines such as 4,4'-diamino-3,3'-dimethyl dicyclohexyl methane, diamine cyclohexane, and isophorone diamine; and aliphatic diamines such as ethylene diamine, tetramethylene diamine, and hexamethylene diamine. Examples of the trivalent or more polyvalent amine compound (B2) include diethylene triamine and triethylene tetramine. Examples of the aminoalcohol (B3) include ethanol amine, and hydroxyethylaniline. Examples of the amino mercaptan (B4) include aminoethyl mercaptan and aminopropyl mercaptan. Examples of the amino acid (B5) include aminopropionic acid, aminocaproic acid, and the like. Examples of the compound, in which the amino group of B1 to B5 is blocked (B6), include a ketimine compound obtained from the above-noted amines of B1 to B5 and ketones such as acetone, methyl ethyl ketone, and methyl isobuthyl ketone and oxazolidine compound, and the like. Among these amines (B), a divalent amine compound B1 and a mixture of B1 with a small amount of a trivalent or more polyvalent amine compound (B2) are preferable.

The ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than ½, the molecular weight of urea modified polyester becomes lower, which making hot-offset resistance degrade.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, hot-offset resistance may degrade.

The modified polyester (i) used in the present invention is manufactured by one-shot methods or prepolymer methods. The weight average molecular weight of the modified polyester (i) is typically 10000 or more, preferably 20000 to 10,000,000, and more preferably 30000 to 1,000,000. The molecular weight peak is preferably 1000 to 10000, and when less than 1000, it is hard to undergo an elongation reaction and the toner elasticity is low, which making hot-offset resistance poor. When the molecular weight peak is more than 10000, it may cause degradation of fixability and may bring hard challenges in manufacturing in yielding toner fine particles and in toner grinding. The number average molecular weight of the modified polyester (i) when used together with an unmodified polyester (ii), which will be hereafter described, may be a number average molecular weight which is easily obtained to be used with the above-noted weight average molecular weight. When a modified polyester (i) is used alone, the number average molecular weight is typically 20000 or less, preferably 1000 to 10000, and more preferably 2000 to 8000. When the number average molecular weight is more than 20000, low-temperature image fixability and glossiness when used in a full-color device become poor.

In cross-linking and/or elongation reactions of a polyester prepolymer (A) and amines (B) in order to obtain a modified polyester (i), a reaction stopper may be used as required to control the molecular weight of a urea modified polyester to be obtained. Examples of the reaction stopper include a monoamine such as diethyl amine, dibutyl amine, buthyl amine, and lauryl amine, and a compound in which the above-noted elements are blocked.

The molecular weight of the resulting polymer can be measured by means of gel permeation chromatography (GPC), using a tetrahydrofuran (THF) solvent.

Unmodified Polyester

In the present invention, not only the modified polyesters but also unmodified polyesters (ii) may be included together with the modified polyester (i) as binder resin components. The unmodified polyester (ii) in combination with a modified polyester (i) is preferred to the modified polyester (i) alone, because low-temperature image fixability and glossiness may be improved when in a full-color device. Examples of the unmodified polyester (ii) include a polycondensation polyester of a polyvalent alcohol (PO) and a polyvalent carboxylic acid (PC), and the like, same as in the modified polyester (i) components. Preferable compounds thereof are also the same as in the modified polyester (i). As for the unmodified polyester (ii), in addition to an unmodified polyester, it may be a polymer which is modified by a chemical bond other than urea bonds, for example, it may be modified by a urethane bond. It is preferable that at least a part of modified polyester (i) is compatible with part of an unmodified polyester (ii), from the aspect of low-temperature image fixability and hot-offset resistance. Thus, it is preferable that the composition of the modified polyester (i) is similar to that of the unmodified polyester (ii). A weight ratio of a modified polyester (i) to an unmodified polyester (ii) when an unmodified polyester (ii) being included, is typically 5/95 to 80/20, preferably 5/95 to 30/70, more preferably 5/95 to 25/75, and still more preferably 7/93 to 20/80. When the weight ratio of a modified polyester (i) is less than 5%, it makes hot-offset resistance degraded and brings about disadvantages in compatibility between heat resistant storage properties and low-temperature image fixability.

The molecular weight peak of the unmodified polyester (ii) is typically 1000 to 10000, preferably 2000 to 8000, and more preferably 2000 to 5000. When the molecular weigh peak of the unmodified polyester (ii) is less than 1000, hot storage stability may degrade, and when more than 10000, low-temperature image fixability may degrade. The hydroxyl value of the unmodified polyester (ii) is preferably 5 mgKOH/g or more, more preferably 10 to 120 mgKOH/g, and still more preferably 20 to 80 mgKOH/g. When the value is less than 5 mgKOH/g, it brings about disadvantages in the compatibility between hot storage stability and low-temperature fixability. The acid number of the unmodified polyester (ii) is preferably 1 to 5 mgKOH/g, and more preferably 2 to 4 mgKOH/g. Since a wax with a high acid value is used, as for the binder, the binder is easily matched with the toner used in a two-component developer, because such a binder leads to charging and a high volume resistivity. The glass transition temperature (Tg) of the binder resin is typically 35° C. to 70° C., and preferably 55° C. to 65° C. When less than 35° C., the hot storage stability degrades, and when more than 70° C., low temperature fixability becomes insufficient. The toner of the present invention shows a proper hot storage stability even with a low glass transition temperature, compared to a toner made from conventional polyesters, because a urea modified polyester easily exists on the surface of particles of the toner base to be obtained. The glass transition temperature (Tg) can be measured using a differential scanning calorimeter (DSC).

The toner may be properly selected in terms of the shape, size, etc. depending on the application; preferably, the toner has the flowing volume average particle diameter, ratio of volume average particle diameter to number average particle diameter (volume average particle diameter/number average particle diameter), average circularity, shape factors SF-1 and SF-2, glass transition temperature, agglomeration degree, volume resistivity and apparent density.

Preferably, the inventive toner has a volume average particle diameter of 2.0 to 10.0 μm, preferably 3.0 to 7.0 μm, more preferably 3.0 to 5.0 μm. The ratio of (Dv/Dn) is 1.00 to 1.40, preferably 1.00 to 1.30, more preferably 1.00 to 1.20, wherein Dv means a volume average particle diameter and Dn means a number average particle diameter.

In general, toners of smaller particle diameters may deposit precisely over electrostatic images. However, volume average diameters smaller than the range in cases of two-component developers may lead to toner fusion on the surface of magnetic carriers under prolonged stirring in developing apparatuses and poor charging ability of the magnetic carriers. On the other hand, the toner having a volume average particle diameter over the inventive range may make difficult to take high-resolution and high quality images, and also the particle diameter of toner often fluctuates along with inflow and outflow of toners.

Further, narrower particle diameter distribution of toners may lead to uniform charge distribution, high quality images with less background fog, and higher transfer rate. However, Dv/Dn above 1.40 undesirably tends to broaden the charge distribution to decrease the resolution.

Preferably, the content of fine particles of no larger than 4 μm is 0 to 20% by number, and the content of coarse particles of no larger than 12.7 μm is 0 to 3% by number.

The average particle diameter and the particle diameter distribution of toners can be measured using Coulter Counter TA-II, and Coulter Multisizer II (by Beckman Coulter, Inc.). In the present invention, Coulter Counter TA-II model was used with connecting an interface (by The Institute JUSE) and a personal computer (PC9801, by NEC Co.) which outputs number distributions and volume distributions.

Preferably, the inventive toner has a shape factor SF-1 of 100 to 180, more preferably 100 to 150. The shape factor SF-2 is preferably 100 to 180, more preferably 100 to 160.

FIGS. 2A and 2B and FIGS. 3A to 3C are schematic views of a toner particle to explain shape factors SF-1 and SF-2. The shape factor SF-1 represents a circular level of toner shape, which is calculated from Equation (1), in which the maximum length MXLNG (see FIG. 2A) of the toner image projected on two-dimensional plane is squared, then divided by the area value of AREA and multiplied by 100π/4.

$$SF\text{-}1=[(MXLNG)^2/AREA]\times(100\pi/4) \quad \text{Equation (1)}$$

The SF-1 value of 100 corresponds to exact sphere, the larger is the SF-1 the shape is more different from exact sphere.

The shape factor SF-2 represents an irregularity of toner shape, which is calculated from Equation (2), in which the peripheral length PERI of the toner image projected on two-dimensional plane is squared, then divided by the area value of AREA and multiplied by 100/4π.

$$SF\text{-}2=[(RERI)^2/AREA]\times(100/4\pi) \quad \text{Equation (2)}$$

The SF-2 value of 100 corresponds to non-irregular shape of toner surface, the larger is the SF-2 the more irregular is the surface shape.

When the toner shape comes to sphere, the contact area between toner particles or between toner particles and photoconductors comes to narrow like a spot contact; consequently, the adsorptivity comes to lower between toner particles, the flowabihty comes to higher, the adsorptivity comes to lower between toner particles and photoconductors, and the transfer rate comes to higher. On the other hand, SF-1 and SF-2 preferably have a somewhat higher value from the viewpoint that spherical toner particles easily enter into a space between cleaning blades and photoconductors. In addition, excessively large values with respect to SF-1 and SF-2 tend to bring about lower image quality due to higher toner scattering on images, thus SF-1 and SF-2 are preferred to be no more than 180.

Specifically, SF-1 and SF-2 were determined by way of taking pictures using a scanning electron microscope S-800 (by Hitachi, Ltd.) and analyzing the pictures using an image analyzer Luzex AP (by Nireco Co.).

It is preferred for stable color reproducibility in the present invention that the toner is of spindle shape, and the spindle shape may be defined by a long axis r1, a short axis r2, and a thickness r3 (r1≧r2≧r3), the ratio r2/r1 is 0.5 to 1.0, and r3/r2 is 0.7 to 1.0.

Figure 3A:
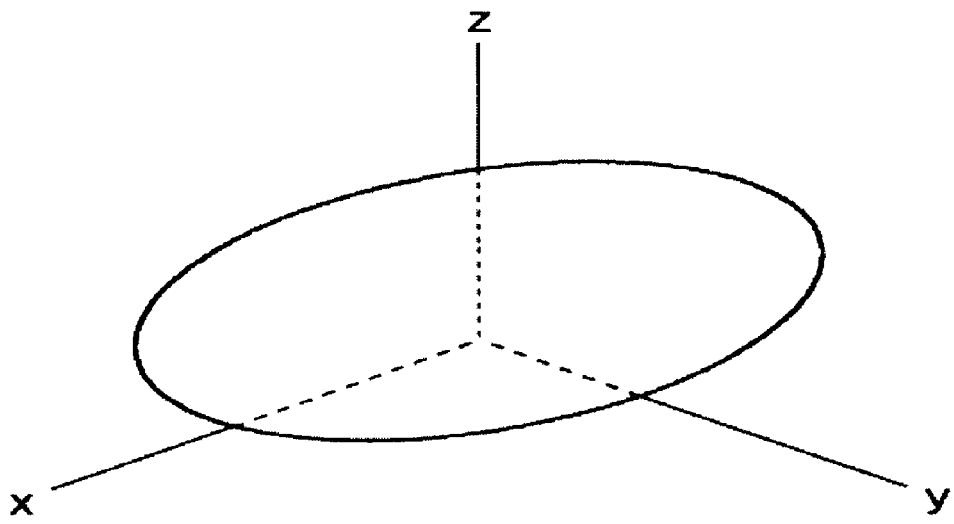
FIG. 3A is a schematic view of toner shape to explain the shape factors SF-1, SF-2.
Figure 3B:
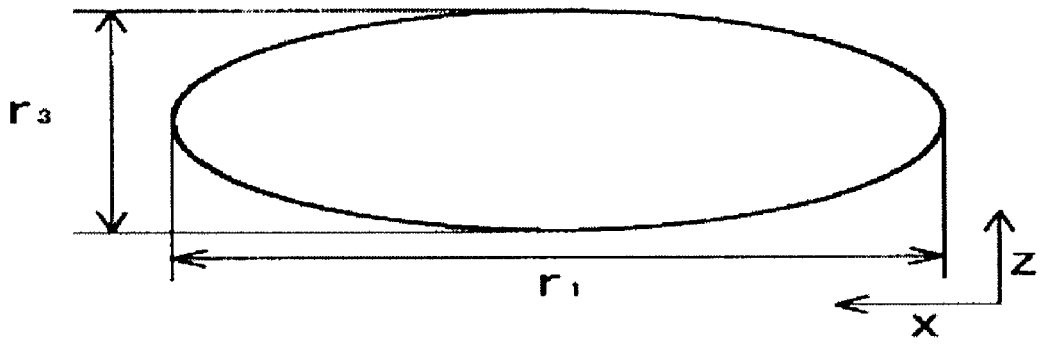
FIG. 3B is a schematic view of toner shape to explain the shape factors SF-1, SF-2.
Figure 3C:
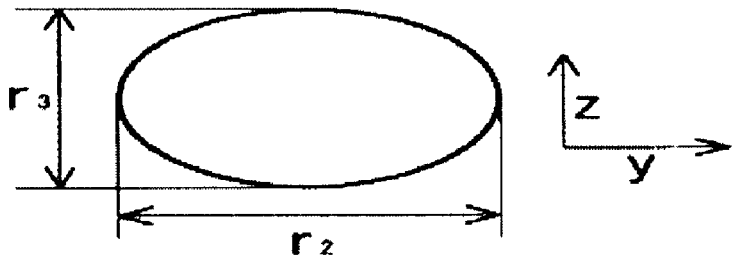
FIG. 3C is a schematic view of toner shape to explain the shape factors SF-1, SF-2.

FIGS. 3A to 3C schematically show the toner shape. When a toner having an approximately spherical shape, as shown in FIG. 3, is defined by a long axis r1, a short axis r2, and a thickness r3 (r1≧r2≧r3), it is preferred in the present invention that the ratio of short axis to long axis (r2/r1) is 0.5 to 1.0 (see FIG. 3B), and the ratio of thickness to short axis (r3/r2) is 0.7 to 1.0 (see FIG. 3C). The ratio r2/r1 of below 0.5 may result in poor dot reproducibility and low transfer efficiency and be far from high quality images due to departing from spherical shape. The ratio r3/r2 of below 0.7 may be far from higher transfer efficiencies like those of spherical toners due to almost flat shape. When the ratio r3/r2 is 1.0, the toner flowability may be enhanced in particular by virtue of the rotatable shape with a long axis as the rotating axis.

The r1, r2 and r3 were determined from observation of photographs with various view angles using a scanning electron microscope (SEM).

It is preferred that the toner has an average circularity of 0.94 or more and below 1.00, more preferably 0.96 to 0.99. The average circularity of 0.94 or more may favorably lead to excellent dot reproducibility and less fluctuation of color reproducibility at narrow line images in particular. Moreover, the proper transfer ability may advantageously bring about high quality images; the higher average circularity may bring about uniform development, transfer and distribution with less adhesion of toner agglomerates at half tone or solid portions. Consequently, uniform intermediate colors may be reproduced with less color polarization after superimposing toners as color overlapping. It is difficult to take high quality images with sufficient transfer ability and without scattering from the toner far from spherical shape with an average circularity of less than 0.94. These irregular particles may provide many contacting points with smooth surface such as of photoconductors, and concentrate charges at projecting tips, thus exhibit higher adhesive force than relatively spherical particles due to van der Waals force or mirror image force. Therefore, spherical particles among irregular particles and spherical particles within toners are selectively transferred in the electrostatic transfer steps, resulting in voids at letter or line images. In addition, residual toners should be removed for the subsequent developing steps, which resulting in such problems that cleaning devices are necessary or toner yield (the rate of toners for image formation) is lower.

It is preferred that the rate of toner particles having an average circularity of below 0.93 is no more than 30%. Toners with the rate of above 30%, i.e. higher fluctuation of circularity, are undesirable since the charging velocity or level comes to broad and the distribution of charge amount is broad.

The average circularity of the toner is a value obtained by optically detecting toner particles, and the circumferential length of a circle that has an area equivalent to the projection area of the toner is divided by a circumferential length of an actual toner particle; specifically, the average circularity of the toner is measured using a flow particle image analyzer (FPIA-2000, by Sysmex Corp.). Pure water of 100 to 150 mL is poured into a vessel, to which 0.1 mL to 0.5 mL of a surfactant and 0.1 to 9.5 g of a sample are added. The suspension with the sample is dispersed for about 1 to 3 minutes using an ultrasonic device to adjust the concentration into 3000 to 10000/μL then to measure the shape and the distribution of the toner sample.

The agglomeration degree of toners is preferably 1% to 25%, more preferably 3% to 15%. The measurement of the agglomeration degree is carried out as follows using a powder tester (by Hosokawa Micron Co.) as the measuring device, the attachment parts are set on a vibrating table according to the following procedures.

(i) vibro-shoot
(ii) packing
(iii) space ring
(iv) screens (three types) upper>middle>lower
(v) pressing bar The screens are fixed by knob nuts, the vibrating table is operated with the conditions below:

screen opening (upper): 75 μm
screen opening (middle): 45 μm
screen opening (lower): 22 μm
vibration amplitude: 1 mm
sample mass: 2 g
vibrating period: 15 seconds The agglomeration degree is calculated as follows after the operation.

mass of powder on the upper screen×1: (a)

mass of powder on the middle screen×0.6: (b)

mass of powder on the lower screen×0.2: (c)

The total of these three values is defined as the agglomeration degree (%); i.e. agglomeration degree (%)=(a)+(b)+(c).

It is preferred that the toner has a loose apparent density of 0.2 to 0.7 g/mL. The loose apparent density may be measured by a powder tester PT-S (by Hosokawa Micron Co.).

It is preferred that the toner has a volume resistivity of 8 to 15 Log ohm·cm, more preferably 9 to 13 Log ohm·cm.

The volume resistivity is measured by way of pressing a toner into a pellet, the pellet is placed between parallel electrodes with a gap of 2 mm, then DC 1000 volts is applied between the electrodes, the resistivity is measured after 30 seconds by a high resist meter (e.g., TR8601, by Advantest Co.), then the volume resistivity is calculated as a logarithmic value from the measured resistivity and the pellet thickness.

It is preferred that the toner has a softening point of 80° C. to 180° C., more preferably 90° C. to 130° C. The softening temperature of the toner is defined as the temperature at which the flow amount comes to the half under the conditions below in a constant temperature-raising rate.

device: flow tester CTF-500D (by Shimadzu Co.)
load: 20 kfg/cm$^2$
die: 1 mmΦ to 1 mm
temperature-rising rate: 6° C./min
sample mass: 1.0 g It is preferred that the toner has a glass transition temperature Tg of 35° C. to 90° C., more preferably 45° C. to 70° C. The glass transition temperature Tg of the toner may be measured under the following conditions.

differential scanning calorimeter: Seiko 1D SC100, Seiko 1SSC5040 (disc station)
measuring conditions: temperature range of 25° C. to 150° C., temperature-rising rate of 10° C./min, sampling period of 0.5 second, sampling amount: 10 mg Toner Kit The inventive toner kit comprises the inventive toners of at least a yellow toner, a magenta toner and a cyan toner. The magenta toner contains an organic pigment expressed by the following Structural Formula (1); the yellow toner contains an organic pigment having two units per molecule each expressed by Structural Skeleton (A) and no halogen atom.

Structural Formula (1)

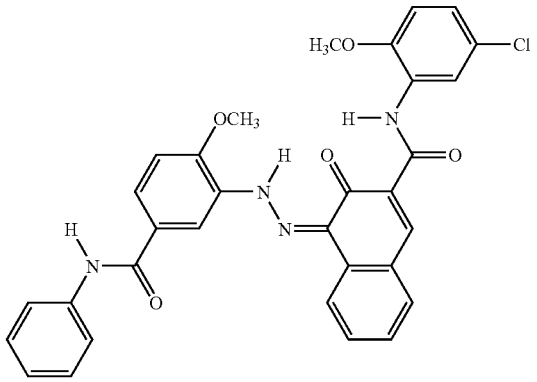

Structural Skeleton (A)

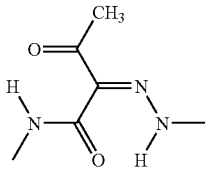

in the Structural Formula (1) and Structural Skeleton (A), ═C═N—NH— encompasses ═CH—N═N—.

The inventive toner kit, which contains a polyester resin synthesized in the presence of a novel titanium-containing catalyst and specific yellow and magenta pigments, may effectively represent color reproducibility of images, in particular color reproducibility of intermediate red.

The mechanism to improve the color reproducibility is not necessarily clear, but it is believed that the effective catalytic activity of the novel titanium-containing catalyst may achieve a condition of molecular chain and/or molecular mass distribution adequate for pigment dispersion. As a result, the energy for the pigment dispersed into the resin on toner production to re-agglomerate again will be reduced, which makes possible to maintain the dispersed condition and improves the color reproducibility at forming images.

Organic pigments represented by Structural Formula (1) as the magenta toner are azo lake pigments. The pigments for the magenta toner have been azo pigments such as azo lake pigments and insoluble azo pigments; and organic pigments such as quinacridone polycyclic pigments. Azo pigments include naphthol pigments and oxynaphthoe acid pigments, and naphthol pigments such as C.I. PR49, C.I. PR68, and C.I. PR 184 have been used so far among them. The quinacridone pigments have been C.I. PR122, C.I. PR209, and C.I. PR206. The magenta toner used for the toner is an oxynaphthoe acid pigment of C.I. PR269 represented by Structural Formula (1). This pigment reproduces brilliant magenta colors due to the narrow absorption band at the wavelength of 500 nm to 600 nm.

Specifically, when the ID (image density: −Log reflectivity) is set to 1.00 measured by X-RITE938 densitometer after fixing an image to recording media such as transfer sheets and film sheets using an observing light D50 (JISZ-8720 (1983)) at a view angle of 2°, "a*" is 55 to 75 and "b*" is −8 to 0 in the color specification system of L*a*b* (CIE1976). These values are obtained through the use of uniform measurements in which color density is measured through a complementary color filter to keep the color density given to humans at a constant state. When "a*" is less than 55 or "b*" is less than 0, the color reproducibility degrades at intermediate colors when mixed with toners with other colors; and when "a*" is more than 75 or "b*" is more than −8, the amount of the pigment should be increased, which leading to higher opacifying power and similarly lower color reproducibility at intermediate colors when mixed with toners with other colors.

The amount of the magenta toner of the organic pigment expressed by Structural Formula (1) is preferably 2 to 15% by mass, more preferably 3 to 10% by mass.

The yellow toner contains an organic pigment that contains an organic pigment having two units per molecule each expressed by Structural Skeleton (A) and no halogen atom. The organic pigment, having two units per molecule each expressed by Structural Skeleton (A) and no halogen atom, is preferably one expressed by Structural Formula (2) or (3) below.

Structural Formula (2)

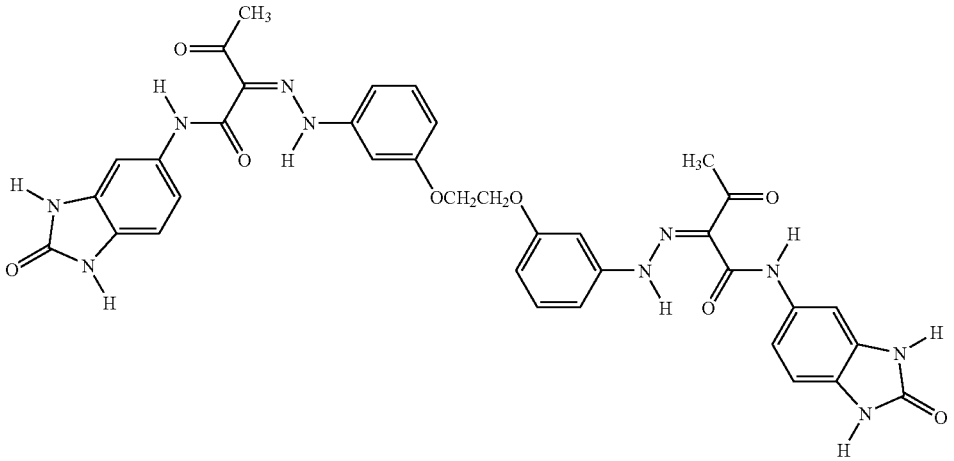

Structural Formula (3)

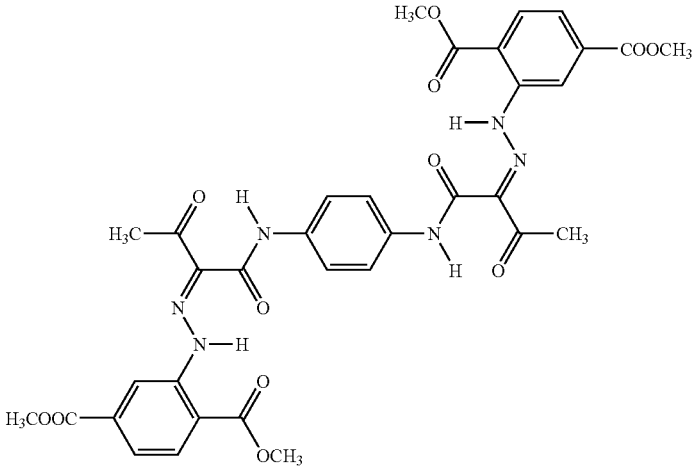

The yellow toner contains an organic pigment expressed by Structural Formula (2) and/or (3), the both are insoluble azo pigments. The yellow toner has been polycyclic organic pigments including acetoacetic acid allylid dis-azo pigments, acetoacetic acid imidazolon pigments, quinacridone pigments and threne pigments. Specifically, acetoacetic acid allylid dis-azo pigments of C.I. PY13 and C.I. PY17 have been widely used. The yellow toners employ the organic pigments expressed by Structural Formula (2), i.e. C.I. pigment yellow 180 disazo organic pigment and/or those by Structural Formula (3), i.e. C.I. pigment yellow 155 dis-azo organic. These pigments contain no halogen and reproduce brilliant yellow colors due to a narrow absorption band at wavelength of 400 to 500 nm.

Specifically, when the ID is set to 1.00 measured by X-RITE938 densitometer after fixing an image to recording media such as transfer sheets and film sheets using an observing light D50 (JISZ-8720 (1983)) at a view angle of 2°, "a*" is −2 to −22 and "b*" is 67 to 90 in the color specification system of L*a*b* (CIE 1976). These values are obtained through the use of uniform measurements in which color density is measured through a complementary color filter to keep the color density given to humans at a constant state. When "a*" is less than −12 or "b*" is less than 67, the color reproducibility degrades at intermediate colors when mixed with toners with other colors; and when "a*" is more than −2 or "b*" is more than 90, the amount of the pigment should be increased, which leading to higher opacifying power and similarly lower color reproducibility at intermediate colors when mixed with toners with other colors.

The mixture of the magenta toner and the yellow toner allows to reproduce red (R) colors. When the ID is 1.00 measured by X-RITE938 densitometer after fixing an image using an observing light D50 (JISZ-8720 (1983)) at a view angle of 2°, "a*" is set to be 60 to 68 and "b*" is set to be 45 to 55 in the color specification system of L*a*b*. The respective ranges of color reproducibility in the L*a*b* color specification system may be adjusted by the contents of the magenta toner and the yellow toner, the amount of adhered toner, and the color reproduction range of red colors may be widened from skin color to vermillion by virtue of the range. When "a*" is less than 60 or "b*" is less than 45, the color reproducible range is narrow and various intermediate reds cannot be reproduced, and when "a*" is more than 68 or "b*" is more than 55, the amount of the pigment should be increased, which leading to higher opacifying power and similarly lower color reproducibility at intermediate colors.

Reproduction of red colors is important when expressing humans and other things; however, the red color reproducibility has been poor compared to photographic papers or sublimation photographs particularly in cases of higher opacifying power since the reproducible range is narrow and organic pigments reduce the transparency. As such, the inventive image forming apparatus may broadly attain red color reproducibility by defining the color reproducible ranges with respect to organic pigments of both of magenta toner and yellow toner.

The amount of the organic pigment, having two units per molecule each expressed by Structural Skeleton (A) and no halogen atom, is preferably 3 to 20% by mass in the yellow toner, more preferably 5 to 15% by mass.

It is preferred that the cyan toner contains a copper phthalocyanine pigment.

It is preferred in the present invention that the layer of the magenta toner is formed under that of the yellow toner. The yellow pigment expressed by Structural Formula (2) or (3) in the inventive toner typically exhibits lower opacifying power thus is far from opacifying the underlying organic pigment. The organic pigments expressed by Structural Formula (2) or (3) described above have a narrower optical absorption range thus are far from disturbing the red color reproduction by the underlying magenta toner. Moreover, the magenta toner, containing the magenta pigment expressed by Structural Formula (1), under the yellow toner may provide red color reproducibility in a wide range.

When a wax is incorporated into the toner of the inventive toner kit, the image surface tends to appear an orange surface, as a result, the rate of diffuse reflection increases such that the spectral reflectance at wavelength of 500 to 700 nm is increased in yellow toners, the spectral reflectance at wavelength of 400 to 500 nm is increased in magenta toners, and the spectral reflectance at wavelength of 400 to 600 nm is increased in yellow toners. As such, when reproducing colors by a subtractive color mixing, increase of reflectance at wavelengths other than to be absorbed may improve the color reproducibility.

The inventive toner kit may be favorably applied to image forming apparatuses that utilize yellow, cyan and magenta toners, and also black toners.

Developer

When the inventive toner is applied to two-component developers, the toner is mixed with a magnetic carrier. The amount of the toner is 1 to 10 parts by mass based on 100 parts by mass of carriers.

The magnetic carrier may be conventional ones such as iron powder, ferrite powder, magnetite powder, resin-coated magnetic carrier and glass beads having a particle diameter of 20 to 200 μm.

Examples of the coating materials of the resin-coated magnetic carrier include phenol resins, amino resins, urea-formaldehyde resins, melamine resins, benzoguanamine resins, urea resins, polyamide resins, epoxy resins, polyvinyl resins, polyvinylidene resins, acrylic resins, polymethylmethacrylate resins, polyacrylonitrile resins, polyvinyl acetate resins, polyvinyl alcohol resins, polyvinyl acetal resins, polyvinyl butyral resins, polystyrene resins, styrene-acrylic copolymer resins, halogenated olefin resins such as polyvinyl chloride resins and polyvinylidene chloride; polyester resins such as polyethylene terephthalate resins and polybuthylene terephthalate resins; polycarbonate resins, polyethylene resins, polyfluorocarbon, polyfluorovinylidene resins, polytrifluoroethylene resins, polyhexafluoropropylene resins, copolymers of vinylidene fluoride and acrylic monomers, copolymers of vinylidene fluoride and vinyl fluoride, fluoro terpolymers such as those of tetrafluoroethylene, and vinylidene fluoride and other non-fluoride monomers, and silicone resins.

Among these, silicone resin-coated carriers are excellent in view of carrier lifetime. Electrically conductive powers may be included into the coating resins as required. Examples of the electrically conductive powers include metal powders, carbon black, titanium oxide, tin oxide and zinc oxide. Preferably, these electrically conductive powers have an average particle diameter of no more than 1 μm since the diameter above 1 μm makes difficult to adjust the resistivity.

In the two-component developers, the amount of the toner is preferably 0.5 to 20.0 parts by mass based on 100 parts of carriers.

The inventive toner may be employed as a magnetic toner in one-component developers without carrier or as non-magnetic toners.

Magnetic Material

The inventive toner may be employed as a magnetic toner with a magnetic material. The magnetic toner may be prepared by incorporating magnetic fine particles into the toner particles. The magnetic materials are exemplified by ferromagnetic metals like iron, nickel and cobalt, alloys and compounds thereof such as iron oxide including ferrites, magnetites and hematites; alloys, which contain no ferromagnetic element but exhibit ferromagnetism through a appropriate heat treatment, such as Huesler alloys containing manganese and copper like Mn—Cu—Al and Mn—Cu—Sn; and chromium dioxide etc.

It is preferred that the magnetic material has an average particle diameter of 0.1 to 2 μm, more preferably 0.1 to 1 μm, and is uniformly dispersed as fine particles. The amount of the magnetic material is preferably 5 to 150 parts by mass based on 100 parts of toner, more preferably 10 to 70 parts by mass, still more preferably 20 to 50 parts by mass.

Image Forming Apparatus and Image Forming Method

The image forming method according to the present invention comprises a latent electrostatic image forming step, a developing step, a transferring step, and a fixing step and further may include other steps suitably selected in accordance with the necessity such as a charge elimination step, a cleaning step, a recycling step and a controlling step.

The image forming apparatus according to the present invention comprises at least a photoconductor, a latent electrostatic image forming unit, a developing unit, a transferring unit, and a fixing unit and may further comprise other units suitably selected in accordance with the necessity such as a charge elimination unit, a cleaning unit, a recycling unit and a controlling unit.

In the latent electrostatic image forming step, a latent electrostatic image is formed on a photoconductor.

The latent electrostatic image bearing member (sometimes referred to as "electrophotographic photoconductor" or "photoconductor") may be properly selected in terms of material, shape, structure, size or the like, and may be suitably selected from conventional ones; the shape of the photoconductor is preferably drum-like; preferable examples of the material include amorphous silicon and selenium for inorganic photoconductors and polysilane and phthalopolymethine for organic photoconductors. Among these, amorphous silicon is preferable in view of longer operating life.

The latent electrostatic images may be formed, for example, by charging the surface of the photoconductor uniformly and then exposing the surface thereof imagewisely by means of the latent electrostatic image forming unit. The latent electrostatic image forming unit is provided with, for example, at least a charger configured to uniformly charge the surface of the photoconductor, and an exposer configured to expose the surface of the photoconductor imagewisely.

The surface of the photoconductor may be charged by applying a voltage to the surface of the photoconductor through the use of, for example, the charger.

The charger may be properly selected depending on the application; examples thereof include conventional contact chargers which are equipped with a conductive or semi-conductive roller, a brush, a film, a rubber blade or the like, and non-contact chargers utilizing corona discharge such as corotoron and scorotoron.

The surface of the photoconductor may be exposed, for example, by exposing the photoconductor surface imagewisely using the exposer.

The exposer may be properly selected depending on the application; examples thereof include various types of exposers such as reproducing optical systems, rod lens array systems, laser optical systems, and liquid crystal shutter optical systems.

In the present invention, the back light method may be employed in which exposing is performed imagewisely from the back side of the photoconductor.

Developing Step and Developing Unit

The developing step is one in which the latent electrostatic image is developed using the developer of the present invention to form a visible image.

The visible image can be formed by developing the latent electrostatic image using, for example, the developer in the developing unit.

The developing unit may be properly selected from conventional ones in the art; preferable examples thereof include those having at least an image developing apparatus which houses the developer of the present invention therein and enables supplying the developer to the latent electrostatic image in a contact or a non-contact state; preferable example is a developing unit with a toner-containing container.

The image developing unit may be of a dry-developing process or a wet-developing process. It may be a monochrome developing unit or a multi-color developing unit. Preferred examples thereof include one having a stirrer by which the developer is frictionally charged, and a rotatable magnet roller.

In the image developing apparatus, for example, a toner and the carrier are mixed and stirred, the toner is charged by frictional force at that time to be held in a state where the toner is standing on the surface of the rotating magnet roller to thereby form a magnetic brush. Since the magnet roller is located near the photoconductor, a part of the toner constituting the magnetic brush formed on the surface of the magnet roller moves to the surface of the photoconductor by electric attraction force. As the result, the latent electrostatic image is developed using the toner to form a visible toner image on the photoconductor surface.

The developer in the developing unit is one that contains the inventive toner. The developer may be of one-component developer or two-component developer.

Transferring Step and Transferring Unit

In the transferring step, the visible image is transferred onto a recording medium, preferably, an intermediate transfer member is used, the visible image is primarily transferred to the intermediate transfer member and then the visible image is secondarily transferred onto the recording medium. An embodiment of the transferring step is more preferable in which two or more color toners are used, an embodiment of the transferring is still more preferably in which a full-color toner is used, and the embodiment includes a primary transferring in which the visible image is transferred to an intermediate transfer member to form a composite transfer image thereon, and a secondary transferring in which the composite transfer image is transferred onto a recording medium.

The transferring may be performed, for example, by charging a visible image formed on the surface of the photoconductor using a transfer-charger to transfer the visible image, and this is enabled by means of the transferring unit. For the transferring unit, it is preferably an embodiment which includes a primary transferring unit configured to transfer the visible image to an intermediate transfer member to form a composite transfer image, and a secondary transferring unit configured to transfer the composite transfer image onto a recording medium.

The intermediate transfer member may be properly selected from conventional ones; preferable examples thereof include transferring belts.

The transferring unit (i.e. primary transferring unit and the secondary transferring unit) preferably includes at least an image-transferer configured to exfoliate and charge the visible image formed on the photoconductor to transfer the visible image onto the recording medium. The transferring unit may be of one part or two or more parts.

Examples of the image transferer include corona transferers, transferring belts, transfer rollers, pressure transfer rollers, and adhesion transfer units. The recording medium may be properly selected from conventional ones.

In the fixing step, a visible image transferred on a recording medium is fixed using a fixing apparatus, and the image fixing may be performed every time each color toner is transferred onto the recording medium or at the time when individual color toners are superimposed.

The fixing apparatus may be properly selected depending on the application, and heat-pressure units known in the art are preferably used. Examples of the heat-pressure units include a combination of a heat roller and a pressure roller, and a combination of a heat roller, a pressure roller, and an endless belt.

The heating temperature in the heat-pressure unit is preferably 80° C. to 200° C.

In the present invention, for example, an optical fixing apparatus known in the art may be used in the fixing step and the fixing unit or instead of the fixing unit.

In the charge elimination step, the charge is eliminated by applying a charge-eliminating bias to the photoconductor, and it can be suitably performed by means of a charge-eliminating unit. The charge-eliminating unit may be properly selected from among conventional ones. For example, charge-eliminating lamps are preferable.

In the cleaning step, a residual electrographic toner remaining on the photoconductor is removed, and the cleaning can be preferably performed using a cleaning unit. The cleaning unit may be properly selected from conventional ones; examples thereof include magnetic brush cleaners, electrostatic brush cleaners, magnetic roller cleaners, blade cleaners, brush cleaners, and web cleaners.

In the recycling step, a step eliminated in the cleaning is recycled to the developing step, and the recycling can be suitably performed by means of a recycling unit. The recycling unit may be properly selected; examples thereof include conventional conveying or transporting units.

The control unit is one to control the every step. The control unit may be properly selected depending on the application; examples thereof include such instruments as sequencers and computers.

The image forming apparatus in this embodiment comprises a charging unit, an exposing unit, a developing unit, a transfer unit, and a cleaning unit in order; and also a paper-feeding unit configured to feed recording media from a paper-feeding tray, and a fixing device configured to fix toners onto recording media after separating recording media, on which toner images being transferred, from the photoconductor. In the image forming apparatus of this configuration, the surface of the rotating photoconductor is uniformly charged by the charging unit then irradiated laser beams from an exposing unit based on image information to form a latent image on the photoconductor, to which then toners are deposited to form images.

On the other hand, the recording media is conveyed from the paper feeding unit, and transported at a transfer site where the photoconductor and the transfer unit face each other. The transfer unit applies the charge of reverse polarity with toner images on the photoconductor, thereby the toner images on the photoconductor are transferred onto the recording media. Then the recording media is separated from the photoconductor and conveyed to a fixing device, where the toners are fixed on the recording media to form images.

FIG. 1 is a schematic constitutional view of developing device 1 of this embodiment. The developing device 1 employed in the inventive image forming apparatus will be explained more specifically with reference to FIG. 1. The developing device 1, which being disposed at a side of photoconductor 8, comprises a non-magnetic developing sleeve 7 that support a two-component developer (hereinafter, sometimes referred to as "developer") containing a toner and a magnetic carrier. The developing sleeve 7 is attached such that a portion thereof is exposed from an opening at a developing casing in the side of photoconductor 1, and is rotated to arrow "b" direction by a driving device (not shown). The material of the developing sleeve may be one used for conventional devices; examples thereof are stainless steel, aluminum, non-magnetic materials like ceramics, and coated materials thereof. The shape of the developing sleeves may also be properly selected. A magnet roller (not shown) of a magnetic-field generating unit is disposed inside the developing sleep. The developing unit 1 is equipped with a rigid doctor 9 as a developer-control member that controls the amount of the developer supported on the developing sleeve 7.

In addition to the doctor 9, a developer container 4 is disposed at upstream of the rotating direction of the developing sleeve 7, the first and the second stirring screws 5, 6 are provide for mechanically stirring the developer in the developer container 4. Furthermore, a toner supply inlet 23 disposed above the developer container 4, a toner hopper 2 for supplying toners to developer container 4, and a toner conveying 3 between the toner supply inlet 23 are provided.

In the developing device 1, the developer in the container 4 is stirred, and the toner and the magnetic carrier are reversely friction-charged by rotating the first and the second stirring screws 5, 6. The developer is supplied to the circumferential surface of the developing sleeve 7 that is rotating toward arrow "b" direction, the developer is supported on the circumferential surface of the developing sleeve 7, and conveyed toward the rotating direction "b". The conveyed developer is then controlled for the amount by the doctor 9, then the controlled developer is conveyed to the developing site where the photoconductor 8 and the developing sleeve 7 face each other. The toner at the site is electrostatically transferred onto electrostatic latent images on the surface of the photoconductor, thereby the electrostatic images are visualized as toner images.

The space of developing gap Gp between the photoconductor 8 and the developing sleeve 7 is preferably 0.01 to 0.7 mm. In cases where the space is less than 0.01 mm, it is possibly difficult to convey toners, decreasing uniformity of solid images, and in cases where the space is above 0.7 mm, the initial charging property and stability of developers are unfavorably deteriorated.

Intermediate Transfer Body

An embodiment of the intermediate transfer body will be explained with reference to FIG. 4. A charging roller 20, an exposing device 30, a cleaning device 60 with a cleaning blade, a charge eliminating device 70, a developing device 40 and an intermediate transfer body 50 are disposed around a photoconductor 10. The intermediate transfer body 50 is suspended by plural suspension rollers 51, and moves toward the arrow direction by driving means such as a motor (not shown) in a manner of an endless belt. One or more of the suspension rollers 51 has an additional role as a transfer bias roller, which supplies a transfer bias to the intermediate transfer body, and a power supply (not shown) applies a desired transfer bias voltage thereto. Additionally, a cleaning device 90 having a cleaning blade for the intermediate transfer body 50 is also arranged. Further, a transfer roller 80 is positioned facing the intermediate transfer body 50 as transfer means to transfer a developed image to a sheet of support paper 100, which is the final support material. A power supply (not shown) applies a transfer bias voltage to the transfer roller 80. Moreover, corona charger 52 as a charging device is located by the intermediate transfer body 50.

The image developer 40 comprises developing belt 41 as a developing agent support, a black (hereinafter Bk) developing unit 45K, yellow (hereinafter Y) developing unit 45Y, magenta (hereinafter M) developing unit 45M, and cyan (hereinafter C) developing unit 45C, the developing units positioned around the developing belt 41. In addition, the developing belt 41 is configured so that it is suspended by a plurality of belt rollers, and by driving means such as a motor or the like (not shown), is advanced to the direction of the arrow in a manner of an endless belt. The developing belt 41 moves at substantially the same speed as the photoconductor 10 at the section where the two contact each other.

Since the configurations of the developing units are common, only the Bk developing unit 45K will be described, and for other developing units 45Y, 45M, and 45C, components that correspond to those in the Bk developing unit 45K are shown in the figure with the same reference numbers followed by a letter Y, M, and C, respectively, and their descriptions are omitted. The developing unit 45K comprises a developing tank 42K that contains a solution of developing agent of high viscosity and high density including toner particles and a carrier liquid component, a scooping roller 43K that is positioned so that its lower portion is dipped in the liquid developing agent within the developing tank 42K, and a applying roller 44K that receives the developing agent scooped by the scooping roller 43K makes a thin layer of the developing agent, and applies the developing agent to the developing belt 41. The applying roller 44K is electrically conductive, and a power supply (not shown) applies a desired bias thereto.

Figure 4:
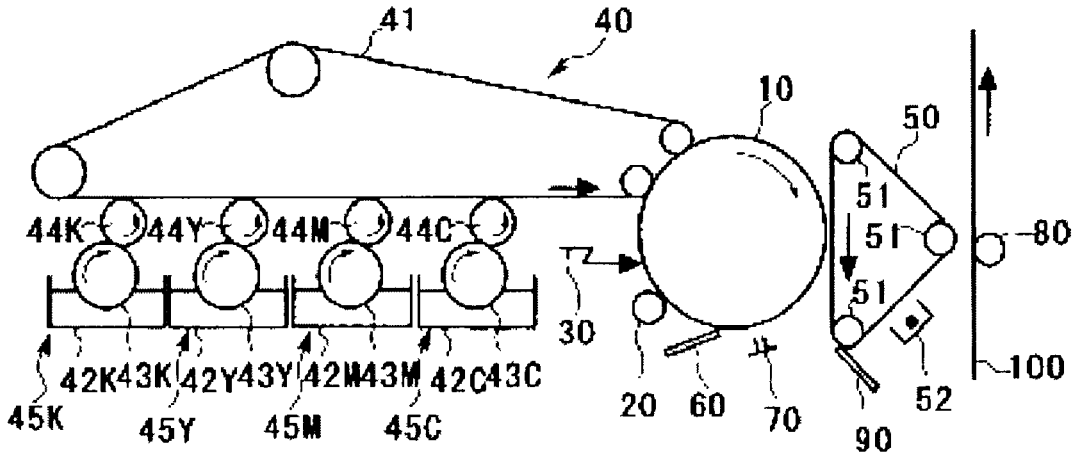
FIG. 4 shows exemplarily an embodiment of an inventive image forming apparatus.
Figure 5:
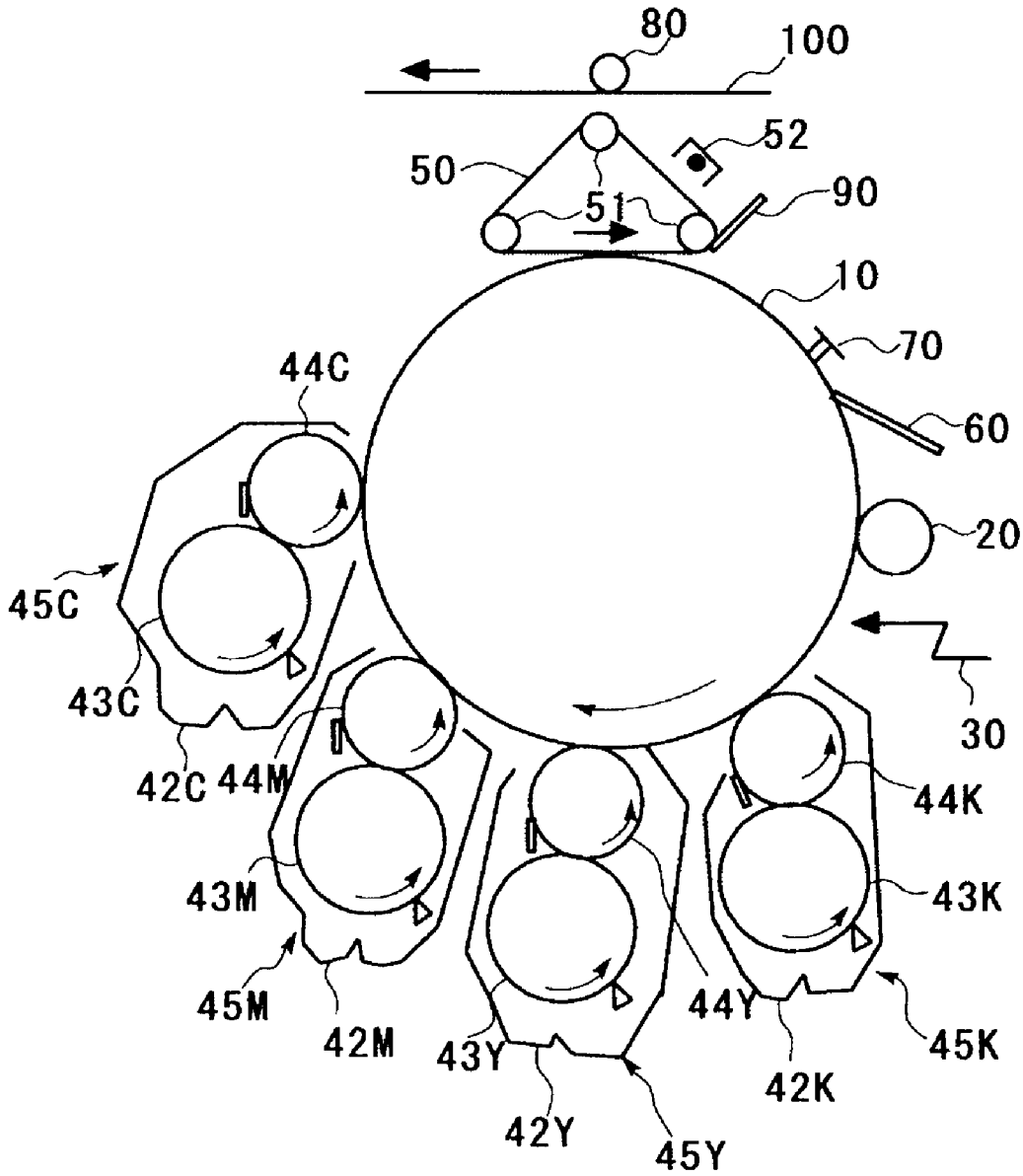
FIG. 5 shows exemplarily another embodiment of an inventive image forming apparatus.

With regards to the device configuration of the copier of this embodiment, a device configuration different from one shown in FIG. 4 may be employed in which a developing unit of each color is located around a photoconductor 10, as shown in FIG. 5.

Next, the operation of the copier of embodiment will be described. In FIG. 1, the photoconductor 10 is rotationally driven in the direction of the arrow and is uniformly charged by the charging roller 20. Then, the exposing device 30 uses reflected light from the original document passing through an optical system (not shown) and forms an electrostatic latent image on the photoconductor 10. The electrostatic latent image is then developed by the image developer 40, and a toner image as a visualized (developed) image is formed. A thin layer of developing agent on the developing belt 41 is released from the belt 41 in a form of a thin layer by a contact with the photoconductor in a developing region, and is moved to the portion where the latent image is formed on the photoconductor 10. The toner image developed by the image developer 40 is transferred to the surface of the intermediate transfer body 50 at a portion of contact (primary transfer region) of the photoconductor 10 and the intermediate transfer body 50 that is moving at the same speed (primary transfer). In a case when three colors or four colors are transferred and overlaid, the process is repeated for each color to form a color image on the intermediate transfer body 50.

The corona charger 52 is placed in order to charge the overlaid toner image on the intermediate transfer body at a position that is downstream of the contact section of the photoconductor 10 and the intermediate transfer body 50, and that is upstream of the contact section of the intermediate transfer body 50 and the sheet of support paper 100 with regards to the direction of the rotation of the intermediate transfer body 50. Then, the corona charger 52 provides a charge to the toner image the polarity of which is the same as that of the toner particles that form the toner image, and gives a sufficient charge for a good transfer to the sheet of support paper 100.

After being charged by the corona charger 52, the toner image is transferred at once to the sheet of support paper 100 that is carried in the direction of the arrow from a sheet feeder (not shown) by a transfer bias of the transfer roller 80 (secondary transfer). Thereafter, the sheet of support paper 100 to which the toner image is transferred is detached from the photoconductor 10 by a detaching device (not shown), and fusing is conducted thereto by a fusing device (not shown). After that, the sheet 100 is ejected from the device. On the other hand, after the transfer, the cleaning device 60 removes and retrieves toner particles that are not transferred from the photoconductor 10, and the charge removing lamp 70 removes remaining charge from the photoconductor 10 to prepare for the next charging.

The static friction coefficient of the intermediate transfer body is preferably 0.1 to 0.6, more preferably 0.3 to 0.5. The volume resistance of the intermediate transfer body is preferably several Ω·cm or more and $10^3$ Ω·cm or less. By controlling the volume resistance from several Ω·cm to $10^3$ Ω·cm, charging of the intermediate transfer body itself is prevented. It also prevents uneven transfer at secondary transfer because the charge provided by charging means does not remain as much. In addition, it is easier to apply transfer bias for the secondary transfer.

The materials for the intermediate transfer body may be properly selected depending on the application; examples are as follows:

(1) Materials with high Young's moduli (tension elasticity) used as a single layer belt, which includes polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's moduli are small in their deformation against stress during image formation and are particularly advantageous in that mis-registration is not easily formed when forming a color image.

(2) A double or triple layer belt using the above-described belt having high Young's modulus as a base layer, added with a surface layer and an optional intermediate layer around the peripheral side of the base layer. The double or triple layer belt has a capability to prevent print defect of unclear center portion in a line image that is caused by the hardness of the single layer belt.

(3) A belt with a relatively low Young's modulus that incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need for ribs and a device to prevent the snaky move.

Conventionally, intermediate transfer belts have been adopting fluorine resins, polycarbonates, polyimides, and the like, but in the recent years, elastic belts in which elastic members are used in all layers or a part thereof. There are issues on transfer of color images using a resin belt.

Color images are typically formed by four colors toners. In one color image, toner layers of layer 1 to layer 4 are formed. Toner layers are pressurized as they pass the primary transfer in which the layers are transferred from the photoconductor to the intermediate transfer belt and the secondary transfer in which the toner is transferred from the intermediate transfer belt to the sheet, which increases the cohesive force among toner particles. As the cohesive force increases, phenomena such as drop outs of letters and dropouts of edges of solid images are likely to occur. Since resin belts are too hard to be deformed by the toner layers, they tend to compress the toner layers and therefore drop out phenomena of letters are likely to occur.

Recently, the demand for printing full color images on various types of paper such as Japanese paper and paper having a rough surface is increasing. However, sheets of paper having low smoothness tend to form gaps between the toner and the sheet at transfer and thus leading to miss-transfers. When the transfer pressure of secondary transfer section is raised in order to increase contact, the cohesive force of the toner layers will be higher, which will result in drop out of letters as described above.

Elastic belts are used for the following aim. Elastic belts deform according to the toner layers and the roughness of the sheet having low smoothness at the transfer section. In other words, since the elastic belts deform to comply with local bumps and holes, a good contact is achieved without increasing the transfer pressure against the toner layers excessively so that it is possible to obtain transferred images having excellent uniformity without any drop out of letters even on sheets of paper of low flatness.

For the resin of the elastic belts, one or more can be selected from the group including polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like.

For the rubber and elastomer of the elastic materials, one or more can be selected from the group consisting of butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers such as polystyrene elastomers, polyolefin elastomers, polyvinyl chloride elastomers, polyurethane elastomers, polyamide elastomers, polyurea elastomers, polyester elastomers and fluorine resin elastomers.

The electric conductive agent may be properly selected depending on the application; examples thereof include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The metal oxides may be coated on non-conducting particulates such as barium sulfate, magnesium silicate, calcium carbonate, and the like.

Materials of the surface layer are required to prevent contamination of the photoconductor by the elastic material and to reduce the surface friction of the transfer belt so that toner adhesion is lessened and the cleanability and secondary transfer property are increased. For example, one or more of polyurethane, polyester, epoxy resin, and the like is used, and powders or particles of a material that reduces surface energy and enhances lubrication such as fluorine resin, fluorine compound, carbon fluoride, titanium dioxide, silicon carbide, or the like can be dispersed and used. One or more lubricant materials may be used, alternatively, powders or particles of different sizes may be employed. In addition, it is possible to use a material such as fluorine rubber that is treated with heat so that a fluorine-rich layer is formed on the surface and the surface energy is reduced.

Charging Unit

Figure 6:
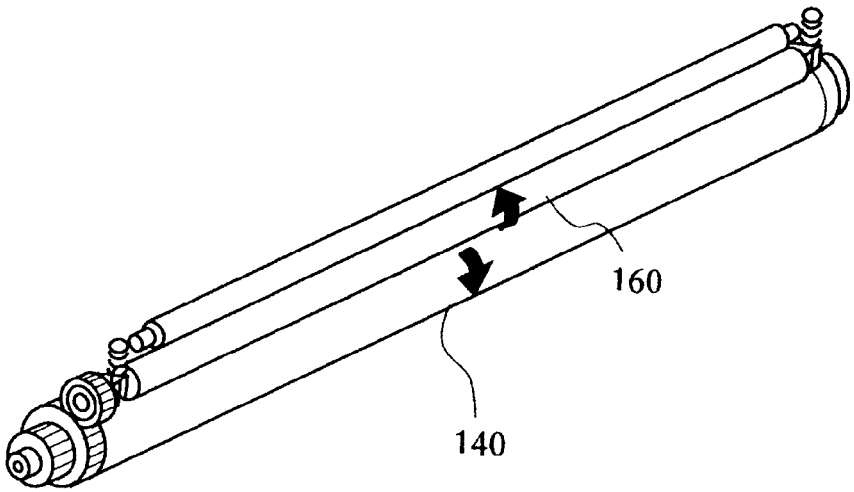
FIG. 6 is a schematic view that shows exemplarily a contact charger used in an inventive image forming apparatus.

FIG. 6 is a schematic diagram showing an example of the image-forming apparatus that equips a contact charger of charging unit. The photoconductor 140 to be charged as a latent electrostatic photoconductor is rotated at a predetermined speed of process speed in the direction shown with the arrow in the figure. The charging roller 160, which is brought into contact with the photoconductor, contains a core rod and a conductive rubber layer formed on the core rod in a shape of a concentric circle. The both terminals of the core rod are supported with bearings (not shown) so that the charging roller enables to rotate freely, and the charging roller is pressed to the photoconductor at a predetermined pressure by a pressure member (not shown). The charging roller 160 in this figure therefore rotates along with the rotation of the photoconductor. The charging roller 160 is generally formed with a diameter of 16 mm in which a core rod having a diameter of 9 mm is coated with a rubber layer having a moderate resistance of approximately 100,000 Ω·cm.

The power supply (not shown) is electrically connected with the core rod of the charging roller 160, and a predetermined bias is applied to the charging roller by the power supply, thereby, the surface of the photoconductor 140 is uniformly charged at a predetermined polarity and potential.

The charging device in the present invention may be a non-contacting unit rather than the contacting unit described above; preferably, the contact charger is preferable since the generation of ozone is relatively little.

An alternative electric field is applied to the charging device of the image forming apparatuses of the present invention. Direct electric field typically generates a great number of $O_3^-$ and $NO_3^-$, since the photoconductor is charged as one polarity. The ozone and nitrogen oxide tend to attach to the photoconductor and degrade the surface of the photoconductor; consequently, the surface of the photoconductor is hardened, the abrasion wear comes to larger, the external additive tends to deposit due to lowered friction coefficients, resulting in frequent occurrences of filming. On the contrary, alternative electric field duplicated with AC may reduce the generation of ozone etc. and the photoconductor may be charged uniformly. In particular, the alternative electric field may suppress the ozone-derived degradation of photoconductor due to the generation of $H_3O^+$ having a reverse polarity.

The configuration of the charging device may be properly selected depending on specifications of the image forming apparatus; for example, the configuration may be magnetic brush, fur brush etc. in addition to roller. The magnetic brush is typically constructed from a charging material of ferrite particles such as Zn—Cu ferrite, a non-magnetic conductive sleeve for the support, or a magnetic roll encased therein. The fur blush is formed of a fur to which such a conductive material is applied as carbon, copper sulfide, metals, or metal oxides; the fur is wounded or adhered to the other metals or conductive materials to form a charging device.

Tandem Color Image Forming Apparatus

Figure 7:
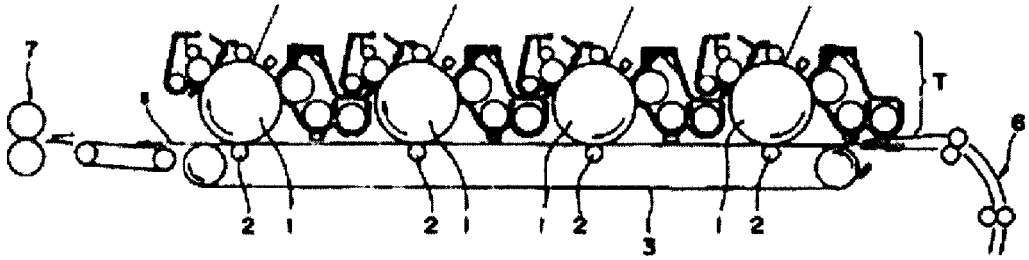
FIG. 7 is a schematic view that exemplarily shows a color-image forming apparatus of tandem system.
Figure 8:
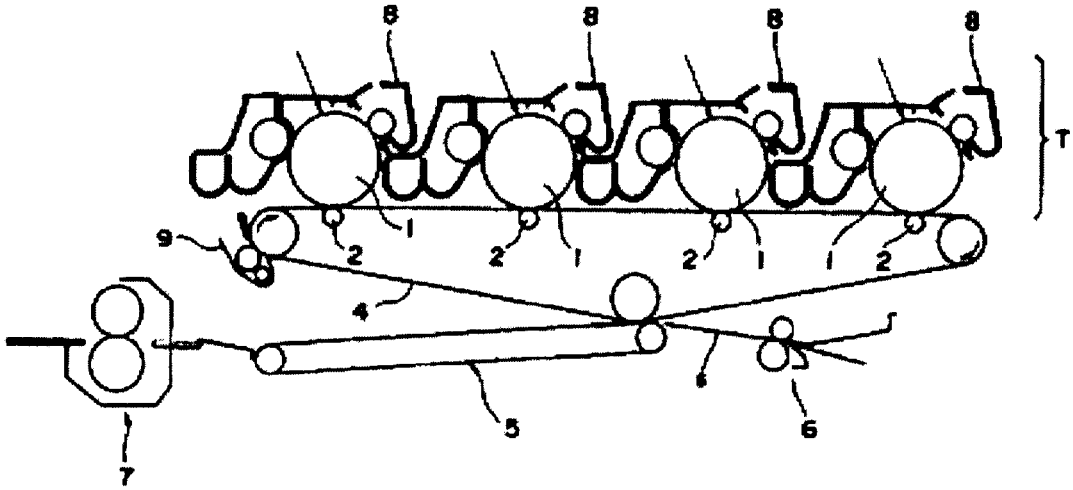
FIG. 8 is a schematic view that exemplarily shows a color-image forming apparatus of tandem system with an intermediate transfer.

FIG. 7 is a schematic view that exemplarily shows a color-image forming apparatus of a tandem system. In the direct transfer system as shown in FIG. 7, a transfer device 2, serving as a transfer, transfers images on individual photoconductors 1 sequentially to a sheet "s", serving as a recording medium, transported by a sheet conveyer belt 3. In the indirect transfer system as shown in FIG. 8, a primary transfer device 2 sequentially transfers images on individual photoconductors 1 to an intermediate transfer 4, and a secondary transfer device 5 transfers the resulting images on the intermediate transfer 4 to the sheet "s" at once. The transfer device 5, serving as the transfer, may be a transfer conveyer belt or a roller.

The direct transfer system must comprise a sheet feeder 6 upstream to the sequentially arrayed photoconductors 1 of the tandem image forming apparatus T and an image-fixing device 7 downstream thereof. The system inevitably increases in its size in a sheet conveying direction. In contrast, in the indirect transfer system, the secondary transfer mechanism can be relatively freely arranged, and the sheet feeder 6 and the image-fixing device 7 can be arranged above and/or below the tandem image forming apparatus T. The apparatus of the indirect transfer system can therefore be downsized.

In the direct transfer system, the image-fixing device 7 should be arranged in the vicinity of the tandem image forming apparatus T to prevent upsizing of the apparatus in a sheet conveying direction. The sheet "s" cannot sufficiently bend in such a small space between the image-fixing device 7 and the tandem image forming apparatus T. Accordingly, image formation upstream to the image-fixing device 7 is affected by an impact, specifically in a thick sheet, formed when the tip of the sheet "s" enters the image-fixing device 7 and by the difference between the conveying speed of the sheet when it passes through the image-fixing device 7 and the conveying speed of the sheet by the transfer conveyor belt.

In contrast, in the indirect transfer system, the sheet "s" can sufficiently bend in a space between the image-fixing device 7 and the tandem image forming apparatus T. Thus, the image-fixing device 7 does not significantly affect the image formation.

In the color electrophotographic apparatus of the tandem type as shown in FIG. 8, a photoconductor cleaning device 8 removes a residual toner on the photoconductor 1 after transferring and cleans the surface of the photoconductor 1 for another image forming process. In addition, an intermediate transfer cleaning device 9 removes residual toners on the intermediate transfer 4 after the secondary transferring step to thereby clean the surface of the intermediate transfer 4 for another image-forming process.

The inventive embodiment will be explained with reference to FIG. 9.

Figure 9:
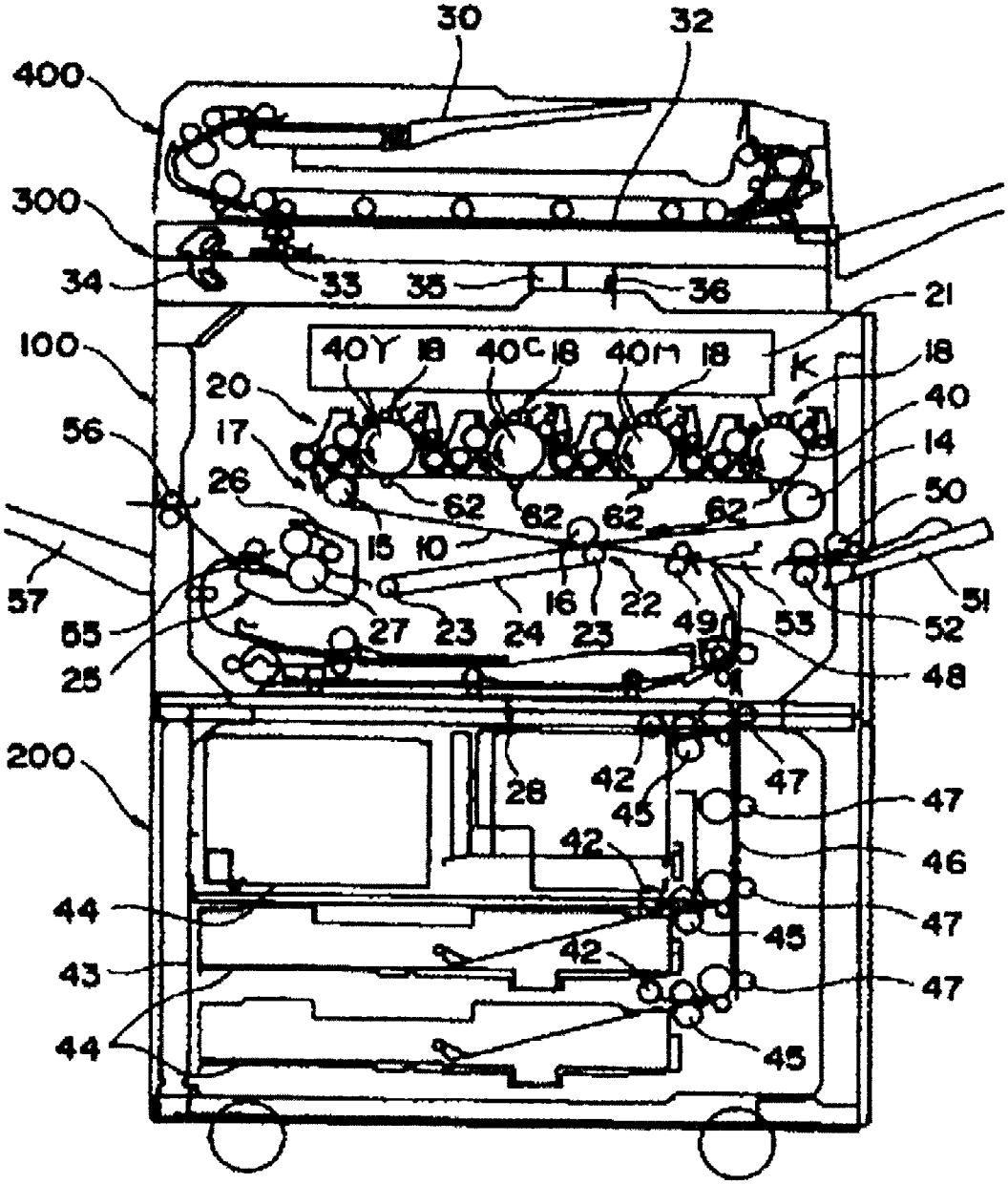
FIG. 9 is a schematic view that exemplarily shows an entire configuration of an image forming apparatus of tandem indirect image transfer system.

FIG. 9 is a schematic view showing an example of an electrophotographic apparatus of the tandem indirect image transfer system as an embodiment using the toner and the developer of the present invention. The apparatus includes a copying machine main body 100, a feeder table 200 on which the copying machine main body 100 is placed, a scanner 300 arranged on the copying machine main body 100, and an automatic document feeder (ADF) 400 arranged on the scanner 300. The copier main body 100 includes an endless-belt intermediate transfer 10.

The intermediate transfer member 10 shown in FIG. 9 is spanned around three support rollers 14, 15 and 16 and is capable of rotating and moving in a clockwise direction in the figure.

This apparatus includes an intermediate transfer cleaning device 17 on the left side of the second support roller 15. The intermediate transfer cleaning device 17 is capable of removing a residual toner on the intermediate transfer 10 after image-transfer.

Above the intermediate transfer 10 spanned between the first and second support rollers 14 and 15, yellow, cyan, magenta, and black image-forming device 18 are arrayed in parallel in a moving direction of the intermediate transfer 10 to thereby constitute a tandem image forming unit 20.

The apparatus further includes an exposing device 21 serving as an image-developer, above the tandem image forming unit 20 and a secondary transfer 22 below the intermediate transfer 10 as shown in FIG. 9. The secondary transfer 22, shown in FIG. 9 comprises an endless belt serving as a secondary transfer belt 24 spanned around two rollers 23. The secondary transfer belt 24 is pressed on the third support roller 16 with the interposition of the intermediate transfer 10 and is capable of transferring an image on the intermediate transfer 10 to a sheet.

An image-fixing device 25 is arranged on the side of the secondary transfer 22 and is capable of fixing a transferred image on the sheet. The image-fixing device 25 comprises an endless image-fixing belt 26 and a pressure roller 27 pressed on the image-fixing belt 26.

The secondary transfer 22 is also capable of transporting a sheet after image transfer to the image-fixing device 25. Naturally, a transfer roller or a non-contact charger can be used as the secondary transfer 22. In this case, the secondary transfer 22 may not have the capability of transporting the sheet.

The apparatus also includes a sheet reverser 28 below the secondary transfer 22 and the image-fixing device 25 in parallel with the tandem image forming unit 20. The sheet reverser 28 is capable of reversing the sheet so as to form images on both sides of the sheet.

A copy is made using the color electrophotographic apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document.

At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the document.

At the push of the start switch (not shown), a drive motor (not shown) rotates and drives one of the support rollers 14, 15 and 16 to thereby allow the residual two support rollers to rotate following the rotation of the one support roller to thereby rotatably convey the intermediate transfer 10. Simultaneously, the individual image forming device 18 rotates their photoconductors 40 to thereby form black, yellow, magenta, and cyan monochrome images on the photoconductors 40, respectively. With the conveying intermediate transfer 10, the monochrome images are sequentially transferred to form a composite color image on the intermediate transfer 10.

Separately at the push of the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copying machine main body 100 and are bumped against a resist roller 49.

Alternatively, the push of the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transfer 10 to transport the sheet into between the intermediate transfer 10 and the secondary transfer 22, and the composite color image is transferred onto the sheet by action of the secondary transfer 22 to thereby record a color image.

The sheet bearing the transferred image is transported by the secondary transfer 22 into the image-fixing device 25, is applied with heat and pressure in the image-fixing device 25 to fix the transferred image, changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the back surface of the sheet. The sheet bearing images on both sides thereof is ejected through the ejecting roller 56 onto the output tray 57.

Separately, the intermediate transfer cleaning device 17 removes a residual toner on the intermediate transfer 10 after image transfer for another image forming procedure by the tandem image forming unit 20.

The resist roller 49 is generally grounded, but it is also acceptable to apply a bias thereto for the removal of paper dust of the sheet.

In the tandem image forming apparatus 20, each of the image forming units 18 comprises drum photoconductor 40, and around the photoconductor 40 are equipped with charge charger 60, developer 61, first transfer unit 62, cleaner 63, charge eliminator 64. Further, developing agent 65, stirring puddle 68, partition plate 69, toner-concentration sensor 71, developing sleeve 72, doctor 73, cleaning blade 75, cleaning brush 76, cleaning roller 77, cleaning blade 78, toner-discharge auger 79, and driving unit 80 are equipped as shown in FIG. 9.

Process Cartridge

The process cartridge applied from the present invention includes at least a latent electrostatic image bearing member to carry electrostatic images, and developing unit for developing by use of the developer to form visible images, and other optional units. The developing unit contains at least a developer container that contains the inventive toner or the developer and a developer carrier that carries and transports the toner or the developer in the developer container, and also a layer-thickness control member to control the layer thickness of the carrying toner.

Figure 10:
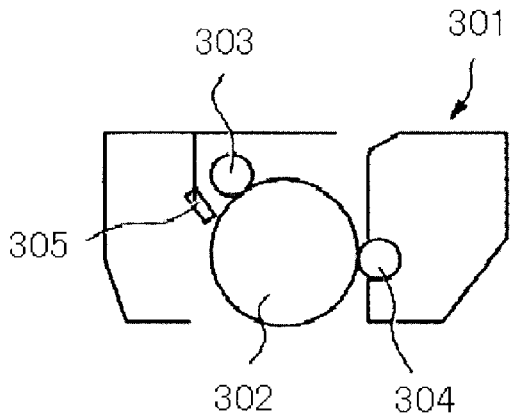
FIG. 10 is a schematic view that exemplarily shows an image forming apparatus of tandem indirect transfer system with an inventive process cartridge.
Figure 11:
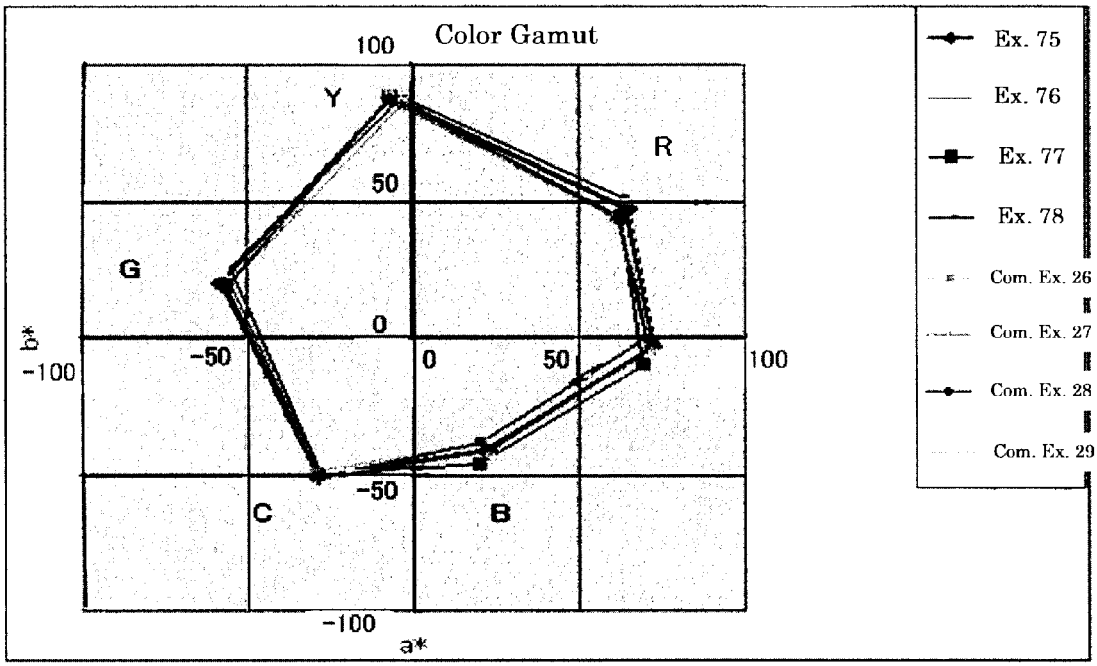
FIG. 11 a graph that plots the values measured for a* and b* in L*a*b* color specification system with respect to the toners of Examples 75 to 78 and Comparative Examples 26 to 29.

FIG. 10 is a schematic view of an image forming apparatus of tandem indirect transfer system that comprises the process cartridge.

The process cartridge contains integrally at least the photoconductor 302 and the developing unit 304 among the photoconductor 302, charging unit 303, developing unit 304, and cleaning unit 305 etc., and preferably, the process cartridge is detachably attached to main bodied of image forming apparatuses such as copiers and printers.

The inventive electrostatic image developing toner, containing the inventive binder resin of the polycondensation polyester resin, may exhibit excellent blocking resistance and low temperature fixability, provide high quality images stably with time under such conditions as high temperature and high humidity, low temperature and low humidity, or outputting larger area images without such problems as decreasing charging capacity due to firm adhesion of toners onto carriers or developing sleeves, and also represent appropriate storage stability, melting-flowability and charging property. Moreover, the resin properties are adequate even though the catalyst is other than tin compounds that are environmentally harmful.

In addition, the inventive toner, in particular the toner combined with the specific charge control agent may be far from background smear under high temperature and high humidity conditions, exhibit proper charging ability, less environmental fluctuation and excellent low temperature fixability, and achieve less environmental load by virtue of the toner binder prepared from catalyst others than tin catalysts that biologically toxic and environmentally harmful.

Moreover, the inventive electrostatic image developing toner, which containing the polyester resin prepared under a specific titanium-containing catalyst and the resin charge control agent in a specific ratio, may exhibit a high charge amount and a sharp charge distribution, excellent initial charging property and excellent background smear, and be hardly affected by temperature/humidity change, be free from smears and filmings for long usage such as several ten thousand sheets on developing supports like developing rollers or sleeves and layer-thickness control members like blades or rollers, and provide efficient productivity due to proper milling ability, and far from environmental problems, as such be appropriate for full-color allocation.

The present invention provide also a one-component developer and two-component developer that contain the toner, and an image forming method and an image forming apparatus that utilize the toner.

The present invention will be explained with reference to Examples, to which the present invention will be limited in no way. In the descriptions of Examples below, all parts means "parts by mass" and all percentages means "% by mass".

In the Examples and Comparative Examples, toner properties were measured in accordance with the following processes.

Measurement of Softening Temperature of Toner

The temperature of a sample material is raised at a constant rate using a flow tester under the conditions below, the temperature at which half of the sample material having been flown out is defined as the softening temperature.

device: flow tester CTF-500D (by Shimadzu Co.)
load: 20 kgf/cm$^2$
die: 1 mmΦ-1 mm
temperature-rising rate: 6° C./min
sample mass: 1.0 g Measurement of Particle Diameter of Toner The particle diameter distribution of toner particles was measured using Coulter counter TA-11 (by Beckman Coulter, Inc.) as follows:

Initially, 0.1 to 5 mL of a surfactant of alkylbenzene sulfonate is added as a dispersant into 100 to 150 mL of an aqueous electrolyte solution. The aqueous electrolyte solution is an about 0.1% NaCl aqueous solution, which is prepared from ISOTON-II (by Beckman Coulter, Inc.). A sample of 2 to 20 mg was added to the electrolyte solution, which was then ultrasonically dispersed for 1 to 3 minutes using a ultrasonic dispersing device, thereafter volume and number of the toner particles are measured by the Coulter counter TA-II using an aperture of 100 μm to calculate the volume distribution and the number distribution, from which the volume average particle diameter and the number average particle diameter are determined.

In order to measure particles having a particle diameter (Pd) of no less than 2.00 μm to less than 40.30 μm, thirteen channels are used such as 2.00 μm≦Pd<2.52 μm, 2.52 μm≦Pd<3.17 μm, 3.17 μm≦Pd<4.00 μm, 4.00 μm≦Pd<5.04 μm, 5.04 μm<Pd<6.35 μm, 6.35 μm≦Pd<8.00 μm, 8.00 μm<Pd<10.08 μm, 10.08 μm≦Pd<12.70 μm, 12.70 μm≦Pd<16.00 μm, 16.00 μm≦Pd<20.20 μm, 20.20 μm≦Pd<25.40 μm, 25.40 μm≦Pd<32.00 μm and 32.00 μm≦Pd<40.30 μm.

Measurement of Average Circularity of Toner

The average circularity is measured using a flow-type particle image analyzer FPIA-2100 (by Sysmex Co.). Specifically, 0.3 mL of a surfactant of alkylbenzene sulfonate is added as a dispersant into 120 mL of pure water, to which about 0.2 g of a sample is added. The dispersion containing the sample is ultrasonically dispersed for about 2 minutes using a ultrasonic dispersing device, the dispersion concentration is adjusted to 5000/μL then the shape and the distribution of the toner are measured.

Measurement of Shape Factors SF-1 and SF-2 of Toner

SEM images taken using FE-SEM (S-4800, by Hitachi, Ltd.) are randomly sampled by 300 views, which are inputted into Image Analyzer LUSEX3 (by Nireco Co.) through an interface and analyzed.

Measurement of Agglomeration Degree of Toner

The agglomeration degree is measured using a powder tester (by Hosokawa Micron Co.) as the measuring device; attachment parts are set on a vibrating table according to the following procedures.

(i) vibro-shoot
(ii) packing
(iii) space ring
(iv) screens (three types) upper>middle>lower
(v) pressing bar The screens are fixed by knob nuts, the vibrating table is operated with the conditions below:

screen opening (upper): 75 μm
screen opening (middle): 45 μm
screen opening (lower): 22 μm
vibration amplitude: 1 mm
sample mass: 2 g
vibrating period: 15 seconds The agglomeration degree is calculated as follows after the operation.

mass of powder on the upper screen×1: (a)

mass of powder on the middle screen×0.6: (b)

mass of powder on the lower screen×0.2: (c)

The total of these three values is defined as the agglomeration degree (%); i.e. agglomeration degree (%) (a)+(b)+(c).

Measurement of Glass Transition Temperature Tg

The glass transition temperature Tg of toner is measured under the following conditions.

differential scanning calorimeter: Seiko 1D SC100, Seiko 1SSC5040 (disc station)

measuring conditions: temperature range of 25° C. to 90° C., temperature-rising rate of 10° C./min, sampling period of 0.5 second, and sampling amount of 10 mg Measurement of Volume Resistivity The volume resistivity is measured by way of pressing a toner into a pellet, the pellet is placed between parallel electrodes with a gap of 2 mm, then DC 1000 volts is applied between the electrodes, the resistivity after 30 seconds is measured by a high resist meter (TR8601, by Advantest Co.), then the volume resistivity is calculated as a logarithmic value from the measured resistivity and the pellet thickness.

Measurement of Loose Apparent Density

The loose apparent density is measured by a powder tester PT-S (by Hosokawa Micron Co.).

[I] EXAMPLES 1 TO 12 AND COMPARATIVE EXAMPLES 1 TO 4

Evaluation Device

Images to be evaluated are formed by use of evaluation devices A, B, C, D or E.

Evaluation Device A

Evaluation device A was a tandem full-color laser printer equipped with a developing unit of a four color non-magnetic two-component system and a four-color photoconductor (IP-SiO Color 8000, by Ricoh Co.) of which the fixing unit was modified into an oilless fixing unit and tuned. The printing rate was high-speed printing of 20 to 50 sheets/min of A4-size.

Evaluation Device B

Evaluation device B was a tandem full-color laser printer equipped with a developing unit of a four color non-magnetic two-component system and a four-color photoconductor (IP-SiO Color 8000, by Ricoh Co.), in which the printer was modified into an intermediate transfer type such that images were primary-transferred onto an intermediate transfer body and then the toner images were secondary-transferred onto a transfer material; and the fixing unit was modified into an oilless fixing unit and tuned. The printing rate was high-speed printing of 20 to 50 sheets/min of A4-size.

Evaluation Device C

Evaluation device C was a full-color laser copier (IMAGIO Color 2800, by Ricoh Co.) where a four-color developing unit develops each color image respectively on one drum-like photoconductor using two-component developers, the color images are transferred on an intermediate transfer body sequentially, then four color images are transferred collectively on a recording medium, in which and the fixing unit was modified into an oilless fixing unit and tuned.

Evaluation Device D

Evaluation device D was a full-color laser printer (IPSiO Color 5000, by Ricoh Co.) where a four-color developing unit develops using each non-magnetic one-component developers respectively on one belt-like photoconductor, the color images were transferred on an intermediate transfer body sequentially, then four color images were transferred collectively on a recording medium, in which and the fixing unit was modified into an oilless fixing unit and tuned.

Evaluation of Two-Component Developer

The two-component developer for evaluating images was prepared, from a ferrite carrier having an average particle diameter of 50 μm and coated with a silicone resin of 0.3 μm thick in average, by mixing 100 part of the carrier and 5 parts of respective color toners uniformly using a tumbler mixer of tumbling-mixing type to charge them, thereby the development was produced.

| Core Material | |
|---|---|
| Cu—Zn ferrite particles *1) | 5000 parts |
| Coating Material | |
| toluene | 450 parts |
| silicone resin (SR2400) *2) | 450 parts |
| amino silane (SH6020) *3) | 10 parts |
| carbon black | 10 parts |

*1) mass average diameter: 35 μm
*2) non-volatile content: 50%, by Toray Dow Corning Silicone Co.
*3) by Toray Dow Corning Silicone Co.

The coating materials were dispersed by a stirrer for 10 minutes to prepare a coating liquid, and the coating liquid and the core material were poured into a coating device that coats the coating liquid onto the core material while swirling them by use of a rotatable bottom disc and stirring blade within a fluidized bed. The coated product was heated at 250° C. for 2 hours to prepare the carrier.

Evaluation Items (1) Carrier Loss

After outputting 100,000 sheets of a chart of 50% image area while controlling image concentration within 1.4±0.2, the charge amount (μc/g) of developers was compared between before and after the outputting and evaluated under the following criteria. The charge amount was measured in accordance with a blow off process.

A: loss of 0% to 30%
B: loss of 30% to 50%
C: loss of 50% or more (2) Fog

As for respective toners, a chart of image area 50% was output at temperature 10° C. and RH 15% continuously on 100,000 sheets, then the toner smear on background was visually evaluated using a loupe under the following criteria.

A: no smear of toner
B: slightly observable smear, substantially no problem
C: some observable smear
D: non-allowable significant smear, problematic (3) Toner Scattering As for respective toners, a chart of image area 10% was output at temperature 40° C. and RH 90% continuously on 100,000 sheets, then the toner smear within the copier was visually evaluated under the following criteria.

A: no smear of toner
B: slightly observable smear, substantially no problem
C: some observable smear
D: non-allowable significant smear, problematic (4) Blocking Resistance (Environmental Preservability)

A toner of 10 g was placed into a glass vessel of 20 mL, then the glass vessel was tapped 100 times and allowed to stand for 48 hours at temperature 55° C. and RH 80%, followed by measuring a penetrating degree (Pd) using a needle-penetrating meter. Separately, the toner was placed into another glass vessel and allowed to stand at low temperature and low humidity condition of 10° C. and RH 15%. The smaller penetrating degree judged between at high temperature and high humidity condition and at low temperature and low humidity condition was employed, and evaluated under the following criteria.

A: 20 mm≦Pd
B: 15 mm≦Pd<20 mm
C: 10 mm≦Pd<15 mm
D: Pd<10 mm (5) Fixability (Hot Offset Resistance, Low Temperature Fixability)

A solid image was output at a toner amount of 1.0±0.1 mg/cm$^2$ on a regular paper and a thick paper (type 6200, by Ricoh Co., copy paper <135>, by NBS Ricoh Co.) using an image forming apparatus (Imagio Neo 450, by Ricoh Co.) that had been modified into a belt-fixing system. A sample toner was fixed on the regular paper while changing the temperature of the fixing belt and the maximum temperature without hot offset was defined as the upper limit of fixing temperature. The lower limit of fixing temperature was defined as the temperature of the fixing roll at which the residual rate of image density after rubbing a fixed image with a pad was 70% or more. It is typically desirable that the upper limit of fixing temperature is 200° C. or higher and the lower limit of fixing temperature is 140° C. or lower.

Synthesis of Titanium-Containing Catalyst

A mixture of 1617 parts of titanium diisopropoxy bis(triethanolaminate) and 126 parts of deionized water was poured into a reactor vessel equipped with a condenser, a stirrer and a nitrogen gas inlet capable of bubbling a liquid therein, the mixture was heated gradually to 90° C. and allowed to react at 90° C. for 4 hours (hydrolysis) while bubbling the liquid with nitrogen gas thereby to prepare titanium dihydroxy bis(triethanolaminate).

Other titanium-containing catalysts in Examples below, available for the present invention, may be prepared in similar synthetic processes.

EXAMPLE 1

Synthesis of Linear Polyester Resin

Four hundred and thirty parts of an adduct of bisphenol A with 2 moles of PO, 300 parts of an adduct of bisphenol A with 3 moles of PO, 257 parts of terephthalic acid, 65 parts of isophthalic acid, 10 parts of maleic anhydride, and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg, and then taken out when the acid value came to 5 mgKOH/g. After cooling to room temperature, the reaction product was milled, consequently, a linear polyester resin AX1-1 was obtained.

The resulting AX1-1 contained no THF-insoluble matter, and had an acid value of 7 mgKOH/g, a hydroxyl value of 12 mgKOH/g, a glass transition temperature Tg of 60° C., a number average molecular mass Mn of 6940, and a peak top molecular mass Mp of 19100. The rate of the molecular mass of no more than 1500 was 1.2%.

Synthesis of Non-Linear Polyester Resin

Three hundred and fifty parts of an adduct of bisphenol A with 2 moles of EO, 326 parts of an adduct of bisphenol A with 3 moles of PO, 278 parts of terephthahc acid, 40 parts of phthahc anhydride, and 2 parts of titanium dihydroxy bis(triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, and cooled to 180° C. when the acid value came to 2 mgKOH/g or less, and 62 parts of trimellitic anhydride was added to the reactant, then the mixture was allowed to react under normal pressure of sealed atmosphere for 2 hours. After cooling to room temperature, the reaction product was milled, consequently, a non-linear polyester resin AX1-1 was obtained.

The resulting AX2-1 contained no THF-insoluble matter, and had an acid value of 35 mgKOH/g, a hydroxyl value of 17 mgKOH/g, a glass transition temperature Tg of 69° C., a number average molecular mass Mn of 3920, and a peak top molecular mass Mp of 112010. The rate of the molecular mass of no more than 1500 was 0.9%.

Synthesis of Toner Binder 1

Four hundred parts of the polyester AX1-1 and 600 parts of the polyester AX2-1 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder 1.

Production of Toner

| Black Toner | |
|---|---|
| water | 1000 parts |
| phthalocyanine green hydrous cake *1) | 200 parts |
| carbon black *2) | 540 parts |
| toner binder 1 | 1200 parts |

*1) solid content: 30%
*2) MA60, by Mitsubishi Chemical Co.

The ingredients described above were mixed by a Henschel mixer to prepare a mixture containing pigment agglomerates to which water infiltrates. The mixture was kneaded for 45 minutes using twin rolls of which the surface being controlled to 130° C., calendered and cooled, then was crushed by a pulverizer thereby to prepare a master batch of pigment.

| | |
|---|---|
| toner binder 1 | 100 parts |
| master batch described above | 8 parts |
| charge control agent (Bontron E-84) *1) | 2 parts |
| wax (aliphatic acid ester wax) *2) | 5 parts |

*1) by Orient Chemical Co.
*2) melting point: 83° C., viscosity: 280 mPa · s at 90° C.

The ingredients described above were mixed by a mixer, and the mixture was melted-kneaded 3 times or more by a two-roll mill, then the kneaded product was calendered-cooled. Then the mixture was milled using a jet-mill of collision-plate type (I-type mill, by Japan Pneumatic Mfg. Co.) and air-classified by swirling flow (DS classifier, by Japan Pneumatic Mfg. Co.) thereby to obtain black color particles having a volume average particle diameter of 5.5 μm. To the black color particles, hydrophobic silica (primary particle diameter: 10 nm, HDK H2000, by Clariant Japan K.K.) was added in an amount of 1.0%, then the mixture was mixed by a Henschel mixer and passed through a screen having an opening of 50 μm to remove agglomerates thereby to prepare a black toner 1. The toner properties are shown in Table 1-1 and evaluation results are shown in Table 2.

| Yellow Toner | |
|---|---|
| water | 600 parts |
| C.I. Pigment Yellow 17 hydrous cake *1) | 1200 parts |
| toner binder 1 | 1200 parts |

*1) solid content: 50%

The ingredients described above were mixed by a Henschel mixer to prepare a mixture containing pigment agglomerates to which water infiltrates. The mixture was kneaded for 45 minutes using twin rolls of which the surface being controlled to 130° C., calendered and cooled, then was crushed by a pulverizer thereby to prepare a master batch of pigment.

| | |
|---|---|
| toner binder 1 | 100 parts |
| master batch describes above | 8 parts |
| charge control agent (Bontron E-84) *1) | 2 parts |
| wax (aliphatic acid ester wax) *2) | 5 parts |

*1) by Orient Chemical Co.
*2) melting point: 83° C., viscosity: 280 mPa · s at 90° C.

The ingredients described above were mixed by a mixer, and the mixture was melted-kneaded 3 times or more by a two-roll mill, then the kneaded product was calendered-cooled. Then the mixture was milled using a jet-mill of collision-plate type (I-type mill, by Japan Pneumatic Mfg. Co.) and air-classified by swirling flow (DS classifier, by Japan Pneumatic Mfg. Co.) thereby to obtain yellow color particles having a volume average particle diameter of 5.5 μm. To the yellow color particles, hydrophobic silica (HDK H2000, by Clariant Japan K.K.) was added in an amount of 1.0%, then the mixture was mixed by a Henschel mixer and passed through a screen having an opening of 50 μm to remove agglomerates thereby to prepare yellow toner 1. The toner properties are shown in Tables 1-1 and 1-2, and evaluation results are shown in Table 2.

| Magenta Toner | |
|---|---|
| water | 600 parts |
| C.I. Pigment Red 57 hydrous cake *1) | 1200 parts |
| toner binder 1 | 1200 parts |

*1) solid content: 50%

The ingredients described above were mixed by a Henschel mixer to prepare a mixture containing pigment agglomerates to which water infiltrates. The mixture was kneaded for 45 minutes using twin rolls of which the surface being controlled to 130° C., calendered and cooled, then was crushed by a pulverizer thereby to prepare a master batch of pigment.

| | |
|---|---|
| toner binder 1 | 100 parts |
| master batch described above | 8 parts |
| charge control agent (Bontron E-84) *1) | 2 parts |
| wax (aliphatic acid ester wax) *2) | 5 parts |

*1) by Orient Chemical Co.
*2) melting point: 83° C., viscosity: 280 mPa · s at 90° C.

The ingredients described above were mixed by a mixer, and the mixture was melted-kneaded 3 times or more by a two-roll mill, then the kneaded product was calendered-cooled. Then the mixture was milled using a jet-mill of collision-plate type (I-type mill, by Japan Pneumatic Mfg. Co.) and air-classified by swirling flow (DS classifier, by Japan Pneumatic Mfg. Co.) thereby to obtain magenta color particles having a volume average particle diameter of 5.5 μm. To the yellow color particles, hydrophobic silica (HDK H2000, by Clariant Japan K.K.) was added in an amount of 1.0%, then the mixture was mixed by a Henschel mixer and passed through a screen having an opening of 50 μm to remove agglomerates thereby to prepare magenta toner 1. The toner properties are shown in Tables 1-1 and 1-2, and evaluation results are shown in Table 2.

| Cyan Toner | |
|---|---|
| water | 600 parts |
| C.I. Pigment Blue 15:3 hydrous cake *1) | 1200 parts |
| toner binder 1 | 1200 parts |

*1) solid content: 50%

The ingredients described above were mixed by a Henschel mixer to prepare a mixture containing pigment agglomerates to which water infiltrates. The mixture was kneaded for 45 minutes using twin rolls of which the surface being controlled to 130° C., calendered and cooled, then was crushed by a pulverizer thereby to prepare a master batch of pigment.

| | |
|---|---|
| toner binder 1 | 100 parts |
| master batch described above | 8 parts |
| charge control agent (Bontron E-84) *1) | 2 parts |
| wax (aliphatic acid ester wax) *2) | 5 parts |

*1) by Orient Chemical Co.
*2) melting point: 83° C., viscosity: 280 mPa · s at 90° C.

The ingredients described above were mixed by a mixer, and the mixture was melted-kneaded 3 times or more by a two-roll mill, then the kneaded product was calendered-cooled. Then the mixture was milled using a jet-mill of collision-plate type (I-type mill, by Japan Pneumatic Mfg. Co.) and air-classified by swirling flow (DS classifier, by Japan Pneumatic Mfg. Co.) thereby to obtain cyan color particles having a volume average particle diameter of 5.5 μm. To the yellow color particles, hydrophobic silica (HDK H2000, by Clariant Japan K.K.) was added in an amount of 1.0%, then the mixture was mixed by a Henschel mixer and passed through a screen having an opening of 50 μm to remove agglomerates thereby to prepare cyan toner 1. The toner properties are shown in Tables 1-1 and 1-2, and evaluation results are shown in Table 2. The evaluation was conducted using an evaluation device A.

EXAMPLE 2

Synthesis of Linear Polyester Resin

A linear polyester resin AX1-2 was prepared by a similar reaction as that of Example 1 (AX1-1), followed by cooling to room temperature and milling except that the polycondensation catalyst was changed into titanyl bis(triethanolaminate).

The resulting AX1-2 contained no THF-insoluble matter, and had an acid value of 8 mgKOH/g, a hydroxyl value of 10 mgKOH/g, a glass transition temperature Tg of 60° C., a number average molecular mass Mn of 6820, and a peak top molecular mass Mp of 20180. The rate of the molecular mass of no more than 1500 was 1.1%.

Synthesis of Non-Linear Polyester Resin

A linear polyester resin AX2-2 was prepared by a similar reaction as that of Example 1 (AX2-1), followed by cooling to room temperature and milling except that the polycondensation catalyst was changed into titanyl bis( triethanolaminate).

The resulting AX2-2 contained no THF-insoluble matter, and had an acid value of 33 mgKOH/g, a hydroxyl value of 14 mgKOH/g, a glass transition temperature Tg of 70° C., a number average molecular mass Mn of 4200, and a peak top molecular mass Mp of 11800. The rate of the molecular mass of no more than 1500 was 0.8%.

Synthesis of Toner Binder 2

The inventive toner binder 2 was prepared by powder-mixing 500 parts of the polyester AX1-2 and 500 parts of the polyester AX2-2 for 5 minutes using a Henschel mixer.

Preparation of Toner

A toner was prepared and evaluated in the same manner as the black toner of Example 1 except that the toner binder 2 was used in the toner resin and the master batch. The toner properties are shown in Tables 1-1 and 1-2, and evaluation results are shown in Table 2. The evaluation was conducted using an evaluation device A.

EXAMPLE 3

Synthesis of Modified Polyester Resin

Five hundred and forty-nine parts of an adduct of bisphenol A with 2 moles of propylene oxide, 20 parts of an adduct of bisphenol A with 3 moles of propylene oxide, 133 parts of an adduct of bisphenol A with 2 moles of ethylene oxide, 133 parts of an adduct of phenol novolac (average polymerization degree: about 5) with 5 moles of ethylene oxide, 252 parts of terephthahc acid, 19 parts of isophthalic acid, 10 parts of trimellitic anhydride, and 2 parts of titanium dihydroxy bis (triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg till the acid value came to 2 mgKOH/g or less. Then 50 parts of trimellitic anhydride was added to the reactant, which was allowed to react under normal pressure for 1 hour followed by reacting under a reduced pressure of 20 to 40 mmHg, then 20 parts of bisphenol A diglycidyl ether was added to the reactant, followed by taking out when the softening temperature came to 150° C. After cooling to room temperature, the reaction product was milled, consequently, a modified polyester resin AY1-1 was obtained.

The resulting AY1-1 had an acid value of 52 mgKOH/g, a hydroxyl value of 16 mgKOH/g, a glass transition temperature Tg of 73° C., a number average molecular mass Mn of 1860, a peak top molecular mass Mp of 6550, and a THF-insoluble content of 32%; the rate of the molecular mass of no more than 1500 was 1.0%, which was used as toner binder 3.

Preparation of Toner

A toner was prepared and evaluated in the same manner as the black toner of Example 1 except that the toner binder 3 was used in the toner resin and the master batch. The toner properties are shown in Tables 1-1 and 1-2, and evaluation results are shown in Table 2. The evaluation was conducted using an evaluation device A.

EXAMPLE 4

Synthesis of Non-Linear Polyester Resin

One hundred and thirty-two parts of an adduct of bisphenol A with 2 moles of propylene oxide, 371 parts of an adduct of bisphenol A with 3 moles of propylene oxide, 20 parts of an adduct of bisphenol A with 2 moles of ethylene oxide, 125 parts of an adduct of phenol novolac (average polymerization degree: about 5) with 5 moles of propylene oxide, 201 parts of terephthalic acid, 25 parts of maleic anhydride, 35 parts of dimethyl terephthalate and 2 parts of titanyl bis(triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, and cooled to 180° C. when the acid value came to 2 mgKOH/g or less, and 65 parts of trimellitic anhydride was added to the reactant, then the mixture was allowed to react under normal pressure of sealed atmosphere for 2 hours. After cooling to room temperature, the reaction product was milled, consequently, a non-linear polyester resin AX2-3 was obtained.

The resulting non-linear polyester resin (AX2-3) had a softening temperature of 144° C., an acid value of 30 mgKOH/g, a hydroxyl value of 16 mgKOH/g, a glass transition temperature Tg of 59° C., a number average molecular mass Mn of 1410, a peak top molecular mass Mp of 4110, and a THF-insoluble content of 27%; the rate of the molecular mass of no more than 1500 was 1.0%, which was used as toner binder 4.

Preparation of Toner

A toner was prepared and evaluated in the same manner as the black toner of Example 1 except that the toner binder 4 was used in the toner resin and the master batch. The toner properties are shown in Tables 1-1 and 1-2, and evaluation results are shown in Table 2. The evaluation was conducted using an evaluation device A.

EXAMPLE 5

Synthesis of Non-Linear Polyester Resin

Four hundred and ten parts of an adduct of bisphenol A with 2 moles of propylene oxide, 270 parts of an adduct of bisphenol A with 3 moles of propylene oxide, 110 parts of terephthalic acid, 125 parts of isophthalic acid, 15 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg, and cooled to 180° C. when the acid value came to 2 mgKOH/g or less, and 25 parts of trimellitic anhydride was added to the reactant, then the mixture was allowed to react under normal pressure of sealed atmosphere for 2 hours. After cooling to room temperature, the reaction product was milled, consequently, a non-linear polyester resin AX2-4 was obtained.

The resulting AX2-4 contained no THF-insoluble matter, and had an acid value of 18 mgKOH/g, a hydroxyl value of 37 mgKOH/g, a glass transition temperature Tg of 62° C., a number average molecular mass Mn of 2130, and a peak top molecular mass Mp of 5350. The rate of the molecular mass of no more than 1500 was 1.3%.

Synthesis of Modified Polyester Resin

Three hundred and seventeen parts of an adduct of bisphenol A with 2 moles of ethylene oxide, 57 parts of an adduct of bisphenol A with 2 moles of propylene oxide, 298 parts of an adduct of bisphenol A with 3 moles of propylene oxide, 75 parts of an adduct of phenol novolac (average polymerization degree: about 5) with 5 moles of propylene oxide, 30 parts of isophthalic acid, 157 parts of terephthalic acid, 27 parts of maleic anhydride, and 2 parts of titanium dihydroxy bis(triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, and cooled to 180° C. till the acid value came to 2 mgKOH/g or less. Then 68 parts of trimellitic anhydride was added to the reactant, which was allowed to react under normal pressure for 1 hour followed by reacting under a reduced pressure of 20 to 40 mmHg, then 25 parts of bisphenol A diglycidyl ether was added to the reactant, followed by taking out when the softening temperature came to 155° C. After cooling to room temperature, the reaction product was milled, consequently, a modified polyester resin AY1-2 was obtained.

The resulting AY1-2 had an acid value of 11 mgKOH/g, a hydroxyl value of 27 mgKOH/g, a glass transition temperature Tg of 60° C., a number average molecular mass Mn of 3020, a peak top molecular mass Mp of 6030, and a THF-insoluble content of 35%. The rate of the molecular mass of no more than 1500 was 1.1%.

Synthesis of Toner Binder 5

Five hundred parts of the AX2-3 and 500 parts of the AY1-2 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder 5.

Preparation of Toner

A toner was prepared and evaluated in the same manner as the black toner of Example 1 except that the toner binder 5 was used in the toner resin and the master batch. The toner properties are shown in Tables 1-1 and 1-2, and evaluation results are shown in Table 2. The evaluation was conducted using an evaluation device A.

EXAMPLE 6

A black toner was prepared in the same manner as black toner 1 of Example 1, except that external additives were mixed in a wet process as described below, and evaluated in the same manner as Example 1.

Ten parts of black color particles having a volume average particle diameter of 5.5 μm of Example 1 and 2 parts of hydrophobic silica having a primary particle diameter of 10 nm (HDK H2000, by Clariant Japan K.K.) were dispersed-mixed in water containing 0.1% of a surfactant using a mono-pump. While monitoring the slurry by fluorescent X ray analysis that the additive amount of the silica came to 1% by mass, a toner was prepared from the slurry, and passed through a screen having an opening of 50 μm to remove agglomerates thereby to prepare a black toner. The toner properties are shown in Tables 1-1 and 1-2, and evaluation results are shown in Table 2. The evaluation was conducted using an evaluation device A.

EXAMPLE 7

A black toner was prepared in the same manner as black toner 1 of Example 1, except that external additives were mixed in the following process.

In addition to black toner 1, 0.4 parts of zinc stearate was mixed by a Henschel mixer, then the mixture was passed through a screen having an opening of 50 μm to remove agglomerates thereby to prepare a black toner.

The toner properties are shown in Tables 1-1 and 1-2, and evaluation results are shown in Table 2. The evaluation was conducted using an evaluation device A.

EXAMPLE 8

A black toner was prepared in the same manner as black toner 1 of Example 1, except that external additives were mixed in the following process.

In addition to black toner 1, 0.5% by mass of titanium oxide (average primary particle diameter: 15 nm, STM-150AI, by Tayca Co.) was mixed by a Henschel mixer, then the mixture was passed through a screen having an opening of 50 μm to remove agglomerates thereby to prepare a black toner.

The toner properties are shown in Tables 1-1 and 1-2, and evaluation results are shown in Table 2. The evaluation was conducted using an evaluation device A.

EXAMPLE 9

A chemical toner was prepared in the following processes and evaluated in the same manner as Example 1.

Synthesis of Emulsion of Organic Fine Particles

Six hundred and eighty-three parts of water, 11 parts of sodium salt of an adduct of sulfonate with methacrylic acid ethylene oxide (Eleminol RS-30, by Sanyo Chemical Industries Ltd.), 166 parts of methacrylic acid, 110 parts of butylacrylate and 1 part of ammonium persulfate were poured into a reaction vessel set with a stirring rod and a thermometer, and the mixture was stirred at 3800 rpm for 30 minutes to prepare a white emulsion, which was allowed to react at 75° C. for 3 hours. Thirty parts of 1% ammonium persulfate aqueous solution was further added to the reactant, which was then aged at 70° C. for 5 hours to prepare an aqueous dispersion (fine particle dispersion 1) of a vinyl resin (copolymer of methacrylic acid, butylacrylate, and sodium salt of an adduct of sulfonate with methacrylic acid ethylene oxide). The volume average particle diameter of the fine particle dispersion 1 was measured to be 75 nm using LA-920. A part of the fine particle dispersion 1 was dried to separate the resin content. The glass transition temperature Tg of the resin content was 60° C. and the mass average molecular mass Mw was 110000.

Preparation of Aqueous Phase

Nine hundred and ninety parts of water, 83 parts of the fine particle dispersion 1, 37 parts of 48.3% aqueous solution of sodium dodecyldiphenylether disulfonate (Eleminol MON-7, by Sanyo Chemical Industries Ltd.), and 90 parts of ethylacetate were mixed and stirred to prepare an opaque liquid of aqueous phase 1.

Synthesis of Low-Molecular Mass Polyester

Four hundred and thirty parts of an adduct of bisphenol A with 2 moles of PO, 300 parts of an adduct of bisphenol A with 3 moles of PO, 257 parts of terephthalic acid, 65 parts of isophthalic acid, 10 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 200° C. for 8 hours under nitrogen gas flow while distilling away the water generated in the reaction. Then the reactant was allowed to react under a reduced pressure of 5 to 20 mmHg, and taken out when the acid value came to 7 mgKOH/g. After cooling to room temperature, the reaction product was milled, consequently, a low-molecular mass polyester resin 1 was obtained.

The resulting low-molecular mass polyester resin 1 contained no THF-insoluble matter, and had an acid value of 9 mgKOH/g, a hydroxyl value of 12 mgKOH/g, a glass transition temperature Tg of 52° C., a number average molecular mass Mn of 4820, and a peak top molecular mass Mp of 17000. The rate of the molecular mass of no more than 1500 was 0.8%.

Synthesis of Intermediate Polyester

Six hundred and eighty-two parts of an adduct of bisphenol A with 2 moles of ethylene oxide, 81 parts of an adduct of bisphenol A with 2 moles of propylene oxide, 283 parts of terephthalic acid, 22 parts of trimellitic anhydride, and 2 parts of dibutyltin oxide were poured into a reactor vessel equipped with a condenser, a stirrer and a nitrogen gas inlet, and the mixture was allowed to react at 230° C. for 7 hours under normal pressure and for 5 hours under a reduced pressure of 10 to 15 mmHg to prepare an intermediate polyester 1. The intermediate polyester 1 had a number average molecular mass of 2200, a mass average molecular mass of 9700, a glass transition temperature Tg of 54° C., an acid value of 0.5 mgKOH/g and a hydroxyl value of 52 mgKOH/g.

Next, 410 parts of the intermediate polyester 1, 89 parts of isophoronediisocyanate and 500 parts of ethylacetate were poured into a reactor vessel equipped with a condenser, a stirrer and a nitrogen gas inlet, and the mixture was allowed to react at 100° C. for 5 hours to prepare prepolymer 1. The content of free isocyanate was 1.53% by mass in the prepolymer 1.

Synthesis of Ketimine

One hundred and seventy parts of isophoronediamine and 75 parts of methylethylketone were poured into a reaction vessel set with a stirring rod and a thermometer, and the mixture was allowed to react at 50° C. for 4.5 hours to prepare ketimine compound 1. The ketimine compound 1 had an amine value of 417.

Preparation of Master Batch (Mb)

Six hundred parts of water, Pigment Blue 15:3 hydrous cake (solid content: 50%) and 1200 parts of polyester resin were mixed using a Henschel mixer (by Mitsui Mining Co.). The mixture was then kneaded for 45 minutes at 120° C. using twin rolls, followed by being calendered and cooled, then was crushed by a pulverizer thereby to prepare master batch 1.

Preparation of Oil Phase

Three hundred and seventy-eight parts of the low-molecular mass polyester 1, 100 parts of Carnauba wax and 947 parts of ethylacetate were poured into a reaction vessel set with a stirring rod and a thermometer, and the mixture was heated to 80° C. and maintained at 80° C. for 5 hours then cooled to 30° C. over 1 hour. Then 500 parts of the mater batch 1 and 500 parts of ethylacetate were introduced into the vessel, the mixture was mixed for 1 hour to obtain raw material solution 1.

Thereafter, 1324 parts of the raw material solution 1 was transferred into a container, a pigment and a wax were dispersed into the raw material solution 1 using a beads mill (Ultra Visco mill, by AIMEX Co.) under the conditions of liquid feed rate of 1 kg/hr, disc circumferential velocity of 6 m/sec, 0.5 mm zirconia beads of 80% by volume, and three times pass to prepare a mixture. Then 1324 parts of an ethylacetate solution of 65% low-molecular mass polyester 1 was added to the mixture, which was then passed through the beads mill two times under the conditions described above thereby to prepare pigment-wax dispersion 1. The solid content of the pigment-wax dispersion 1 was 50% at 130° C. for 30 minutes.

Emulsification and de-Solvent

Seven hundred and forty-nine parts of the pigment-wax dispersion 1, 115 parts of the prepolymer 1 and 2.9 parts of the ketimine compound 1 were poured into a container to prepare a mixture, which was then mixed at 5000 rpm for 2 minutes using TK homomixer (by Primix Co.), followed by adding 1200 parts of the aqueous phase 1 into the container and mixing at 13000 rpm for 25 minutes using TK homomixer to prepare emulsified slurry 1.

The emulsified slurry 1 was poured into a vessel set with a stirring rod and a thermometer, then subjected to remove solvents at 30° C. for 8 hours, and aged at 45° C. for 7 hours to prepare dispersion slurry 1.

Purification and Drying

One hundred parts of the dispersion slurry 1 was vacuum-filtered, followed by:

(1) 100 parts of deionized water was added to the filtered cake, the mixture was mixed using TK homomixer at 12000 rpm for 10 minutes and then filtered;

(2) 100 parts of 10% sodium hydroxide aqueous solution was added to the filtered cake (1), the mixture was mixed using TK homomixer at 12000 rpm for 30 minutes and then filtered;

(3) 100 parts of 10% hydrogen chloride aqueous solution was added to the filtered cake (2), the mixture was mixed using TK homomixer at 12000 rpm for 10 minutes and then filtered;

(4) 300 parts of deionized water was added to the filtered cake (3), the mixture was mixed using TK homomixer at 12000 rpm for 10 minutes and then this procedure was repeated once more to prepare filtered cake 1; and the filtered cake 1 was dried at 45° C. for 48 hours.

Next, a toner base and 1% aqueous dispersion of the fluorine compound (2) shown below were mixed within a water bath in an amount of 0.1% by mass of the fluorine compound (2) based on the toner base to adhere or deposit the fluorine compound (2). Then the mixture was dried at 45° C. for 48 hours in an air-circulating dryer and further at 30° C. for 10 hours on shelves, and then screened through a mesh of opening 75 μm thereby to prepare toner base particles 1.

Fluorine Compound (2)

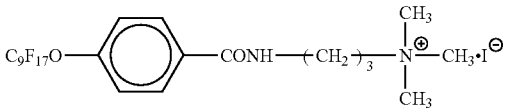

Next, 100 parts of the toner base particles 1 and hydrophobic silica having a primary particle diameter of 10 nm (HDK H2000, by Clariant Japan K.K.) were mixed by a Henschel mixer (FM20C, by Mitsui Mining Co.) to prepare a toner under such conditions as three repeating times of rotating for 20 seconds at circumferential velocity 30 m/sec as well as stopping for 60 seconds.

The toner properties are shown in Tables 1-1 and 1-2, and evaluation results are shown in Table 2. The evaluation was conducted using an evaluation device A.

EXAMPLES 10 TO 12

Toners were prepared in the same manner as Example 1 using the black toner of Example 1 and evaluated except that the evaluation devices were devices B, C or D. The results are shown in Table 2.

COMPARATIVE EXAMPLE 1

A toner was prepared and evaluated in the same manner as Example 1, except that the binder resin used for the black toner of Example 1 was changed into the resin H2 shown below.

Two hundred and twenty-mme parts of an adduct of bisphenol A with 2 moles of ethylene oxide, 529 parts of an adduct of bisphenol A with 3 moles of propylene oxide, 208 parts of terephthalic acid, 46 parts of adipic acid and 2 parts of dibutyltin oxide were poured into a reactor vessel equipped with a condenser, a stirrer and a nitrogen gas inlet, and the mixture was allowed to react at 230° C. for 7 hours under normal pressure and further under a reduced pressure of 10 to 15 mmHg for 5 hours. Then 44 parts of trimellitic anhydride was poured into the reaction vessel and the reactant was allowed to react at 180° C. for 3 hours under normal pressure thereby to prepare a polyester resin H2. The resulting polyester resin H2 had a number average molecular mass of 2300, a mass average molecular mass of 6700, a glass transition temperature Tg of 43° C. and an acid value of 25 mgKOH/g. One part of dibutyltin was mixed as for the catalyst.

The toner properties are shown in Tables 1-1 and 1-2, and evaluation results are shown in Table 2. The evaluation was conducted using an evaluation device A.

COMPARATIVE EXAMPLE 2

A black toner was prepared and evaluated in the same manner as that of Example 1, except that the particle diameter, the particle diameter distribution, the content of fine powder and the content of course powder were adjusted as shown in Table 1-1 by classifying procedures. The toner properties are shown in Tables 1-1 and 1-2, and evaluation results are shown in Table 2. The evaluation was conducted using an evaluation device A.

COMPARATIVE EXAMPLE 3

A black toner was prepared and evaluated in the same manner as that of Example 1, except that the particle diameter, the particle diameter distribution, the content of fine powder and the content of course powder were adjusted as shown in Table 1-1 by classifying procedures. The toner properties are shown in Tables 1-1 and 1-2, and evaluation results are shown in Table 2. The evaluation was conducted using an evaluation device A.

COMPARATIVE EXAMPLE 4

A black toner was prepared and evaluated in the same manner as that of Example 1, except that the particle diameter, the particle diameter distribution, the content of fine powder and the content of course powder were adjusted as shown in Table 1-1 by classifying procedures. The toner properties are shown in Tables 1-1 and 1-2, and evaluation results are shown in Table 2. The evaluation was conducted using an evaluation device A.

TABLE 1-1

| | | Particle Diameter | | | | | Circularity | | |
|---|---|---|---|---|---|---|---|---|---|
| | | Volume Average Particle Diameter (Dv, μm) | Number Average Particle Diameter (Dn, μm) | Content of Fine Particles (≦4 μm) | Content of Coarse Particles (12.7 μm≦) | Dv/Dn | Average Circularity | SF-1 | SF-2 |
| Ex. 1 | BT | 5.5 | 4.3 | 11 | 0.2 | 1.28 | 0.93 | 150 | 143 |
| | YT | 5.6 | 4.1 | 15 | 2.1 | 1.37 | 0.94 | 164 | 160 |
| | MT | 5.7 | 4.2 | 8 | 0.4 | 1.36 | 0.91 | 171 | 162 |
| | CT | 5.4 | 4.0 | 4 | 1.2 | 1.35 | 0.92 | 163 | 149 |
| Ex. 2 | BT | 7.8 | 6.5 | 22 | 3.5 | 1.20 | 0.93 | 171 | 143 |
| Ex. 3 | BT | 5.6 | 4.0 | 17 | 0.0 | 1.40 | 0.94 | 170 | 152 |
| Ex. 4 | BT | 5.3 | 4.5 | 19 | 1.5 | 1.18 | 0.94 | 168 | 153 |
| Ex. 5 | BT | 5.5 | 4.2 | 4 | 0.1 | 1.31 | 0.96 | 159 | 157 |
| Ex. 6 | BT | 5.5 | 4.3 | 11 | 0.2 | 1.28 | 0.93 | 150 | 143 |

TABLE 1-1-continued

| | | Particle Diameter | | | | | Circurality | | |
|---|---|---|---|---|---|---|---|---|---|
| | | Volume Average Particle Diameter (Dv, μm) | Number Average Particle Diameter (Dn, μm) | Content of Fine Particles (≦4 μm) | Content of Coarse Particles (12.7 μm≦) | Dv/Dn | Average Circurality | SF-1 | SF-2 |
| Ex. 7 | BT | 5.5 | 4.3 | 11 | 0.2 | 1.28 | 0.93 | 150 | 143 |
| Ex. 8 | BT | 5.5 | 4.3 | 11 | 0.2 | 1.28 | 0.93 | 150 | 143 |
| Ex. 9 | CT | 4.7 | 4.5 | 2 | 0.0 | 1.04 | 0.98 | 120 | 115 |
| Co. Ex. 1 | BT | 5.5 | 4.0 | 19 | 2.8 | 1.38 | 0.93 | 151 | 147 |
| Co. Ex. 2 | BT | 11.1 | 8.0 | 11 | 0.2 | 1.39 | 0.93 | 150 | 143 |
| Co. Ex. 3 | BT | 5.5 | 3.8 | 24 | 3.5 | 1.45 | 0.93 | 150 | 143 |
| Co. Ex. 4 | BT | 1.8 | 1.0 | 70 | 0.0 | 1.80 | 0.91 | 170 | 164 |

BT: black toner, YT: yellow toner, MT: magenta toner, CT: cyan toner

TABLE 1-2

| | Agglomeration Degree (%) | Loose Apparent Density (g/ml) | Volume Resistivity (Log Ω · cm) | Softening Point (° C.) | Glass Transition Temperature (° C.) |
|---|---|---|---|---|---|
| Ex. 1 | 11 | 0.35 | 11.1 | 106 | 53 |
| | 12 | 0.34 | 10.8 | 105 | 52 |
| | 10 | 0.32 | 10.7 | 106 | 52 |
| | 9 | 0.35 | 10.6 | 107 | 54 |
| Ex. 2 | 24 | 0.33 | 10.5 | 104 | 55 |
| Ex. 3 | 10 | 0.34 | 10.4 | 106 | 56 |
| Ex. 4 | 12 | 0.41 | 10.7 | 91 | 48 |
| Ex. 5 | 14 | 0.36 | 10.6 | 105 | 59 |
| Ex. 6 | 22 | 0.45 | 11.1 | 106 | 53 |
| Ex. 7 | 24 | 0.29 | 11.2 | 106 | 53 |
| Ex. 8 | 6 | 0.38 | 11.1 | 106 | 53 |
| Ex. 9 | 8 | 0.38 | 10.4 | 85 | 45 |
| Com. Ex. 1 | 21 | 0.31 | 10.1 | 84 | 41 |
| Com. Ex. 2 | 11 | 0.35 | 11.1 | 106 | 53 |
| Com. Ex. 3 | 11 | 0.35 | 11.1 | 106 | 53 |
| Com. Ex. 4 | 35 | 0.21 | 10.7 | 105 | 53 |

TABLE 2

| | | | | | | Fixability | |
|---|---|---|---|---|---|---|---|
| | | Carrier Loss | Fog | Toner Scattering | Blocking Resistance | Lower Limit (° C.) | Upper Limit (° C.) |
| Ex. 1 | BT | B | B | A | B | 130 | 200 |
| | YT | B | B | B | B | 130 | 200 |
| | MT | B | B | B | B | 130 | 200 |
| | CT | B | A | B | B | 130 | 200 |
| Ex. 2 | BT | C | A | A | A | 140 | 200 |
| Ex. 3 | BT | B | C | C | B | 130 | 200 |
| Ex. 4 | BT | A | A | A | C | 125 | 190 |
| Ex. 5 | BT | B | B | B | B | 145 | 210 |
| Ex. 6 | BT | A | B | C | C | 130 | 200 |
| Ex. 7 | BT | B | B | B | A | 130 | 200 |
| Ex. 8 | BT | B | A | B | A | 130 | 200 |
| Ex. 9 | CT | A | B | B | B | 120 | 200 |
| Ex. 10 | BT | B | B | C | B | 130 | 200 |
| Ex. 11 | BT | B | C | C | B | 130 | 200 |
| Ex. 12 | BT | B | C | C | B | 130 | 200 |
| Com. Ex. 1 | BT | D | D | D | D | 150 | 160 |
| Com. Ex. 2 | BT | C | C | D | C | 145 | 180 |
| Com. Ex. 3 | BT | C | D | D | C | 130 | 180 |
| Com. Ex. 4 | BT | D | D | D | D | 130 | 160 |

BT: black toner, YT: yellow toner, MT: magenta toner, CT: cyan toner

[II] EXAMPLES 13 TO 72 AND COMPARATIVE EXAMPLES 5 TO 24

Synthesis of Toner Binder A

Synthesis of Linear Polyester Resin

Four hundred and thirty parts of an adduct of bisphenol A with 2 moles of PO, 300 parts of an adduct of bisphenol Awith 3 moles of PO, 257 parts of terephthahc acid, 65 parts of isophthalic acid, 10 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg, and taken out when the acid value came to 5 mgKOH/g. After cooling to room temperature, the reaction product was milled, consequently, a linear polyester resin AX1-1 was obtained.

The resulting AX1-1 contained no THF-insoluble matter, and had an acid value of 7 mgKOH/g, a hydroxyl value of 12 mgKOH/g, a glass transition temperature Tg of 60° C., a number average molecular mass Mn of 6940, and a peak top molecular mass Mp of 19100. The rate of the molecular mass of no more than 1500 was 1.2%.

Synthesis of Non-Linear Polyester Resin

Three hundred and fifty parts of an adduct of bisphenol A with 2 moles of EO, 326 parts of an adduct of bisphenol A with 3 moles of PO, 278 parts of terephthalic acid, 40 parts of phthalic anhydride and 2 parts of titanium dihydroxy bis( triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, 62 parts of trimellitic anhydride was added, then the mixture was allowed to react under normal pressure of sealed atmosphere for 2 hours. After cooling to room temperature, the reaction product was milled, consequently, a non-linear polyester resin AX2-1 was obtained.

The resulting AX2-1 contained no THF-insoluble matter, and had an acid value of 35 mgKOH/g, a hydroxyl value of 17 mgKOH/g, a glass transition temperature Tg of 69° C., a number average molecular mass Mn of 3920, and a peak top molecular mass Mp of 11200. The rate of the molecular mass of no more than 1500 was 0.9%.

Synthesis of Toner Binder A

Four hundred parts of the polyester AX1-1 and 600 parts of the AX2-1 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder A.

Synthesis of Toner Binder B

Synthesis of Linear Polyester Resin

A linear polyester resin AX1-2 was prepared by a similar reaction as that of AX1-1 of toner binder A, followed by cooling to room temperature and milling except that the polycondensation catalyst was changed into titanyl bis(triethanolaminate).

The resulting AX1-2 contained no THF-insoluble matter, and had an acid value of 8 mgKOH/g, a hydroxyl value of 10 mgKOH/g, a glass transition temperature Tg of 60° C., a number average molecular mass Mn of 6820, and a peak top molecular mass Mp of 20180. The rate of the molecular mass of no more than 1500 was 1.1%.

Synthesis of Non-Linear Polyester Resin

A non-linear polyester resin AX2-2 was prepared by a similar reaction as that of AX2-1 of toner binder A, followed by cooling to room temperature and milling except that the polycondensation catalyst was changed into titanyl bis(triethanolaminate).

The resulting AX2-2 contained no THF-insoluble matter, and had an acid value of 33 mgKOH/g, a hydroxyl value of 14 mgKOH/g, a glass transition temperature Tg of 70° C., a number average molecular mass Mn of 4200, and a peak top molecular mass Mp of 11800. The rate of the molecular mass of no more than 1500 was 0.8%.

Synthesis of Toner Binder B

The inventive toner binder B was prepared by powder-mixing 500 parts of the polyester AX1-2 and 500 parts of the polyester AX2-2 for 5 minutes using a Henschel mixer.

Synthesis of Toner Binder C

Synthesis of Comparative Linear Polyester Resin

The reaction was carried out in the same manner as that of AX1-1 in synthesis of toner binder A, except that the polycondensation catalyst was changed into titanium tetraisopropoxide. There arose such a problem that the reaction was stopped on the way due to catalysis deactivation and the distillation of generated water was also stopped, thus 2 parts of titanium tetraisopropoxide was added four times during the reaction thereby to obtain a comparative linear polyester resin CAX1-1.

The resulting CAX1-1 contained no THF-insoluble matter, and had an acid value of 7 mgKOH/g, a hydroxyl value of 12 mgKOH/g, a glass transition temperature Tg of 58° C., a number average molecular mass Mn of 6220, and a peak top molecular mass Mp of 18900. The rate of the molecular mass of no more than 1500 was 2.2%.

Synthesis of Comparative Non-Linear Polyester Resin

The reaction was carried out in the same manner as that of AX2-1 in synthesis of toner binder A, except that the polycondensation catalyst was changed into titanium tetraisopropoxide. The reaction was carried out under normal pressure for 16 hours and under a reduced pressure for 8 hours. The reaction velocity was slow, thus 2 parts of titanium tetraisopropoxide was added three times during the reaction thereby to obtain a comparative non-linear polyester resin CAX2-1.

The resulting CAX2-1 contained no THF-insoluble matter, and had an acid value of 34 mgKOH/g, a hydroxyl value of 16 mgKOH/g, a glass transition temperature Tg of 68° C., a number average molecular mass Mn of 3420, and a peak top molecular mass Mp of 12100. The rate of the molecular mass of no more than 1500 was 2.1%.

Synthesis of Toner Binder C

Four hundred parts of the polyester CAX1-1 and 600 parts of the CAX2-1 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder C. The toner binder C was a resin of intense purplish brown.

EXAMPLE 13

One hundred parts of the inventive toner binder A, 5 parts of Carnauba wax (Carnauba wax C1, melting point: 84° C., by S. Kato & Co.), 4 parts of a yellow pigment (toner yellow HG VP2155, by Clariant Co.) and 3 parts of zinc salicylate (Bontron E-84, by Orient Chemical Co.) were preliminarily mixed using a Henschel mixer (FM10B, by Mitsui Mining Co.) and then kneaded using a two-axis kneader (PCM-30, by Ikegai Ltd.).

The mixture was finely milled using a super sonic jet mill (lab jet, by Japan Pneumatic Mfg. Co.) and then classified using an air classifier (MDS-I, by Japan Pneumatic Mfg. Co.)

to prepare toner particles having a particle diameter D50 of 8 μm. Then 0.5 part of colloidal silica (Aerosil R972, by Nippon Aerosil Co.) was mixed with 100 parts of the toner particles using a sample mill thereby to prepare a toner T13.

EXAMPLE 14

A toner T14 was prepared in the same manner as Example 13, except that the zinc salicylate (Bontron E-84, by Orient Chemical Co.) was changed into a quaternary ammonium salt (Bontron P-51, by Orient Chemical Co.) and the colloidal silica (Aerosil R972, by Nippon Aerosil Co.) was changed into H30TA (by Wacker Chemical Co.).

EXAMPLE 15

A toner T15 was prepared in the same manner as Example 13, except that the zinc salicylate (Bontron E-84, by Orient Chemical Co.) was changed into bis[1-(5-chloro-2-hydroxyphenylazo-2-naphtolato)chrome (III) acid.

EXAMPLE 16

A toner T16 was prepared in the same manner as Example 13, except that the zinc salicylate (Bontron E-84, by Orient Chemical Co.) was changed into nigrosine (Nigrosine Base EX, by Orient Chemical Co.) and the colloidal silica (Aerosil R972, by Nippon Aerosil Co.) was changed into H30TA (by Wacker Chemical Co.).

EXAMPLE 17

A toner T17 was prepared in the same manner as Example 13, except that the zinc salicylate (Bontron E-84, by Orient Chemical Co.) was changed into a fluomme compound (Copy Charge NX VP 434, by Clariant Japan K.K.).

EXAMPLE 18

A toner T18 was prepared in the same manner as Example 13, except that the zinc salicylate (Bontron E-84, by Orient Chemical Co.) was changed into perfluoroalkyltrimethyl ammonium iodide (FT-310, by Neos Company Ltd.).

EXAMPLE 19

A toner T19 was prepared in the same manner as Example 13, except that the zinc salicylate (Bontron E-84, by Orient Chemical Co.) was changed into a quaternary ammonium salt-containing styrene/acrylic copolymer (FCA-77PR, by Fujikurakasei Co.) and the colloidal silica (Aerosil R972, by Nippon Aerosil Co.) was changed into H30TA (by Wacker Chemical Co.).

EXAMPLE 20

A toner T20 was prepared in the same manner as Example 13, except that the zinc salicylate (Bontron E-84, by Orient Chemical Co.) was changed into a Cr azo dye (CCA-7, by AstraZeneca Co.).

EXAMPLE 21

A toner T21 was prepared in the same manner as Example 13, except that the zinc salicylate (Bontron E-84, by Orient Chemical Co.) was changed into a Fe azo dye (T-77, by Hodogaya Chemical Co.).

EXAMPLE 22

A toner T22 was prepared in the same manner as Example 13, except that the zinc salicylate (Bontron E-84, by Orient Chemical Co.) was changed into polyhydroxyalkanoate.

The method for producing the polyhydroxyalkanoate will be shown below.

Method for Producing Polyhydroxyalkanoate

A colony of agar plate was plated on 200 mL of a medium containing 0.5% polypeptone and 0.1% phenylsulfanylvaleric acid, and cultured in a shaking flask of 500 mL at 30° C. for 30 hours. After the incubation, the fungus was harvested and rinsed with methanol, followed by freeze-drying. The dried fungus was sampled, to which acetone was added, the mixture was stirred for 72 hours to extract polymer. The acetone, containing the extracted polymer, was filtered and condensed by an evaporator, then collecting substances deposited-solidified by cold methanol, followed by vacuum-drying to obtain intended polymer. The mass of the dried fungus was 215 mg, and the mass of the resulting polymer was 76 mg.

EXAMPLE 23

A toner T23 was prepared in the same manner as Example 13, except that the toner binder A was changed into the toner binder B.

EXAMPLE 24

A toner T24 was prepared in the same manner as Example 14, except that the toner binder A was changed into the toner binder B.

EXAMPLE 25

A toner T25 was prepared in the same manner as Example 15, except that the toner binder A was changed into the toner binder B.

EXAMPLE 26

A toner T26 was prepared in the same manner as Example 16, except that the toner binder A was changed into the toner binder B.

EXAMPLE 27

A toner T27 was prepared in the same manner as Example 17, except that the toner binder A was changed into the toner binder B.

EXAMPLE 28

A toner T28 was prepared in the same manner as Example 18, except that the toner binder A was changed into the toner binder B.

EXAMPLE 29

A toner T29 was prepared in the same manner as Example 19, except that the toner binder A was changed into the toner binder B.

EXAMPLE 30

A toner T30 was prepared in the same manner as Example 20, except that the toner binder A was changed into the toner binder B.

EXAMPLE 31

A toner T31 was prepared in the same manner as Example 21, except that the toner binder A was changed into the toner binder B.

EXAMPLE 32

A toner T32 was prepared in the same manner as Example 22, except that the toner binder A was changed into the toner binder B.

EXAMPLE 33

A toner T33 was prepared in the same manner as Example 13, except that 3 parts of zinc salicylate (Bontron E-84, by Orient Chemical Co.) was changed into 3 parts of zinc sahcylate (Bontron E-84, by Orient Chemical Co.) and 2 parts of bis[1-(5-chloro-2-hydroxyphenylazo-2-naphtolato)chrome (III) acid.

EXAMPLE 34

A toner T34 was prepared in the same manner as Example 14, except that 3 parts of quaternary ammonium salt (Bontron P-51, by Orient Chemical Co.) was changed into 3 parts of quaternary ammonium salt (Bontron P-51, by Orient Chemical Co.) and 2 parts of nigrosine (Nigrosine Base EX, by Orient Chemical Co.).

EXAMPLE 35

A toner T35 was prepared in the same manner as Example 15, except that 3 parts of bis[1-(5-chloro-2-hydroxyphenylazo-2-naphtolato)chrome (III) acid was changed into 3 parts of bis[1-(5-chloro-2-hydroxyphenylazo-2-naphtolato) chrome (III) acid and 2 parts of zinc salicylate (Bontron E-84, by Orient Chemical Co.).

EXAMPLE 36

A toner T36 was prepared in the same manner as Example 16, except that 3 parts of nigrosine (Nigrosine Base EX, by Orient Chemical Co.) was changed into 3 parts of nigrosine (Nigrosine Base EX, by Orient Chemical Co.) and 2 parts of quaternary ammonium salt (Bontron P-51, by Orient Chemical Co.).

EXAMPLE 37

A toner T37 was prepared in the same manner as Example 17, except that 3 parts of fluorine compound (Copy Charge NX VP 434, by Clariant Japan K.K.) was changed into 3 parts of the fluorine compound (Copy Charge NX VP 434, by Clariant Japan K.K.) and 2 parts of zinc salicylate (Bontron E-84, by Orient Chemical Co.).

EXAMPLE 38

A toner T38 was prepared in the same manner as Example 18, except that 3 parts of perfluoroalkyltrimethyl ammonium iodide (FT-310, by Neos Company Ltd.) was changed into 3 parts of perfluoroalkyltrimethyl ammonium iodide (FT-310, by Neos Company Ltd.) and 2 parts of zinc salicylate (Bontron E-84, by Orient Chemical Co.).

EXAMPLE 39

A toner T39 was prepared in the same manner as Example 19, except that 3 parts of quaternary ammonium salt-containing styrene/acrylic copolymer (FCA-77PR, by Fujikurakasei Co.) was changed into 3 parts of quaternary ammonium salt-containing styrene/acrylic copolymer (FCA-77PR, by Fujikurakasei Co.) and 2 parts of quaternary ammonium salt (Bontron P-51, by Orient Chemical Co.).

EXAMPLE 40

A toner T40 was prepared in the same manner as Example 20, except that 3 parts of Cr azo dye (CCA-7, by AstraZeneca Co.) was changed into 3 parts of Cr azo dye (CCA-7, by AstraZeneca Co.) and 2 parts of zinc salicylate (Bontron E-84, by Orient Chemical Co.).

EXAMPLE 41

A toner T41 was prepared in the same manner as Example 21, except that 3 parts of Fe azo dye (T-77, by Hodogaya Chemical Co.) was changed into 3 parts of Fe azo dye (T-77, by Hodogaya Chemical Co.) and 2 parts of zinc salicylate (Bontron E-84, by Orient Chemical Co.).

EXAMPLE 42

A toner T42 was prepared in the same manner as Example 22, except that 3 parts of polyhydroxyalkanoate was changed into 3 parts of polyhydroxyalkanoate and 2 parts of zinc salicylate (Bontron E-84, by Orient Chemical Co.).

COMPARATIVE EXAMPLE 5

A toner T5' was prepared in the same manner as Example 13, except the toner binder A was changed into the toner binder C.

COMPARATIVE EXAMPLE 6

A toner T6' was prepared in the same manner as Example 14, except the toner binder A was changed into the toner binder C.

COMPARATIVE EXAMPLE 7

A toner T7' was prepared in the same manner as Example 15, except the toner binder A was changed into the toner binder C.

COMPARATIVE EXAMPLE 8

A toner T8' was prepared in the same manner as Example 16, except the toner binder A was changed into the toner binder C.

COMPARATIVE EXAMPLE 9

A toner T9' was prepared in the same manner as Example 17, except the toner binder A was changed into the toner binder C.

COMPARATIVE EXAMPLE 10

A toner T10' was prepared in the same manner as Example 18, except the toner binder A was changed into the toner binder C.

COMPARATIVE EXAMPLE 11

A toner T11' was prepared in the same manner as Example 19, except the toner binder A was changed into the toner binder C.

COMPARATIVE EXAMPLE 12

A toner T12' was prepared in the same manner as Example 20, except the toner binder A was changed into the toner binder C.

COMPARATIVE EXAMPLE 13

A toner T13' was prepared in the same manner as Example 21, except the toner binder A was changed into the toner binder C.

COMPARATIVE EXAMPLE 14

A toner T14' was prepared in the same manner as Example 22, except the toner binder A was changed into the toner binder C.

Synthesis of Toner Binder D

Five hundred and forty-nine parts of an adduct of bisphenol A with 2 moles of propylene oxide, 20 parts of an adduct of bisphenol A with 3 moles of propylene oxide, 133 parts of an adduct of bisphenol A with 2 moles of ethylene oxide, 10 parts of an adduct of phenol novolac (average polymerization degree: about 5) with 5 moles of ethylene oxide, 252 parts of terephthalic acid, 19 parts of isophthalic acid, 10 parts of trimellitic anhydride, and 2 parts of titanium dihydroxy bis (diethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg till the acid value came to 2 mgKOH/g or less. Then 50 parts of trimellitic anhydride was added to the reactant, which was allowed to react for 1 hour under normal pressure and then under a reduced pressure of 5 to 20 mmHg, 20 parts of bisphenol A diglycidyl ether was added when the softening temperature came to 105° C., then the reactant was taken out when the softening temperature came to 150° C. After cooling to room temperature, the reaction product was milled, consequently, a modified polyester resin AY1-1 was obtained.

The resulting AY1-1 had an acid value of 52 mgKOH/g, a hydroxyl value of 16 mgKOH/g, a glass transition temperature Tg of 73° C., a number average molecular mass Mn of 1860, a peak top molecular mass Mp of 6550, and a THF-insoluble content of 32%. The rate of the molecular mass of no more than 1500 was 2.1%. This resin was used as a toner binder D.

Synthesis of Toner Binder E

Synthesis of Modified Polyester Resin

A comparative modified polyester resin CAY1-2 was prepared in the same manner as Example 15, except that the polycondensation catalyst was changed into titanium tetrabutoxide.

The resulting CAY1-2 had a softening temperature of 150° C., an acid value of 53 mgKOH/g, a hydroxyl value of 17 mgKOH/g, a glass transition temperature Tg of 71° C., a number average molecular mass Mn of 1660, a peak top molecular mass Mp of 6340, and a THF-insoluble content of 34%. The rate of the molecular mass of no more than 1500 was 3.1%. This resin was used as a toner binder E.

Synthesis of Toner Binder F

Synthesis of Non-Linear Polyester Resin

One hundred and thirty-two parts of an adduct of bisphenol A with 2 moles of propylene oxide, 371 parts of an adduct of bisphenol A with 3 moles of propylene oxide, 20 parts of an adduct of bisphenol A with 2 moles of ethylene oxide, 125 parts of an adduct of phenol novolac (average polymerization degree: about 5) with 5 moles of propylene oxide, 201 parts of terephthalic acid, 25 parts of maleic anhydride, 35 parts of dimethyl terephthalate and 2 parts of titanyl bis(triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, 65 parts of trimellitic anhydride was added, then the mixture was allowed to react under normal pressure of sealed atmosphere for 2 hours. After cooling to room temperature, the reaction product was milled, consequently, a non-linear polyester resin AX2-3 was obtained.

The resulting non-linear polyester resin AX2-3 had a softening temperature of 144° C., an acid value of 30 mgKOH/g, a hydroxyl value of 16 mgKOH/g, a glass transition temperature Tg of 59° C., a number average molecular mass Mn of 1410, a peak top molecular mass Mp of 4110, and a THF-insoluble content of 27%. The rate of the molecular mass of no more than 1500 was 1.0%. This resin was used as a toner binder F.

Synthesis of Toner Binder G

Synthesis of Non-Linear Polyester Resin

Four hundred ten parts of an adduct of bisphenol A with 2 moles of propylene oxide, 270 parts of an adduct of bisphenol A with 3 moles of propylene oxide, 110 parts of terephthalic acid, 125 parts of isophthalic acid, 15 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, 25 parts of trimellitic anhydride was added, then the mixture was allowed to react under normal pressure of sealed atmosphere for 2 hours. After cooling to room temperature, the reaction product was milled, consequently, a non-linear polyester resin AX2-4 was obtained.

The resulting AX2-4 contained no THF-insoluble matter, and had an acid value of 18 mgKOH/g, a hydroxyl value of 37 mgKOH/g, a glass transition temperature Tg of 62° C., a number average molecular mass Mn of 2130, and a peak top molecular mass Mp of 5350. The rate of the molecular mass of no more than 1500 was 1.3%.

Synthesis of Modified Polyester Resin

Three hundred and seventeen parts of an adduct of bisphenol A with 2 moles of ethylene oxide, 57 parts of an adduct of bisphenol A with 2 moles of propylene oxide, 298 parts of an adduct of bisphenol A with 3 moles of propylene oxide, 75 parts of an adduct of phenol novolac (average polymerization degree: about 5) with 5 moles of propylene oxide, 30 parts of isophthalic acid, 157 parts of terephthalic acid, 27 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, then 68 parts of trimellitic anhydride was added to the reactant, which was allowed to react for 1 hour under normal pressure followed by under a reduced pressure of 20 to 40 mmHg, then 25 parts of bisphenol A diglycidyl ether was added when the softening temperature came to 120° C., the reactant was taken out when the softening temperature came to 155° C. After cooling to room temperature, the reaction product was milled, consequently, a modified polyester resin AY1-2 was obtained.

The resulting AY1-2 had an acid value of 11 mgKOH/g, a hydroxyl value of 27 mgKOH/g, a glass transition temperature Tg of 60° C., a number average molecular mass Mn of 3020, a peak top molecular mass Mp of 6030, and a THF-insoluble content of 35%. The rate of the molecular mass of no more than 1500 was 1.1%.

Synthesis of Toner Binder G

Five hundred parts of the polyester AX2-3 and 500 parts of the AY1-2 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder G.

EXAMPLE 43

A toner T43 was prepared in the same manner as Example 13, except the toner binder A was changed into the toner binder D.

EXAMPLE 44

A toner T44 was prepared in the same manner as Example 14, except the toner binder A was changed into the toner binder D.

EXAMPLE 45

A toner T45 was prepared in the same manner as Example 15, except the toner binder A was changed into the toner binder D.

EXAMPLE 46

A toner T46 was prepared in the same manner as Example 16, except the toner binder A was changed into the toner binder D.

EXAMPLE 47

A toner T47 was prepared in the same manner as Example 17, except the toner binder A was changed into the toner binder D.

EXAMPLE 48

A toner T48 was prepared in the same manner as Example 18, except the toner binder A was changed into the toner binder D.

EXAMPLE 49

A toner T49 was prepared in the same manner as Example 19, except the toner binder A was changed into the toner binder D.

EXAMPLE 50

A toner T50 was prepared in the same manner as Example 20, except the toner binder A was changed into the toner binder D.

EXAMPLE 51

A toner T51 was prepared in the same manner as Example 21, except the toner binder A was changed into the toner binder D.

EXAMPLE 52

A toner T52 was prepared in the same manner as Example 22, except the toner binder A was changed into the toner binder D.

EXAMPLE 53

A toner T53 was prepared in the same manner as Example 13, except the toner binder A was changed into the toner binder F

EXAMPLE 54

A toner T54 was prepared in the same manner as Example 14, except the toner binder A was changed into the toner binder F

EXAMPLE 55

A toner T55 was prepared in the same manner as Example 15, except the toner binder A was changed into the toner binder F.

EXAMPLE 56

A toner T56 was prepared in the same manner as Example 16, except the toner binder A was changed into the toner binder F.

EXAMPLE 57

A toner T57 was prepared in the same manner as Example 17, except the toner binder A was changed into the toner binder F.

EXAMPLE 58

A toner T58 was prepared in the same manner as Example 18, except the toner binder A was changed into the toner binder F.

EXAMPLE 59

A toner T59 was prepared in the same manner as Example 19, except the toner binder A was changed into the toner binder F.

EXAMPLE 60

A toner T60 was prepared in the same manner as Example 20, except the toner binder A was changed into the toner binder F.

EXAMPLE 61

A toner T61 was prepared in the same manner as Example 21, except the toner binder A was changed into the toner binder F.

EXAMPLE 62

A toner T62 was prepared in the same manner as Example 22, except the toner binder A was changed into the toner binder F

EXAMPLE 63

A toner T63 was prepared in the same manner as Example 13, except the toner binder A was changed into the toner binder G.

EXAMPLE 64

A toner T64 was prepared in the same manner as Example 14, except the toner binder A was changed into the toner binder G.

EXAMPLE 65

A toner T65 was prepared in the same manner as Example 15, except the toner binder A was changed into the toner binder G.

EXAMPLE 66

A toner T66 was prepared in the same manner as Example 16, except the toner binder A was changed into the toner binder G.

EXAMPLE 67

A toner T67 was prepared in the same manner as Example 17, except the toner binder A was changed into the toner binder G.

EXAMPLE 68

A toner T68 was prepared in the same manner as Example 18, except the toner binder A was changed into the toner binder G.

EXAMPLE 69

A toner T69 was prepared in the same manner as Example 19, except the toner binder A was changed into the toner binder G.

EXAMPLE 70

A toner T70 was prepared in the same manner as Example 20, except the toner binder A was changed into the toner binder G.

EXAMPLE 71

A toner T71 was prepared in the same manner as Example 21, except the toner binder A was changed into the toner binder G.

EXAMPLE 72

A toner T72 was prepared in the same manner as Example 22, except the toner binder A was changed into the toner binder G.

COMPARATIVE EXAMPLE 15

A toner T15' was prepared in the same manner as Example 13, except the toner binder A was changed into the toner binder E.

COMPARATIVE EXAMPLE 16

A toner T16' was prepared in the same manner as Example 14, except the toner binder A was changed into the toner binder E.

COMPARATIVE EXAMPLE 17

A toner T17' was prepared in the same manner as Example 15, except the toner binder A was changed into the toner binder E.

COMPARATIVE EXAMPLE 18

A toner T18' was prepared in the same manner as Example 16, except the toner binder A was changed into the toner binder E.

COMPARATIVE EXAMPLE 19

A toner T19' was prepared in the same manner as Example 17, except the toner binder A was changed into the toner binder E.

COMPARATIVE EXAMPLE 20

A toner T20' was prepared in the same manner as Example 18, except the toner binder A was changed into the toner binder E.

COMPARATIVE EXAMPLE 21

A toner T21' was prepared in the same manner as Example 19, except the toner binder A was changed into the toner binder E.

COMPARATIVE EXAMPLE 22

A toner T22' was prepared in the same manner as Example 20, except the toner binder A was changed into the toner binder E.

COMPARATIVE EXAMPLE 23

A toner T23' was prepared in the same manner as Example 21, except the toner binder A was changed into the toner binder E.

COMPARATIVE EXAMPLE 24

A toner T24' was prepared in the same manner as Example 22, except the toner binder A was changed into the toner binder E.

Evaluation Process (Positively Charged Toner)

Evaluation Item (1) Low Temperature Fixability (Peeling Property with Tape)

A developer was prepared by mixing for 5 minutes 4 parts by mass of a toner and 96 parts by mass of a silicone-coated ferrite carrier (average particle diameter 100 μm, by Kanto Denka Kogyo Co.) using a turbuler mixer. The developer was input into a copier (Imagio 105, by Ricoh Co.) that had been modified so as to fix at outside the apparatus, and unfixed images of 2 cm by 12 cm were formed in a toner amount of 0.5 $mg/cm^2$. Then the unfixed images were fixed at a linear velocity of 1500 mm/sec while raising the temperature of the fixing roll from 100° C. to 250° C. stepwise with an increment of 5° C. per step. The fixing paper was RICOPY PPC paper Type 6000 (by Ricoh Co.).

A scotch tape (by Sumitomo 3M Ltd.) was glued on images formed at respective fixing temperatures and allowed to stand for 3 hours, then the tape was peeled away and disposed on a white paper. The density of unfixed images on the tape was measured by X-Rite 938 (by X-Rite Co.); the difference of the density from that of blank being no less than 0.150 was evaluated as "unfixed", the temperature at which the difference firstly came to less than 0.150 was defined as the lowest fixing temperature. The low temperature fixability was evaluated based on the lowest fixing temperature in accordance the following criteria.

Evaluation Criteria

A: lowest fixing temperature<140° C.

B: 140° C.≦lowest fixing temperature<150° C.

C: 150° C.≦lowest fixing temperature (2) Evaluation of Background Smear

Using the toners of Examples and Comparative Examples similarly as above (1), a solid image was developed on 10000 sheets of paper under high temperature and high humidity condition by use of a copier. Then a scotch tape (by Sumitomo 3M Ltd.) was glued on the background portion of the photoconductor, followed by being peeled away and disposed on a white paper. The density of background smear on the tape was measured by X-Rite 938 (by X-Rite Co.); the difference of the density from that of blank being no less than 0.050 was evaluated as occurrence of background smear, the difference of less than 0.010 and no less than 0.005 was evaluated as appropriate resistance for background smear, and the difference of less than 0.005 was evaluated as very appropriate resistance for background smear.

Evaluation Criteria

A: very appropriate resistance for background smear

B: appropriate resistance for background smear

C: occurrence of background smear

Evaluation Process (Negatively Charged Toner)

Evaluation Item (1) Low Temperature Fixability (Peeling Property with Tape)

A developer was prepared by mixing for 5 minutes 4 parts by mass of a toner and 96 parts by mass of a ferrite carrier (F-150, Powder Tec Co.) using a turbuler mixer. The developer was input into a copier (Imagio Neo C385, by Ricoh Co.) that had been modified so as to fix at outside the apparatus, and unfixed images of 2 cm by 12 cm were formed in a toner amount of 0.5 mg/cm$^2$. Then the unfixed images were fixed at a linear velocity of 1500 mm/sec while raising the temperature of the fixing roll from 100° C. to 250° C. stepwise with an increment of 5° C. per step. The fixing paper was RICOPY PPC paper Type 6000 (by Ricoh Co.).

A scotch tape (by Sumitomo 3M Ltd.) was glued on images of respective fixing temperatures and allowed to stand for 3 hours, then the tape was peeled away and disposed on a white paper. The density of unfixed images on the tape was measured by X-Rite 938 (by X-Rite Co.); the difference of the density from that of blank being no less than 0.150 was evaluated as "unfixed", the temperature at which the difference firstly came to less than 0.150 was defined as the lowest fixing temperature. The low temperature fixability was evaluated based on the lowest fixing temperature in accordance the following criteria.

Evaluation Criteria

A: lowest fixing temperature<140° C.

B: 140° C.≦lowest fixing temperature<150° C.

C: 150° C.≦lowest fixing temperature (2) Evaluation of Background Smear

Using the toners of Examples and Comparative Examples similarly as above (1), a solid image was developed on 10000 sheets of paper under high temperature and high humidity condition by use of a copier. Then a scotch tape (by Sumitomo 3M Ltd.) was glued on the background portion of the photoconductor, followed by being peeled away and disposed on a white paper. The density of background smear on the tape was measured by X-Rite 938 (by X-Rite Co.); the difference of the density from that of blank being no less than 0.050 was evaluated as occurrence of background smear, the difference of less than 0.010 and no less than 0.005 was evaluated as appropriate resistance for background smear, and the difference of less than 0.005 was evaluated as very appropriate resistance for background smear.

Evaluation Criteria

A: very appropriate resistance for background smear

B: appropriate resistance for background smear

C: occurrence of background smear

TABLE 3

| | LTF | BSR |
|---|---|---|
| Ex. 13 | B | B |
| Ex. 14 | B | B |
| Ex. 15 | A | B |
| Ex. 16 | B | B |
| Ex. 17 | A | B |
| Ex. 18 | B | B |
| Ex. 19 | B | B |
| Ex. 20 | B | B |
| Ex. 21 | A | B |
| Ex. 22 | B | A |
| Ex. 23 | B | B |
| Ex. 24 | B | B |
| Ex. 25 | A | A |
| Ex. 26 | B | B |
| Ex. 27 | B | B |
| Ex. 28 | B | B |
| Ex. 29 | A | B |
| Ex. 30 | B | B |
| Ex. 31 | B | B |
| Ex. 32 | A | A |
| Ex. 33 | B | B |
| Ex. 34 | A | B |
| Ex. 35 | B | B |
| Ex. 36 | B | B |
| Ex. 37 | B | B |
| Ex. 38 | A | B |
| Ex. 39 | B | B |
| Ex. 40 | B | B |
| Ex. 41 | A | B |
| Ex. 42 | B | A |
| Ex. 43 | B | B |
| Ex. 44 | A | A |
| Ex. 45 | A | B |
| Ex. 46 | B | B |
| Ex. 47 | A | B |
| Ex. 48 | B | B |
| Ex. 49 | A | A |
| Ex. 50 | B | B |
| Ex. 51 | A | B |
| Ex. 52 | A | A |
| Ex. 53 | B | A |
| Ex. 54 | A | B |
| Ex. 55 | A | A |
| Ex. 56 | B | B |
| Ex. 57 | A | A |
| Ex. 58 | A | B |
| Ex. 59 | B | A |
| Ex. 60 | A | B |
| Ex. 61 | B | A |
| Ex. 62 | A | A |
| Ex. 63 | B | B |
| Ex. 64 | B | B |
| Ex. 65 | A | A |
| Ex. 66 | A | B |
| Ex. 67 | B | A |
| Ex. 68 | A | A |
| Ex. 69 | B | B |
| Ex. 70 | A | B |
| Ex. 71 | B | B |
| Ex. 72 | A | A |
| Co. Ex. 5 | C | C |
| Co. Ex. 6 | B | D |

TABLE 3-continued

| | LTF | BSR |
|---|---|---|
| Co. Ex. 7 | B | D |
| Co. Ex. 8 | C | C |
| Co. Ex. 9 | C | D |
| Co. Ex. 10 | D | C |
| Co. Ex. 11 | C | C |
| Co. Ex. 12 | C | D |
| Co. Ex. 13 | C | C |
| Co. Ex. 14 | B | D |
| Co. Ex. 15 | C | D |
| Co. Ex. 16 | D | C |
| Co. Ex. 17 | C | D |
| Co. Ex. 18 | C | C |
| Co. Ex. 19 | C | C |
| Co. Ex. 20 | C | D |
| Co. Ex. 21 | D | C |
| Co. Ex. 22 | C | C |
| Co. Ex. 23 | C | D |
| Co. Ex. 24 | C | C |

LTF: Low Temperature Fixability
BSR: Background Smear Resistance

The results described above demonstrate that the inventive toners may exhibit appropriate low temperature fixability and be far from background smear of toners even under high temperature and high humidity conditions.

[III] EXAMPLES 73, 74 AND COMPARATIVE EXAMPLES 25

SYNTHESIS EXAMPLE 1

Synthesis of Linear Polyester Resin

Forty hundred and thirty parts of an adduct of bisphenol A with 2 moles of PO, 300 parts of an adduct of bisphenol A with 3 moles of PO, 257 parts of terephthalic acid, 65 parts of isophthalic acid, 10 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg and taken out when the acid value came to 5. After cooling to room temperature, the reaction product was milled, consequently, a linear polyester resin AX1-1 was obtained.

Synthesis of Non-Linear Polyester Resin

Three hundred and fifty parts of an adduct of bisphenol A with 2 moles of EO, 326 parts of an adduct of bisphenol A with 3 moles of PO, 278 parts of terephthalic acid, 40 parts of phthalic anhydride and 2 parts of titanium dihydroxy bis (triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, 62 parts of trimellitic anhydride was added, then the mixture was allowed to react under normal pressure of sealed atmosphere for 2 hours. After cooling to room temperature, the reaction product was milled, consequently, a non-linear polyester resin AX2-1 was obtained.

Synthesis of Toner Binder TB1

Four hundred parts of the polyester AX1-1 and 600 parts of the AX2-1 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder TB1.

The resulting toner binder resin TB1 had a content of 3.5% in terms of the molecular mass of no more 500, a main molecular-mass peak of 7500, a glass transition temperature Tg of 62° C., a Mw/Mn ratio of 5.1, and an acid value of 2.3 mgKOH/g. The temperature was 112° C. at which the apparent viscosity being $10^3$ Pa·s. The resin had substantially no THF-insoluble matter.

SYNTHESIS EXAMPLE 2

Synthesis of Linear Polyester Resin

A linear polyester resin AX1-2 was prepared by a similar reaction as that of AX1-1 of the synthesis example 1, followed by cooling to room temperature and milling except that the polycondensation catalyst was changed into titanyl bis(triethanolaminate).

Synthesis of Non-Linear Polyester Resin

A linear polyester resin AX2-2 was prepared by a similar reaction as that of AX2-1 of the synthesis example 1, followed by cooling to room temperature and milling except that the polycondensation catalyst was changed into titanyl bis(triethanolaminate).

Synthesis of Toner Binder TB2

The inventive toner binder resin TB2 was prepared by powder-mixing 500 parts of the polyester AX1-2 and 500 parts of the polyester AX2-2 for 5 minutes using a Henschel mixer.

The resulting toner binder resin TB2 had a content of 3.0% in terms of the molecular mass of no more 500, a main molecular-mass peak of 8000, a glass transition temperature Tg of 62° C., a Mw/Mn ratio of 4.7, and an acid value of 0.5 mgKOH/g. The temperature was 116° C. at which the apparent viscosity was $10^3$ Pa·s by the flow tester. The resin had substantially no THF-insoluble matter.

SYNTHESIS EXAMPLE 3

Synthesis of Comparative Linear Polyester Resin

The reaction was carried out in the same manner as that of AX-1 of synthesis example 1, except that the polycondensation catalyst was changed into titanium tetraisopropoxide. There arose such a problem that the reaction was stopped on the way due to catalysis deactivation and the distillation of generated water was also stopped, thus 2 parts of titanium tetraisopropoxide was added four times during the reaction thereby to obtain a comparative linear polyester resin CAX1-1.

Synthesis of Comparative Non-Linear Polyester Resin

The reaction was carried out in the same manner as that of AX2-1 in synthesis example 1, except that the polycondensation catalyst was changed into titanium tetraisopropoxide. The reaction was carried out under normal pressure for 16 hours and under a reduced pressure for 8 hours. The reaction velocity was slow, thus 2 parts of titanium tetraisopropoxide was added three times during the reaction thereby to obtain a comparative non-linear polyester resin CAX2-1.

Synthesis of Comparative Toner Binder Resin CTB1

Four hundred parts of the polyester CAX1-1 and 600 parts of the polyester CAX2-1 were melted-kneaded using a continuous kneader at a jacket temperature of 150° C. and a residence time of 3 minutes. The melted resin was cooled to 30° C. over 4 minutes using a steel-belt cooler, then milled to prepare a comparative toner binder resin CTB1. The toner binder CTB1 was a resin of intense purplish brown.

The resulting toner binder resin CTB1 had a content of 5.1% in terms of the molecular mass of no more 500, a main molecular-mass peak of 9200, a glass transition temperature Tg of 71° C., a Mw/Mn ratio of 4.6, and an acid value of 10.0 mgKOH/g. The temperature was 117° C. at which the apparent viscosity was $10^3$ Pa·s by a flow tester. The resin had substantially no THF-insoluble matter, and was used as a toner binder CTB1.

SYNTHESIS EXAMPLE 4

Synthesis of Modified Polyester Resin

Five hundred and forty-nine parts of an adduct of bisphenol A with 2 moles of propylene oxide, 20 parts of an adduct of bisphenol A with 3 moles of propylene oxide, 133parts of an adduct of bisphenol A with 2 moles of ethylene oxide, 10 parts of an adduct of phenol novolac (average polymerization degree: about 5) with 5 moles of ethylene oxide, 252parts of terephthalic acid, 19 parts of isophthalic acid, 10 parts of trimellitic anhydride, and 2parts of titanium dihydroxy bis (diethanolaluminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg till the acid value came to 2 mgKOH/g or less. Then 50 parts of trimellitic anhydride was added to the reactant, which was allowed to react for 1 hour under normal pressure followed by under a reduced pressure of 20 to 40mmHg, then 25 parts of bisphenol A diglycidyl ether was added when the softening temperature came to 105° C., the reactant was taken out when the softening temperature came to 150° C. After cooling to room temperature, the reaction product was milled, consequently, a modified polyester resin AY1-1 was obtained.

The resulting AY1-1 had a content of 2.8% in terms of the molecular mass of no more 500, a main molecular-mass peak of 6900, a glass transition temperature Tg of 64° C., a Mw/Mn ratio of 5.5, and an acid value of 8.1 mgKOH/g. The temperature was 102° C. at which the apparent viscosity was $10^3$ Pa·s by a flow tester. The resin had substantially no THF-insoluble matter, and was used as a toner binder resin TB3.

SYNTHESIS EXAMPLE 5

Synthesis of Comparative Modified Polyester Resin

A comparative modified polyester resin CAY1-2 was prepared in the same manner as synthesis example 4, except that the polycondensation catalyst was changed into titanium tetrabutoxide.

The resulting CAY1-2 had a content of 6.1% in terms of the molecular mass of no more 500, a main molecular-mass peak of 10700, a glass transition temperature Tg of 74° C., a Mw/Mn ratio of 7.2, and an acid value of 10.6 mgKOH/g. The temperature was 122° C. at which the apparent viscosity was $10^3$ Pa·s by a flow tester. The resin had a THF-insoluble content of 12%, and was used as a toner binder resin CTB2.

Synthesis Example of Resin Charge Control Agent

SYNTHESIS EXAMPLE 1

Three hundred and fifty parts of 3,4-dichlorophenylmaleimide and 100 parts of 2-acrylamide-2-methylpropanesulfonic acid were copolymerized for 8 hours in dimethylformamide (DMF) at a temperature of below the boiling point using di-t-butylperoxide as an initiator. Then 500 parts of n-butylacrylate and 50 parts of styrene were added to the reactant, and the mixture was graft-polymerized for 4 hours using di-t-butylperoxide as an initiator, followed by distilling away the DMF under vacuum-drying, thereby a resin charge control agent 1 was prepared that had a volume resistivity of 10.5 Log 1-cm and a mass average molecular mass of $1\times10^4$, the temperature was 96° C. at which the apparent viscosity was $10^4$ Pa·s, and the content was 6% that corresponding to components having a mass average molecular mass of $1\times10^3$ or less.

SYNTHESIS EXAMPLE 2

Six hundred parts of m-nitrophenylmaleimide and 100 parts of perfluorooctane sulfonic acid were copolymerized for 8 hours in DMF at a temperature of below the boiling point using di-t-butylperoxide as an initiator. Then 250 parts of 2-ethylacrylate and 30 parts of styrene were added to the reactant, and the mixture was graft-polymerized for 4 hours using di-t-butylperoxide as an initiator, followed by distilling away the DMF under vacuum-drying, thereby a resin charge control agent 2 was prepared that had a volume resistivity of 9.5 Log Ω·cm and a mass average molecular mass of $5.5\times10^3$, the temperature was 85° C. at which the apparent viscosity was $10^4$ Pa·s, and the content was 8% that corresponding to components having a mass average molecular mass of $1\times10^3$ or less.

SYNTHESIS EXAMPLE 3

Five hundred parts of 3,4-dichlorophenylmaleimide and 150 parts of 2-acrylamide-2-methylpropanesulfonic acid were copolymerized for 8 hours in dimethylformamide (DMF) at a temperature of below the boiling point using di-t-butylperoxide as an initiator. Then 350 parts of n-butylacrylate and 250 parts of alpha-methylstyrene were added to the reactant, and the mixture was graft-polymerized for 4 hours using di-t-butylperoxide as an initiator, followed by distilling away the DMF under vacuum-drying, thereby a resin charge control agent 3 was prepared that had a volume resistivity of 11.5 Log Ω·cm and a mass average molecular mass of $9.6\times10^4$, the temperature was 110° C. at which the apparent viscosity was $10^4$ Pa·s, and the content was 5% that corresponding to components having a mass average molecular mass of $1\times10^3$ or less.

SYNTHESIS EXAMPLE 4

Four hundred parts of 3,4-dichlorophenylmaleimide and 200 parts of perfluorooctane sulfonic acid were copolymerized for 8 hours in DMF at a temperature of below the boiling point using di-t-butylperoxide as an initiator. Then 300 parts of n-butylacrylate was added to the reactant, and the mixture was graft-polymerized for 4 hours using di-t-butylperoxide as an initiator, followed by distilling away the DMF under vacuum-drying, thereby a resin charge control agent 4 was prepared that had a volume resistivity of 10.4 Log Ω·cm and a mass average molecular mass of $1.5\times10^4$, the temperature was 105° C. at which the apparent viscosity was $10^4$ Pa·s, and the content was 6% that corresponding to components having a mass average molecular mass of $1\times10^3$ or less.

SYNTHESIS EXAMPLE 5

Four hundred parts of 3,4-dichlorophenylmaleimide and 100 parts of 2-acrylamide-2-methylpropanesulfonic acid were copolymerized for 8 hours in DMF at a temperature of below the boiling point using di-t-butylperoxide as an initiator. Then 500 parts of n-butylacrylate and 100 parts of styrene were added to the reactant, and the mixture was graft-polymerized for 4 hours using di-t-butylperoxide as an initiator, followed by distilling away the DMF under vacuum-drying, thereby a resin charge control agent 5 was prepared that had a volume resistivity of 9.3 Log Ω·cm and a mass average molecular mass of $3\times10^4$, the temperature was 101° C. at which the apparent viscosity was $10^4$ Pa·s, and the content was 6% that corresponding to components having a mass average molecular mass of $1\times10^3$ or less.

EXAMPLE 73

Colorants were treated by the following formulations.

| Yellow colorant formulation: | |
|---|---|
| binder resin TB1 | 100 parts |
| C.I. pigment yellow 180 | 100 parts |
| Red colorant formulation: | |
| binder resin TB1 | 100 parts |
| C.I. pigment red 122 | 100 parts |
| Blue colorant formulation: | |
| binder resin TB1 | 100 parts |
| C.I. pigment blue 15.3 | 100 parts |
| Black colorant formulation: | |
| binder resin TB1 | 100 parts |
| carbon black | 100 parts |

The materials were respectively mixed in a Henschel mixer, the mixture was subjected to an air-cooling two-roll mill and melted-kneaded for 15 minutes. Then the melted-kneaded material was calendered and cooled, followed by coarsely milled by a hammer mill thereby to prepare colorants treated with binder resins.

Toners were prepared by the following formulations.

| Yellow toner formulation: | |
|---|---|
| binder resin TB1 | 91 parts |
| yellow colorant treated with binder resin TB1 | 12 parts |
| resin charge control agent 1 | 3 parts |
| Magenta toner formulation: | |
| binder resin TB1 | 92 parts |
| red colorant treated with binder resin TB1 | 10 parts |
| resin charge control agent 1 | 3 parts |
| Cyan toner formulation: | |
| binder resin TB1 | 94 parts |
| blue colorant treated with binder resin TB | 16 parts |
| resin charge control agent 1 | 3 parts |
| Black toner formulation: | |
| binder resin TB1 | 90 parts |
| black colorant treated with binder resin TB1 | 12 parts |
| blue colorant treated with binder resin TB | 12 parts |
| resin charge control agent 1 | 3 parts |

The materials were respectively mixed in a Henschel mixer, the mixture was subjected to a roll mill heated to 110° C. and melted-kneaded for 30 minutes. Then the kneaded material was cooled, followed by coarsely milled by a hammer mill and finely milled by an alr-jet mill, then fine powders were removed by an air classifier thereby to prepare toners of respective colors. T1/T2 was 1.16 in the binder resin TB1 and the resin charge control agent 1.

The resulting toners were mixed with the following additives based on 100 parts of respective toners to prepare one-component colorants.

| | |
|---|---|
| hydrophobic silica<br>primary particle diameter: 0.02 μm | 2.5 parts |
| hydrophobic titanium oxide<br>primary particle diameter:<br>0.015 μm, specific surface area:<br>90 mg/cm$^2$ | 0.8 parts |

The resulting one-component developers were set in a commercially available digital full-color printer (IPSiO Color 6500, by Ricoh Co.) and images were formed. The resulting images were clear and far from defects like background smear. The developing roller was visually observed and the toner thin layer was confirmed to be uniform on the roller. The charge amount on the developing roller by an absorbing process was measured to be −35 μC/g in the yellow developer, −30 μC/g in the magenta developer, −31 μC/g in the cyan developer and −32 μC/g in the black developer. Images were similarly formed under a high temperature and high humidity condition of 27° C. and 80% RH and a low temperature and low humidity condition of 10° C. and 15% RH, consequently, excellent images were formed under both conditions without significant difference. A durability test was conducted such that a full-color image was formed continuously under normal temperature, low temperature and low humidity, high temperature and high humidity, and normal temperature conditions on a total of 40000 sheets, consequently, there appeared no significant difference on fixed images, and 40000th image was clear with no background smear.

The developing roller was visually observed and confirmed that the toner thin layer underwent no significant change on the roller, the charge amount of developers was stable such as −31 μC/g in the yellow developer, −29 μC/g in the magenta developer, −29 μC/g in the cyan developer and −27 μC/g in the black developer. No filming was observed on the developing roller, the blades and the photoconductor.

EXAMPLE 74

Colorants were treated by the following formulations.

| Yellow colorant formulation: | |
|---|---|
| binder resin TB2 | 100 parts |
| C.I. pigment yellow 180 | 100 parts |
| Red colorant formulation: | |
| binder resin TB2 | 100 parts |
| C.I. pigment red 146 | 100 parts |
| Blue colorant formulation: | |
| binder resin TB3 | 100 parts |
| C.I. pigment blue 15.3 | 100 parts |
| Black colorant formulation: | |
| binder resin TB3 | 100 parts |
| carbon black | 100 parts |

The materials were respectively mixed in a Henschel mixer, the mixture was subjected to an air-cooling two-roll mill and melted-kneaded for 15 minutes. Then the melted-kneaded material was calendered and cooled, followed by coarsely milled by a hammer mill thereby to prepare colorants treated with binder resins.

Toners were prepared by the following formulations.

| Yellow toner formulation: | |
|---|---|
| binder resin TB2 | 91 parts |
| yellow colorant treated with binder resin TB2 | 12 parts |
| resin charge control agent 2 | 3 parts |
| Magenta toner formulation: | |
| binder resin TB2 | 92 parts |
| red colorant treated with binder resin TB2 | 10 parts |
| resin charge control agent 2 | 3 parts |
| Cyan toner formulation: | |
| binder resin TB3 | 94 parts |
| blue colorant treated with binder resin TB | 36 parts |
| resin charge control agent 3 | 3 parts |
| Black toner formulation: | |
| binder resin TB3 | 90 parts |
| black colorant treated with binder resin TB3 | 12 parts |
| blue colorant treated with binder resin TB | 32 parts |
| resin charge control agent 4 | 3 parts |

The materials were respectively mixed in a Henschel mixer, the mixture was subjected to a two-axis continuous kneader heated to 80° C. and melted-kneaded. Then the kneaded material was cooled, followed by coarsely milled by a hammer mill and finely milled by an air-flow mill, then fine particles were removed by an air classifier thereby to prepare toners of respective colors. T1/T2 was 1.11 in the binder resin TB2 and the resin charge control agent 2, T1/T2 was 1.15 in the binder resin TB3 and the resin charge control agent 3, and T1/T2 was 1.21 in the binder resin TB3 and the resin charge control agent 4.

The resulting toners were mixed with the following additives based on 100 parts of respective toners.

| | |
|---|---|
| hydrophobic silica<br>primary particle diameter: 0.02 μm | 2.1 parts |
| hydrophobic titanium oxide<br>primary particle diameter:<br>0.015 μm, specific surface area:<br>120 mg/cm$^2$ | 1.0 parts |

Two-component developers were prepared by way of blending the respective toners of 6 parts and a silicone-resin coated carrier of 94 parts. The resulting two component developers were set in commercially available digital full-color printer (IPSiO Color 7100, by Ricoh Co.) and images were formed. The resulting images were clear without background smear. No problem appeared on images and charging under high temperature and high humidity condition as well as low temperature and low humidity condition. A durability test was conducted such that a full-color image was formed on 10000 sheets, consequently, there appeared no problem in images, and there existed no scattering within the apparatus and no deposition on the photoconductor.

COMPARATIVE EXAMPLE 25

Colorants were treated by the following formulations.

| Yellow colorant formulation: | |
|---|---|
| binder resin CTB1 | 100 parts |
| C.I. pigment yellow 180 | 100 parts |

-continued

| Red colorant formulation: | |
|---|---|
| binder resin CTB1 | 100 parts |
| C.I. pigment red 122 | 100 parts |
| Blue colorant formulation: | |
| binder resin CTB2 | 100 parts |
| C.I. pigment blue 15.3 | 100 parts |
| Black colorant formulation: | |
| binder resin CTB2 | 100 parts |
| carbon black | 100 parts |

The materials were respectively mixed in a Henschel mixer, the mixture was subjected to an air-cooling two-roll mill and melted-kneaded for 15 minutes. Then the melted-kneaded material was calendered and cooled, followed by coarsely milled by a hammer mill thereby to prepare colorants treated with binder resins.

Toners were prepared by the following formulations.

| Yellow toner formulation: | |
|---|---|
| binder resin CTB1 | 91 parts |
| yellow colorant treated with binder resin CTB1 | 12 parts |
| resin charge control agent 1 | 3 parts |
| Magenta toner formulation: | |
| binder resin CTB1 | 92 parts |
| red colorant treated with binder resin CTB1 | 10 parts |
| resin charge control agent 3 | 3 parts |
| Cyan toner formulation: | |
| binder resin CTB2 | 94 parts |
| blue colorant treated with binder resin CTB2 | 6 parts |
| resin charge control agent 5 | 3 parts |
| Black toner formulation: | |
| binder resin CTB2 | 90 parts |
| black colorant treated with binder resin CTB2 | 12 parts |
| blue colorant treated with binder resin CTB2 | 2 parts |
| resin charge control agent 5 | 3 parts |

The materials were respectively mixed in a Henschel mixer, the mixture was subjected to a roll mill heated to 100° C. and melted-kneaded for 20 minutes. Then the kneaded material was cooled, followed by coarsely milled by a hammer mill and finely milled by an air-jet mill, then fine powders were removed by an air classifier thereby to prepare toners of respective colors. T1/T2 was 1.20 in the binder resin CTB1 and the resin charge control agent 1, T1/T2 was 1.11 in the binder resin CTB1 and the resin charge control agent 3, and T1/T2 was 1.34 in the binder resin CTB2 and the resin charge control agent 5.

The resulting toners were mixed with the following additives based on 100 parts of respective toners to prepare one-component colorants.

| | |
|---|---|
| hydrophobic silica<br>primary particle diameter: 0.02 μm | 2.5 parts |
| hydrophobic titanium oxide<br>primary particle diameter:<br>0.015 μm, specific surface area:<br>90 mg/cm$^2$ | 0.8 parts |

The resulting one-component developers were set in a commercially available digital full-color printer (IPSiO Color 6500, by Ricoh Co.) and images were formed. The resulting images were clear and far from defects like background smear. The developing roller was visually observed and the toner thin layer was confirmed to be uniform on the roller. The charge amount on the developing roller by an absorbing process was measured to be −43 μC/g in the yellow developer, −36 μC/g in the magenta developer, −38 μC/g in the cyan developer and −35 μC/g in the black developer. When images were formed under a high temperature and high humidity condition of 27° C. and 80% RH, the images included irregularity or mutter. When images were formed under a low temperature and low humidity condition of 10° C. and 15% RH, the images were thin and of low density. When a durability test was conducted with forming full-color images continuously under normal temperature, low temperature and low humidity, high temperature and high humidity, and normal temperature conditions, problems appeared on the images, such as background smear, dusts and streaks.

When the developing roller was visually observed at that time, streaks had occurred circumferentially in the toner thin film on the photoconductor. The measurement of charge amount of the developers revealed the degradation such as −28 μC/g in the yellow developer, −22 μC/g in the magenta developer, −25 μC/g in the cyan developer and −21 μC/g in the black developer.

Synthesis of Titanium-Containing Catalyst

A mixture of 1700 parts of titanium diisopropoxy bis(triethanolaminate) and 130 parts of deionized water was poured into a reactor vessel equipped with a condenser, a stirrer and a nitrogen gas inlet capable of bubbling a liquid therein, the mixture was heated gradually to 90° C. and allowed to react at 90° C. for 4 hours (hydrolysis) while bubbling the liquid with nitrogen gas thereby to prepare titanium dihydroxy bis(triethanolaminate).

Other titanium-containing catalysts in Examples below, available for the present invention, may be prepared in similar synthetic processes.

Synthesis 1 of Linear Polyester Resin

Forty hundred and thirty parts of an adduct of bisphenol A with 2 moles of PO, 300parts of an adduct of bisphenol A with 3 moles of PO, 257 parts of terephthalic acid, 65 parts of isophthalic acid, 10 parts of maleic anhydride and 2 parts of titanium dihydroxy bis(triethanolaminate) as a condensation catalyst were poured into a reactor vessel equipped with a condenser, a stirrer and a nitrogen gas inlet, and the mixture was allowed to react at 220° C. for 10 hours under nitrogen gas flow while distilling away the water generated in the reaction. Then the reactant was allowed to react under a reduced pressure of 5 to 20 mmHg and taken out when the acid value came to 5 mgKOH/g. After cooling to room temperature, the reaction product was milled, consequently, a linear polyester resin AX1-1 was obtained.

The resulting AX1-1 contained no THF-insoluble matter, and had an acid value of 7 mgKOH/g, a hydroxyl value of 12 mgKOH/g, a glass transition temperature Tg of 60° C., a number average molecular mass Mn of 6940, and a peak top molecular mass Mp of 19100. The rate of the molecular mass of no more than 1500 was 1.2%.

Synthesis 1 of non-Linear Polyester Resin

Three hundred and fifty parts of an adduct of bisphenol A with 2 moles of E0, 326parts of an adduct of bisphenol A with 3 moles of PO, 278 parts of terephthalic acid, 40 parts of phthalic anhydride and 2 parts of titanium dihydroxy bis (triethanolaminate) as a condensation catalyst were poured into a reactor vessel equipped with a condenser, a stirrer and a nitrogen gas inlet, and the mixture was allowed to react at 230° C. for 10 hours under nitrogen gas flow while distilling away the water generated in the reaction. Then the reactant was allowed to react under a reduced pressure of 5 to 20 mmHg, cooled to 180° C. when the acid value came to 2 mgKOH/g or less, 62 parts of trimellitic anhydride was added, then the mixture was allowed to react under normal pressure of sealed atmosphere for 2 hours. After cooling to room temperature, the reaction product was milled, consequently, a non-linear polyester resin AX2-1 was obtained.

The resulting AX2-1 contained no THF-insoluble matter, and had an acid value of 35 mgKOH/g, a hydroxyl value of 17 mgKOH/g, a glass transition temperature Tg of 69° C., a number average molecular mass Mn of 3920, and a peak top molecular mass Mp of 11200. The rate of the molecular mass of no more than 1500 was 0.9%.

Synthesis 1 of Toner Binder

Four hundred parts of the AX1-1 and 600 parts of the AX2-1 were melted-kneaded using a continuous kneader at a jacket temperature of 150° C. and a residence time of 3 minutes. The melted resin was cooled to 30° C. over 4 minutes using a steel-belt cooler, then milled to prepare an inventive toner binder (resin A).

Synthesis 2 of Comparative Linear Polyester Resin

The reaction was carried out in the same manner as that of AX1-1 of synthesis example 1, except that the polycondensation catalyst was changed into titanium tetraisopropoxide. There arose such a problem that the reaction was stopped on the way due to catalysis deactivation and the distillation of generated water was also stopped, thus 2 parts of titanium tetraisopropoxide was added four times during the reaction thereby to obtain a comparative linear polyester resin CAX1-1.

The resulting CAX1-1 contained no THF-insoluble matter, and had an acid value of 7 mgKOH/g, a hydroxyl value of 12 mgKOH/g, a glass transition temperature Tg of 58° C., a number average molecular mass Mn of 6220 and a peak top molecular mass Mp of 18900. The rate of the molecular mass of no more than 1500 was 2.2%.

Synthesis 2 of Comparative Non-Linear Polyester Resin

The reaction was carried out in the same manner as that of AX2-1 in synthesis example 1, except that the polycondensation catalyst was changed into titanium tetraisopropoxide. The reaction was carried out under normal pressure for 16 hours and under a reduced pressure for 8 hours. The reaction velocity was slow, thus 2 parts of titanium tetraisopropoxide was added three times during the reaction thereby to obtain a comparative non-linear polyester resin CAX2-1.

The resulting CAX2-1 contained no THF-insoluble matter, and had an acid value of 34 mgKOH/g, a hydroxyl value of 16 mgKOH/g, a glass transition temperature Tg of 68° C., a number average molecular mass Mn of 3420 and a peak top molecular mass Mp of 12100. The rate of the molecular mass of no more than 1500 was 2.1%.

Synthesis 2 of Comparative Toner Binder

Four hundred parts of the CAX1-1 and 600 parts of the CAX2-1 were melted-kneaded using a continuous kneader at a jacket temperature of 150° C. and a residence time of 3 minutes. The melted resin was cooled to 30° C. over 4 minutes using a steel-belt cooler, then milled to prepare a comparative toner binder (resin B). The resin B was of intense purplish brown Synthesis 3 of Linear Polyester Resin A linear polyester resin AX1-2 was prepared by a similar reaction as that of AX1-1of the synthesis example 1, followed by cooling to room temperature and milling except that the polycondensation catalyst was changed into titanyl bis(triethanolaminate).

The resulting AX1-2 contained no THF-insoluble matter, and had an acid value of 8 mgKOH/g, a hydroxyl value of 10 mgKOH/g, a glass transition temperature Tg of 60° C., a number average molecular mass Mn of 6820 and a peak top molecular mass Mp of 20180. The rate of the molecular mass of no more than 1500 was 1.1%.

Synthesis 3 of non-Linear Polyester Resin

A linear polyester resin AX2-2 was prepared by a similar reaction as that of AX2-1of the synthesis example 1, followed by cooling to room temperature and milling except that the polycondensation catalyst was changed into titanyl bis(triethanolaminate).

The resulting AX2-2 contained no THF-insoluble matter, and had an acid value of 33 mgKOH/g, a hydroxyl value of 14 mgKOH/g, a glass transition temperature Tg of 70° C., a number average molecular mass Mn of 4200 and a peak top molecular mass Mp of 11800. The rate of the molecular mass of no more than 1500 was 0.8%.

Synthesis 3 of Toner Binder

The inventive toner binder resin (resin C) was prepared by powder-mixing 500 parts of the AX1-2 and 500 parts of the AX2-2 for 5 minutes using a Henschel mixer.

Production Example of Toner A

| Formulation | |
|---|---|
| resin A | 100 parts |
| magenta pigment (C.I. Pigment Red 269) | 5 parts |
| charge control agent (E-84) *1) | 2 parts |

*1) by Orient Chemical Co.

Among the ingredients described above, the pigment and the polyester resin, and also pure water were blended in a mass ratio of 1:1:0.5 and kneaded using twin rolls. The mixture was kneaded at 70° C., then the water was evaporated by raising the roll temperature to 120° C. thereby to prepare a master batch.

Using the prepared master batch, the ingredients were mixed based on the formulation described above, melted-kneaded at 50° C. for 40 minutes using twin rolls and cooled, followed by coarsely milled by a hammer mill and finely milled by an air-jet mill, then the resulting fine powders were classified by an air classifier thereby to prepare a base toner having a volume average particle diameter D4 of 6.8 μm. In addition, 0.15 part of zinc stearate (by Sakai Chemical Industry Co.), I part of hydrophilic silica (by Clariant Japan K.K.) and 1 part of hydrophobic titanium oxide (by Tayca Co.) were added and mixed by a mixer to prepare toner A.

The resulting toner A had a volume average particle diameter Dv of 6.8 μm, a ratio Dv/Dn of 1.38, and shape factors SF-1, SF-2 of 151, 142.

Production Example of Toner B

Toner B was prepared in the same manner as the production example of toner A except that the magenta pigment was changed into that shown below.

| | |
|---|---|
| yellow pigment (C.I. Pigment Yellow 180) | 5 parts |

The resulting toner B had a volume average particle diameter Dv of 6.8 μm, a ratio Dv/Dn of 1.35, and shape factors SF-1, SF-2 of 150, 141.

Production Example of Toner C

Toner C was prepared in the same manner as the production example of toner A except that the magenta pigment was changed into that shown below.

| | |
|---|---|
| yellow pigment (C.I. Pigment Yellow 155) | 5 parts |

The resulting toner C had a volume average particle diameter Dv of 6.8 μm, a ratio Dv/Dn of 1.38, and shape factors SF-1, SF-2 of 158, 150.

Production Example of Toner D

Toner D was prepared in the same manner as the production example of toner A except that the magenta pigment was changed into that shown below.

magenta pigment (C.I. Pigment Red 184 (mixture of C.I. Pigment

| | |
|---|---|
| magenta pigment ((C.I. Red 184 (mixture of C.I. Pigment Red 146 and C.I. Pigment Red 147)) | 5 parts |

The resulting toner D had a volume average particle diameter Dv of 6.8 μm, a ratio Dv/Dn of 1.36, and shape factors SF-1, SF-2 of 150, 142.

Production Example of Toner E

Toner E was prepared in the same manner as the production example of toner A except that the magenta pigment was changed into that shown below.

| | |
|---|---|
| yellow pigment (C.I. Pigment Yellow 17) | 5 parts |

The resulting toner E had a volume average particle diameter Dv of 6.8 μm, a ratio Dv/Dn of 1.35, and shape factors SF-1, SF-2 of 154, 148.

Production Example of Toner F

Toner F was prepared in the same manner as the production example of toner A except that the magenta pigment was changed into that shown below.

| | |
|---|---|
| cyan pigment (C.I. Pigment Blue 15:2) | 5 parts |

The resulting toner F had a volume average particle diameter Dv of 6.8 μm, a ratio Dv/Dn of 1.36, and shape factors SF-1, SF-2 of 151, 145.

Production Example of Toner G

Toner G was prepared in the same manner as the production example of toner A except that the resin A was changed into that shown below.

| | |
|---|---|
| resin B | 100 parts |

The resulting toner G had a volume average particle diameter Dv of 6.8 μm, a ratio Dv/Dn of 1.32, and shape factors SF-1, SF-2 of 153, 149.

Production Example of Toner H

Toner H was prepared in the same manner as the production example of toner B except that the resin A was changed into that shown below.

| | |
|---|---|
| resin B | 100 parts |

The resulting toner H had a volume average particle diameter Dv of 6.8 μm, a ratio Dv/Dn of 1.33, and shape factors SF-1, SF-2 of 159, 148.

Production Example of Toner J

Toner J was prepared in the same manner as the production example of toner A except that the wax shown below was added.

| | |
|---|---|
| Carnauba wax | 5 parts |

The resulting toner J had a volume average particle diameter Dv of 6.8 μm, a ratio Dv/Dn of 1.32, and shape factors SF-1, SF-2 of 152, 145.

Production Example of Toner K

Toner K was prepared in the same manner as the production example of toner B except that the wax shown below was added.

| | |
|---|---|
| Carnauba wax | 5 parts |

The resulting toner K had a volume average particle diameter Dv of 6.8 μm, a ratio Dv/Dn of 1.37, and shape factors SF-1, SF-2 of 151, 149.

Production Example of Toner L

Toner L was prepared in the same manner as the production example of toner F except that the wax shown below was added.

| | |
|---|---|
| Carnauba wax | 5 parts |

The resulting toner L had a volume average particle diameter Dv of 6.8 μm, a ratio Dv/Dn of 1.34, and shape factors SF-1, SF-2 of 155, 144.

Production Example of Toner M

Toner M was prepared in the same manner as the production example of toner A except that the resin A was changed into that shown below.

| | |
|---|---|
| resin C | 100 parts |

The resulting toner M had a volume average particle diameter Dv of 6.8 μm, a ratio Dv/Dn of 1.31, and shape factors SF-1, SF-2 of 159, 142.

Evaluation Process (1) Color Difference in L*a*b* Color Specification System

Figure 12:
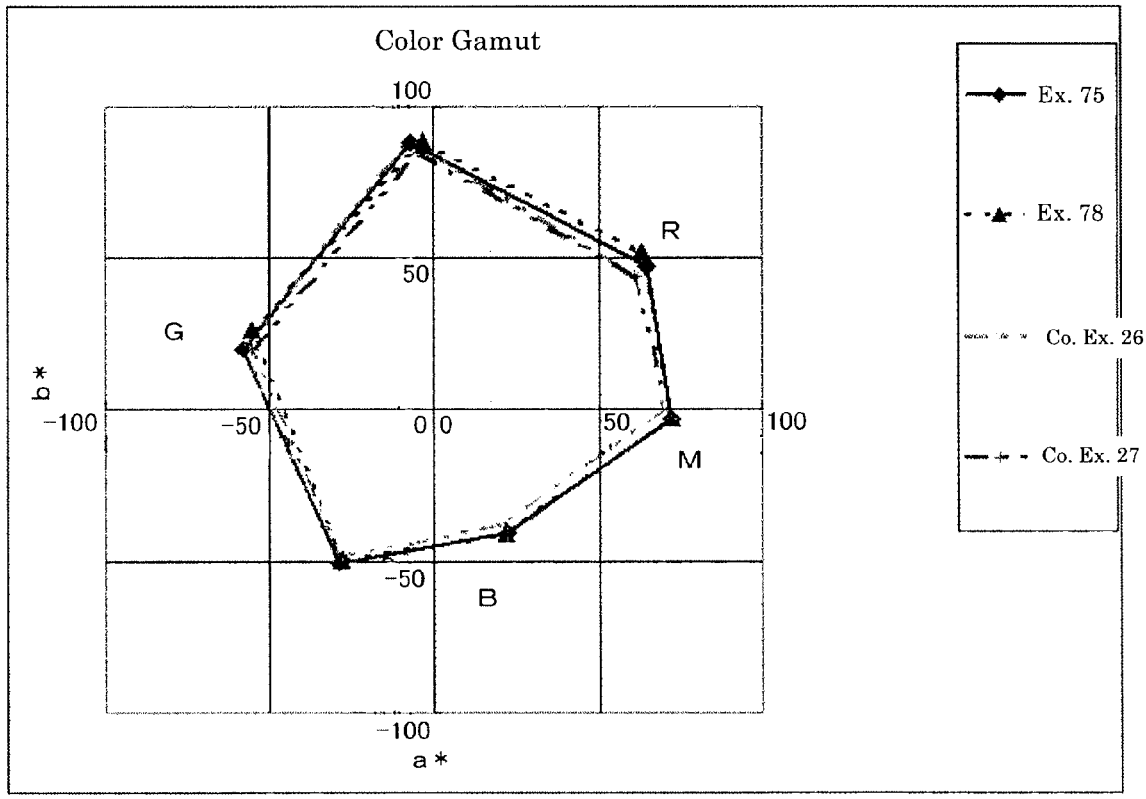
FIG. 12 a graph that plots the values measured for a* and b* in L*a*b* color specification system with respect to the toners of Examples 75, 78 and Comparative Examples 26, 27.
Figure 13:
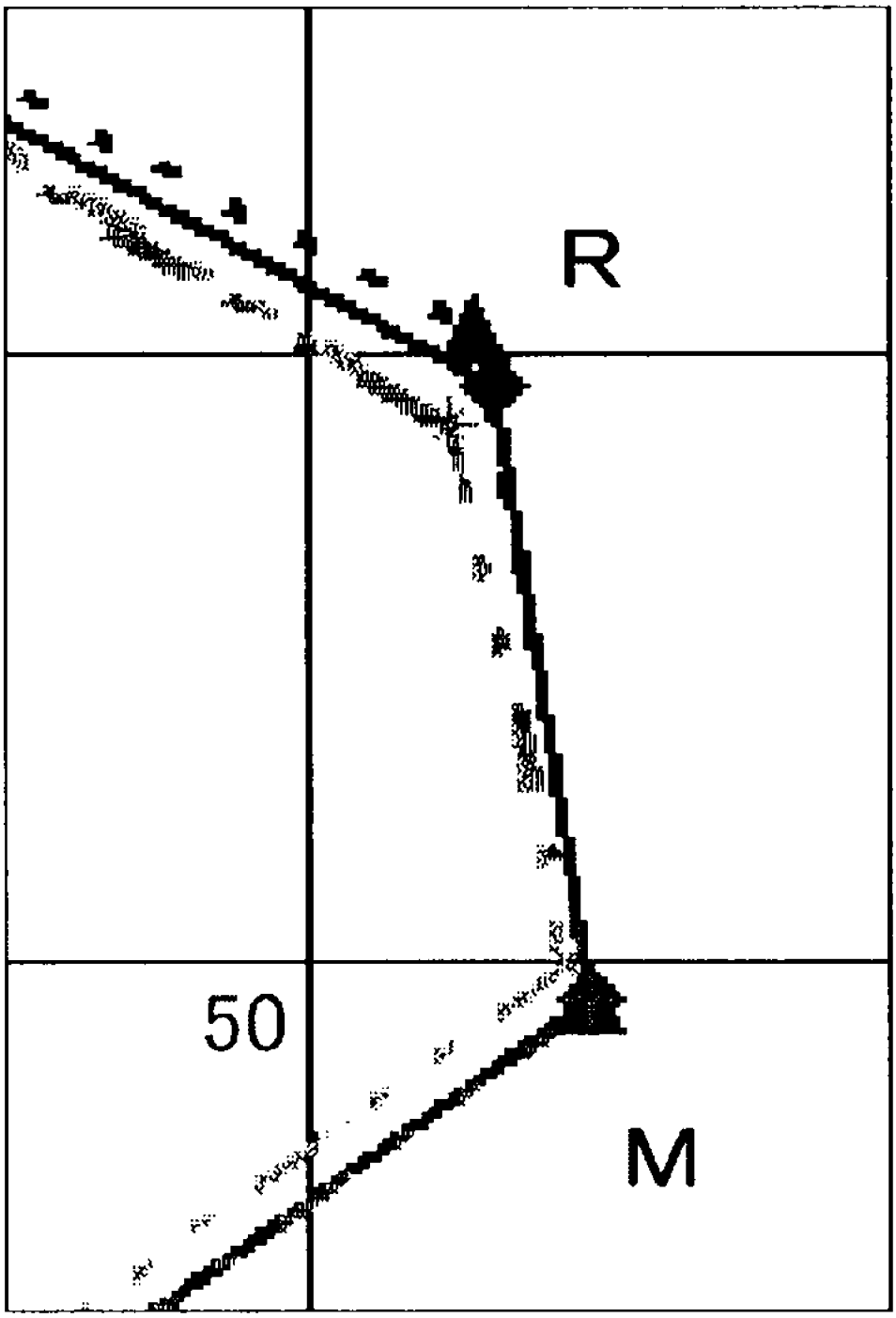
FIG. 13 is a partially enlarged view of FIG. 12.

Using an image forming apparatus, respective image densities at a 100% image-area ratio in monochrome mode of yellow (Y), magenta (M) and cyan (C) were measured, and intermediate colors of blue (B), green (G) and red (R) were measured by color-mixing 50% of yellow (Y), magenta (M) or cyan (C). The respective image densities were measured using X-Rite 938 (by X-Rite Inc.) in a condition of observable eyespot 20 at observing light D50 (JIS Z-8720 (1983)), then a* and b* where the image density ID (−Log Reflectivity) being "1.0" was measured. The results are shown in FIGS. 11 to 15. FIG. 13 is a partially enlarged view of FIG. 12, and FIG. 15 is a partially enlarged view of FIG. 14.

When toners are overlapped for two or more colors, images are formed firstly by magenta, followed by cyan, and followed by yellow.

EXAMPLES 75 TO 78 AND COMPARATIVE EXAMPLES 26 TO 29

The toner kits to evaluate toners of Examples 75 to 78 and Comparative Examples 26 to 29 are shown in Table 4.

TABLE 4

| | magenta toner | yellow toner | cyan toner |
|---|---|---|---|
| Ex. 75 | toner A | toner B | toner F |
| Ex. 76 | toner A | toner C | toner F |
| Ex. 77 | toner J | toner K | toner L |
| Ex. 78 | toner M | toner B | toner F |
| Com. Ex. 26 | toner G | toner B | toner F |
| Com. Ex. 27 | toner A | toner H | toner F |
| Com. Ex. 28 | toner D | toner B | toner F |
| Com. Ex. 29 | toner A | toner E | toner F |

The evaluation results are shown in Tables 5, 6 and FIGS. 11 to 15. In the figure where a*b* is plotted in L*a*b* color specification system, the wider area enclosed by six colors of YIR/MIBIC/G indicates that color reproducibility is more excellent.

FIGS. 12 and 13 demonstrate that Examples 75 and 78 definitely represent wider color reproducible area in terms of R and M compared to Comparative Example 26 and 27, in particular the color reproducible area is excellently wide for R.

On the contrary, Comparative Example 26 represents a wider color reproducible area in terms of G/C, however, narrow in terms of R/M. Comparative Example 27 represents a wide area in terms of M, however, remarkably narrow in terms of GIY/R.

As such, it is clear that Example 75 and 78 represent color reproducibility over entire regions, in particular wide in R.

Figure 14:
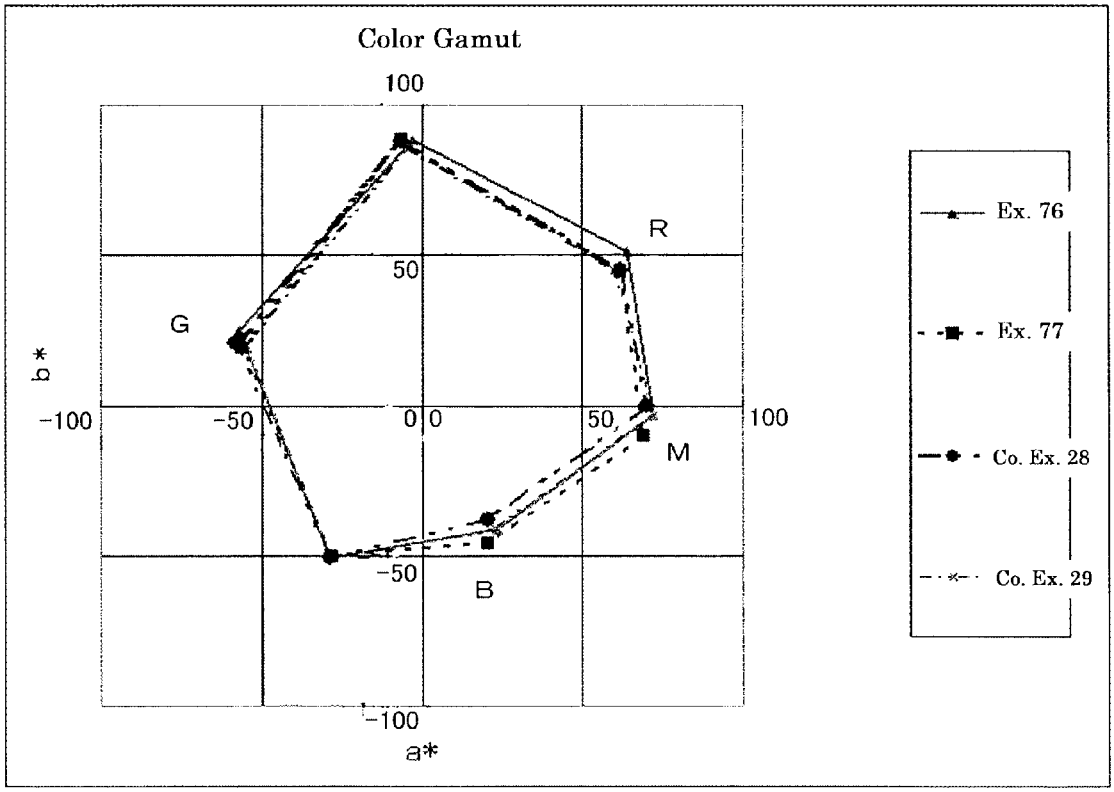
FIG. 14 a graph that plots the values measured for a* and b* in L*a*b* color specification system with respect to the toners of Examples 76, 77 and Comparative Examples 28, 29.
Figure 15:
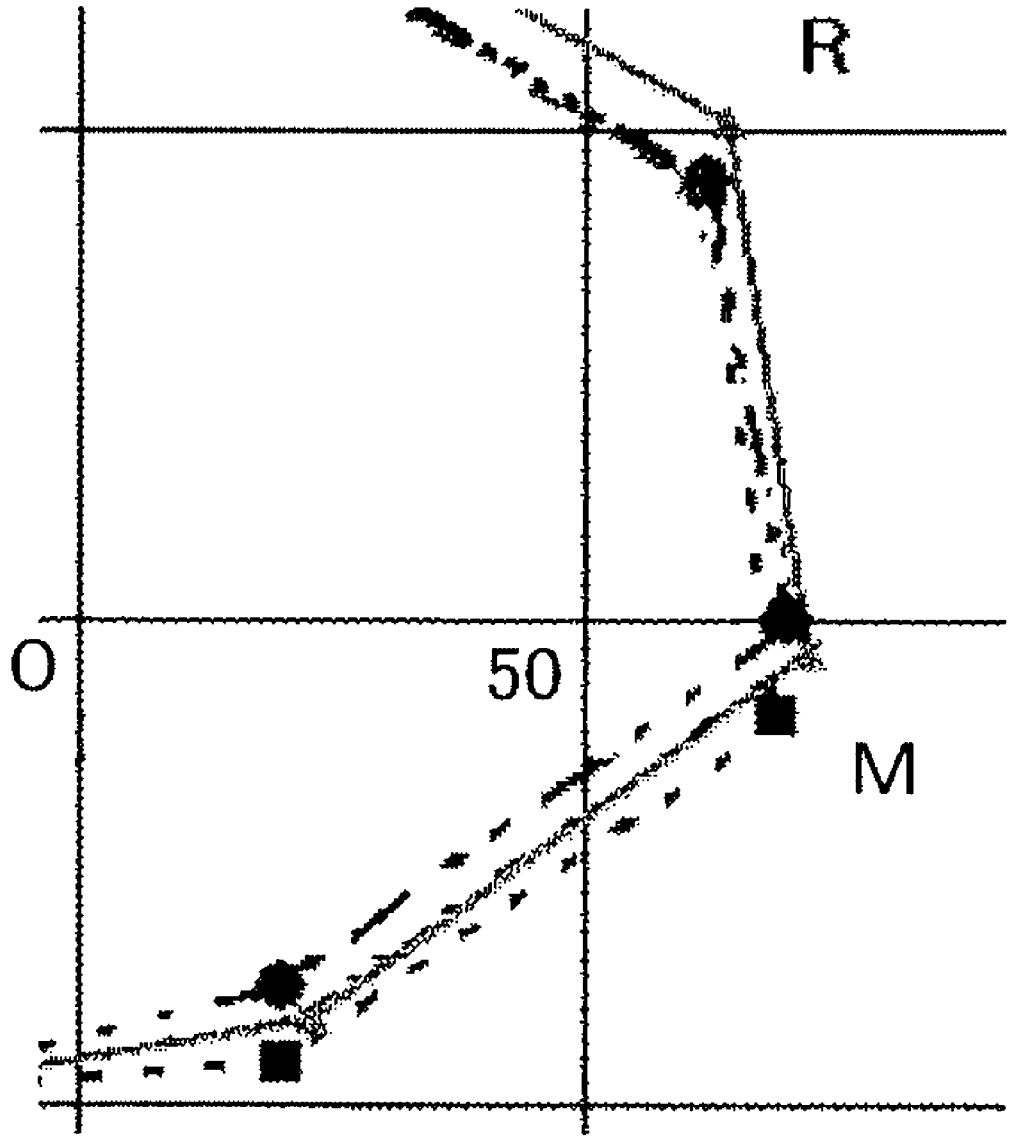
FIG. 15 is a partially enlarged view of FIG. 14.

It is also clear from FIGS. 14 and 15 that Example 76 represents a wide area particularly in R without sacrificing the other regions, and Example 77 is not as wide as Example 76 in terms of R but wide in terms of M/B.

Image Evaluation

The toners described above and Cu—Zn ferrite carrier (coated with a silicone resin, average particle diameter: 40 μm) were blended by 5% and 95% as content to prepare two-component developers, which were used to develop a draft photograph containing flesh color. The development was carried out on 1000 sheets with full-color mode of 400 dpi using a modified copier (Imagio Neo C385, by Ricoh Co.), and the developed images were evaluated visually by 50 persons and ranked in accordance with the following criteria. The results are shown in Table 5.

Sensitive Evaluation for Flesh Color Photography

The evaluation results were ranked under the following five steps with respect to superiority for flesh color on the basis of human visual inspection.

The evaluation was such as full marks being 100 points, and the lowest being 0 point, then the points by 50 persons being averaged.

A: very good, 80 points or higher
B: good, 60 to 79 points
C: ordinary, 40 to 59 points
D: bad, 20 to 39 points
E: very bad, 19 points or lower

TABLE 5

| | Sensitive Evaluation for Flesh Color Photography |
|---|---|
| Ex. 75 | B |
| Ex. 76 | B |
| Ex. 77 | A |
| Ex. 78 | B |
| Com. Ex. 26 | D |
| Com. Ex. 27 | D |
| Com. Ex. 28 | C |
| Com. Ex. 29 | C |

TABLE 6

| | | a* | b* |
|---|---|---|---|
| Ex. 75 | Y | −6.79 | 88.02 |
| | R | 64.53 | 47.35 |
| | M | 72.17 | −3 |
| | B | 22.3 | −41.01 |
| | C | −28.85 | −50.59 |
| | G | −58 | 20.15 |
| Ex. 76 | Y | −3 | 88.3 |
| | R | 64 | 51 |
| | M | 72.17 | −3 |
| | B | 23.1 | −41.2 |
| | C | −28.6 | −50.4 |
| | G | −57 | 25 |
| Ex. 77 | Y | −6.8 | 88.3 |
| | R | 62.3 | 44.2 |
| | M | 69 | −10 |
| | B | 20 | −46 |
| | C | −28.5 | −50.23 |
| | G | −56 | 19 |
| Ex. 78 | Y | −3 | 88.5 |
| | R | 63 | 52 |
| | M | 72.12 | −3 |
| | B | 22 | −40.8 |
| | C | −28 | −49.9 |
| | G | −55 | 26 |
| Com. Ex. 26 | Y | −6.6 | 89 |
| | R | 61 | 44 |
| | M | 70.2 | −0.2 |
| | B | 21 | −38 |
| | C | −30 | −49 |
| | G | −58.2 | 20.3 |
| Com. Ex. 27 | Y | −4 | 85 |
| | R | 61 | 44 |
| | M | 72.17 | −3 |
| | B | 22.56 | −41.16 |
| | C | −28.1 | −50.6 |
| | G | −55 | 20 |
| Com. Ex. 28 | Y | −6.6 | 88.1 |
| | R | 62 | 45 |
| | M | 70.2 | −0.2 |
| | B | 20 | −38 |
| | C | −28.75 | −50.48 |
| | G | −58.2 | 20.3 |
| Com. Ex. 29 | Y | −4 | 86 |
| | R | 60 | 45 |
| | M | 72.17 | −3 |
| | B | 22.56 | −41.16 |
| | C | −28.1 | −50.6 |
| | G | −55 | 20 |

INDUSTRIAL APPLICABILITY

The inventive toner may exhibit excellent blocking resistance and low temperature fixability, provide high quality images stably with time under such conditions as high temperature and high humidity, low temperature and low humidity, or outputting larger area images, without such problems as decreasing charging capacity due to firm adhesion of toners onto carriers or developing sleeves, therefore, is available as an electrostatic image developing toner.

The inventive toner kit may represent wide reproducible regions in terms of yellow and magenta colors, in particular of intermediate flesh and red colors, and may also decrease scattering of magenta and yellow toners in particular, therefore, is available as a kit for developing electrostatic latent images.

The invention claimed is:

1. A toner, comprising a colorant and a binder resin, wherein the binder resin comprises a polyester resin that is prepared by a polycondensation reaction of a polyol and a polycarboxylic acid in the presence of at least a titanium-containing catalyst expressed by General Formula (I) or (II), wherein an amount of the titanium-containing catalyst in the polycondensation reaction is from 0.0001 to 0.8% by mass based on the resulting polycondensation product in view of polymerization activity, wherein the polyol and the polycarboxylic acid are reacted in a ratio of polyol/polycarboxylic acid of from 2/1 to 1/2 in terms of equivalent ratio [OH]/[COOH];

characterized in that the toner has a volume average particle diameter of 2.0 μm to 10.0 μm and a ratio Dv/Dn of 1.00 to 1.40, in which Dv represents a volume average particle diameter and Dn represents a number average particle diameter,

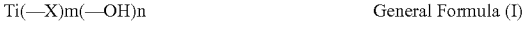

General Formula (I)

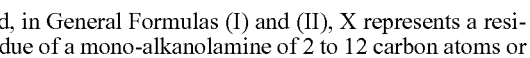

General Formula (II)

and, in General Formulas (I) and (II), X represents a residue of a mono-alkanolamine of 2 to 12 carbon atoms or a polyalkanolamine from which a hydrogen atom of one hydroxyl group is removed; other hydroxyl group(s) and still other hydroxyl group(s), within the polyalkanolamine molecule that has a directly bonding Ti atom, may polycondense to form a ring structure; other hydroxyl group(s) and still other hydroxyl group(s) may polycondense intermolecularly to form a repeating structure; and the polymerization degree is 2 to 5 in a case of forming the repeating structure;

R represents one of a hydrogen atom and alkyl groups of 1 to 8 carbon atoms that may have 1 to 3 ether bonds; "m" is an integer of 1 to 4; "n" is an integer of 0 to 3; the sum of "m" and "n" is 4; "p" is an integer of 1 or 2; "q" is an integer of 0 or 1; the sum of "p" and "q" is 2; and in a case that "m" and "p" is 2 or more, the respective Xs may be identical or different from each other.

2. The toner according to claim 1, wherein the polyester resin comprises at least a species of polyester resin that is prepared by a polycondensation reaction in the presence of a titanium-containing catalyst expressed by General Formula (I) or (II), and X in General Formulas (I) and (II) represents a residue of a dialkanolamine or a trialkanolamine from which a hydrogen atom of one hydroxyl group is removed.

3. The toner according to claim 1, wherein the polyester resin comprises at least a species of polyester resin that is prepared by a polycondensation reaction in the presence of a titanium-containing catalyst expressed by General Formula (I) or (II), in which "m" or "p" is 2 or more, and all of Xs are an identical group.

4. The toner according to claim 1, wherein the polyester resin comprises at least a species of polyepoxide-modified resin.

5. The toner according to claim 1, wherein the polyester resin comprises substantially no THF insoluble matter, the content of the ingredients having a molecular mass of 500 or less is no more than 4% by mass in the molecular mass distribution based on gel permeation chromatography, and a main peak exists within a range of 3000 to 9000 in the molecular mass distribution.

6. The toner according to claim 1, wherein the binder resin represents an endothermic peak within a range of 60° C. to 70° C. under the measurement using a differential scanning calorimeter (DSC).

7. The toner according to claim 1, wherein the binder resin has a ratio Mw/Mn of 2 to 10, in which Mw represents a mass average molecular mass and Mn represents a number average molecular mass.

8. The toner according to claim 1, wherein the binder resin has an acid value of 10 mgKOH/g or less.

9. The toner according to claim 1, wherein the binder resin represents a temperature within a range of 95° C. to 120° C. at which the apparent viscosity comes to 103 Pa·s measured by a flow tester.

10. A toner kit, comprising a toner, wherein the toner kit comprises a colorant and a binder resin, the binder resin comprises a polyester resin that is prepared by a polycondensation reaction of a polyol and a polycarboxylic acid in the presence of at least a titanium-containing catalyst expressed by General Formula (I) or (II), wherein an amount of the titanium-containing catalyst in the polycondensation reaction is from 0.0001 to 0.8% by mass based on the resulting polycondensation product in view of polymerization activity, wherein the polyol and the polycarboxylic acid are reacted in a ratio of polyol/polycarboxylic acid of from 2/1 to 1/2 in terms of equivalent ratio [OH]/[COON];

the toner has a volume average particle diameter of 2.0 μm to 10.0 μm and a ratio Dv/Dn of 1.00 to 1.40, in which Dv represents a volume average particle diameter and Dn represents a number average particle diameter, Ti(—X)m(—OH)n General Formula (I)

O═Ti(—X)p(—OR)q General Formula (II)

in General Formulas (I) and (II), X represents a residue of a mono-alkanolamine of 2 to 12 carbon atoms or a polyalkanolamine from which a hydrogen atom of one hydroxyl group is removed; other hydroxyl group(s) and still other hydroxyl group(s), within the polyalkanolamine molecule that has a directly bonding Ti atom, may polycondense to form a ring structure; other hydroxyl group(s) and still other hydroxyl group(s) may polycondense intermolecularly to form a repeating structure; and the polymerization degree is 2 to 5 in a case of forming the repeating structure;

R represents one of a hydrogen atom and alkyl groups of 1 to 8 carbon atoms that may have 1 to 3 ether bonds; "m" is an integer of 1 to 4; "n" is an integer of 0 to 3; the sum of "m" and "n" is 4; "p" is an integer of 1 or 2; "q" is an integer of 0 or 1; the sum of "p" and "q" is 2; and in a case that "m" and "p" is 2 or more, the respective Xs may be identical or different each other;

wherein the toner kit comprises a yellow toner, a magenta toner and a cyan toner, the magenta toner comprises an organic pigment expressed by the following Structural Formula (1), and the yellow toner comprises an organic pigment having two units per molecule each expressed by Structural Skeleton (A) and no halogen atom;

Structural Formula (1)

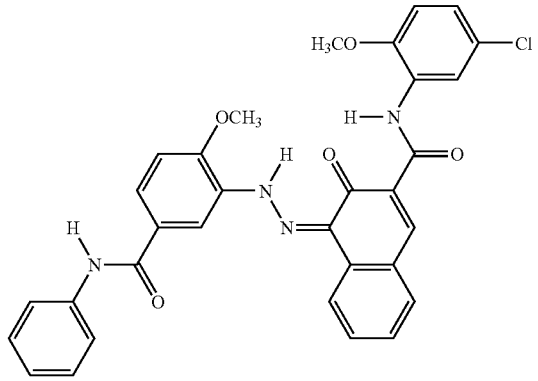

Structural Skeleton (A)

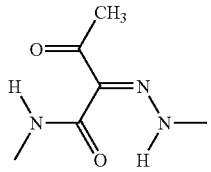

in the Structural Formula (1) and Structural Skeleton (A), ═C═N—NH— may be ═CH—N═N—.

11. The toner kit according to claim 10, wherein the organic pigment, having two units per molecule each expressed by Structural Skeleton (A) and no halogen atom, is an organic pigment expressed by Structural Formula (2) or (3)

Structural Formula (2)

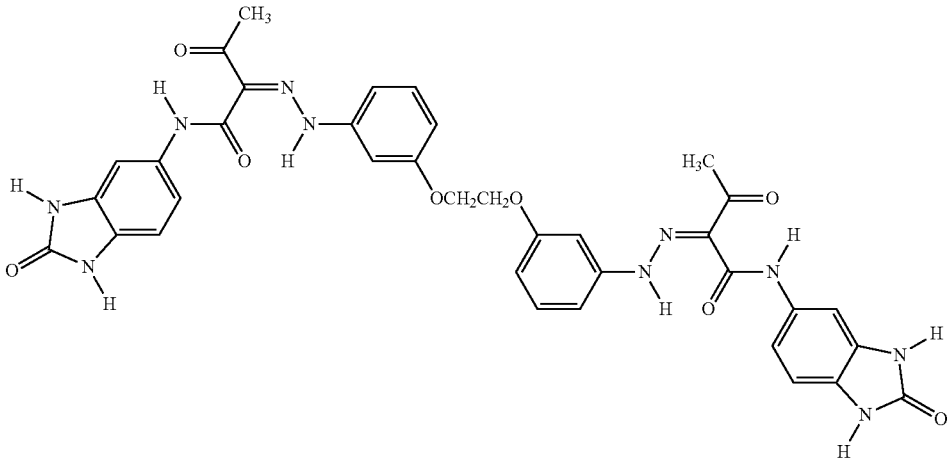

-continued

Structural Formula (3)

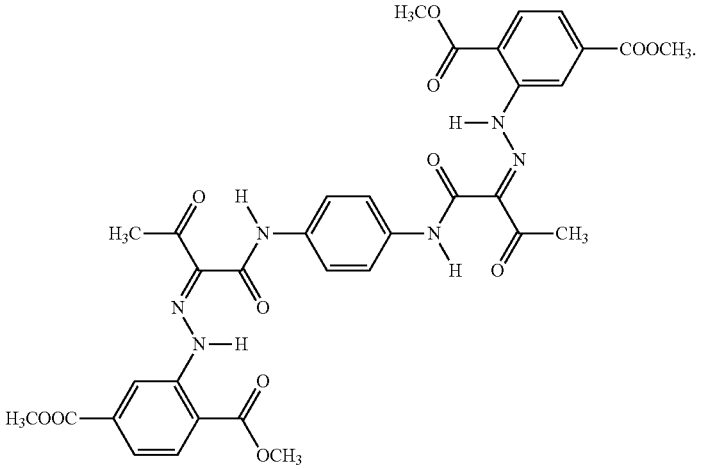

12. An image forming apparatus, comprising:

a latent electrostatic image bearing member, a latent electrostatic image forming unit configured to form a latent electrostatic image on the latent electrostatic image bearing member, at least three developing units configured to develop a visible image using a toner kit, a transfer unit configured to transfer the visible image onto a recording medium, and a fixing unit configured to fix the transferred image on the recording medium, wherein the toner kit comprises a toner that comprises a colorant and a binder resin, the binder resin comprises a polyester resin that is prepared by a polycondensation reaction of a polyol and a polycarboxylic acid in the presence of at least a titanium-containing catalyst expressed by General Formula (I) or (II), wherein an amount of the titanium-containing catalyst in the polycondensation reaction is from 0.0001 to 0.8% by mass based on the resulting polycondensation product in view of polymerization activity, wherein the polyol and the polycarboxylic acid are reacted in a ratio of polyol/polycarboxylic acid of from 2/1 to 1/2 in terms of equivalent ratio [OH]/[COOH];

the toner has a volume average particle diameter of 2.0 μm to 10.0 μm and a ratio Dv/Dn of 1.00 to 1.40, in which Dv represents a volume average particle diameter and Dn represents a number average particle diameter, Ti(—X)m(—OH)n General Formula (I)

O═Ti(—X)p(—OR)q General Formula (II)

in General Formulas (I) and (II), X represents a residue of a mono-alkanolamine of 2 to 12 carbon atoms or a polyalkanolamine from which a hydrogen atom of one hydroxyl group is removed; other hydroxyl group(s) and still other hydroxyl group(s), within the polyalkanolamine molecule that has a directly bonding Ti atom, may polycondense to form a ring structure; other hydroxyl group(s) and still other hydroxyl group(s) may polycondense intermolecularly to form a repeating structure; and the polymerization degree is 2 to 5 in a case of forming the repeating structure;

R represents one of a hydrogen atom and alkyl groups of 1 to 8 carbon atoms that may have 1 to 3 ether bonds; "m" is an integer of 1 to 4; "n" is an integer of 0 to 3; the sum of "m" and "n" is 4; "p" is an integer of 1 or 2; "q" is an integer of 0 or 1; the sum of "p" and "q" is 2; and in a case that "m" and "p" is 2 or more, the respective Xs may be identical or different each other;

wherein the toner kit comprises a yellow toner, a magenta toner and a cyan toner, the magenta toner comprises an organic pigment expressed by the following Structural Formula (1), and the yellow toner comprises an organic pigment having two units per molecule each expressed by Structural Skeleton (A) and no halogen atom;

Structural Formula (1)

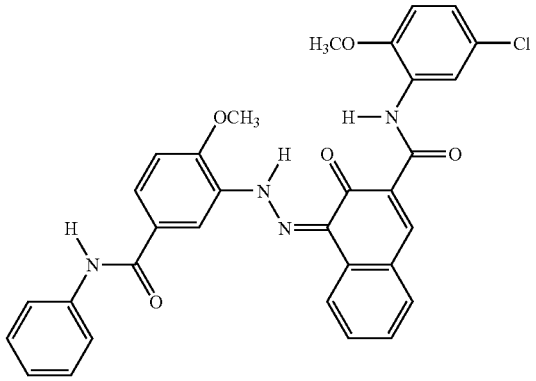

Structural Skeleton (A)

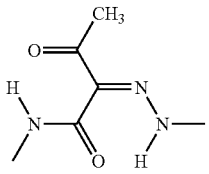

in the Structural Formula (1) and Structural Skeleton (A), ═C═N—NH— may be ═CH—N═N—.

13. The toner kit according to claim 10, wherein the polyester resin comprises at least a species of polyester resin that is prepared by a polycondensation reaction in the presence of a titanium-containing catalyst expressed by General Formula (I) or (II), and X in General Formulas (I) and (II) represents a residue of a dialkanolamine or a trialkanolamine from which a hydrogen atom of one hydroxyl group is removed.

14. The toner kit according to claim 10, wherein the polyester resin comprises at least a species of polyester resin that is prepared by a polycondensation reaction in the presence of a titanium-containing catalyst expressed by General Formula (I) or (II), in which "m" or "p" is 2 or more, and all of Xs are an identical group.

15. The toner kit according to claim 10, wherein the polyester resin comprises at least a species of polyepoxide-modified resin.

16. The toner kit according to claim 10, wherein the binder resin has an acid value of 10 mgKOH/g or less.

17. The image forming apparatus according to claim 12, wherein the polyester resin comprises at least a species of polyester resin that is prepared by a polycondensation reaction in the presence of a titanium-containing catalyst expressed by General Formula (I) or (II), and X in General Formulas (I) and (II) represents a residue of a dialkanolamine or a trialkanolamine from which a hydrogen atom of one hydroxyl group is removed.

18. The image forming apparatus according to claim 12, wherein the polyester resin comprises at least a species of polyester resin that is prepared by a polycondensation reaction in the presence of a titanium-containing catalyst expressed by General Formula (I) or (II), in which "m" or "p" is 2 or more, and all of Xs are an identical group.

19. The image forming apparatus according to claim 12, wherein the polyester resin comprises at least a species of polyepoxide-modified resin.

20. The image forming apparatus according to claim 12, wherein the binder resin has an acid value of 10 mgKOH/g or less.

21. The toner according to claim 1, wherein the colorant is a dye or pigment and colorant is present in an amount of from 1 to 15% by mass with respect to the amount of toner.

22. The toner according to claim 1, wherein the colorant is a magnetic powder and is present in an amount of from 15 to 70% by mass with respect to the amount of toner.

* * * * *